US012753994B2

(12) United States Patent
Underwood

(10) Patent No.: US 12,753,994 B2
(45) Date of Patent: Oct. 6, 2026

(54) LOCATING FASTENER FOR FIREARM OPTIC

(71) Applicant: AXTS INC, Redmond, OR (US)

(72) Inventor: Joshua A. Underwood, Redmond, OR (US)

(73) Assignee: AXTS INC, Redmond, OR (US)

( * ) Notice: Subject to any disclaimer, the term of this patent is extended or adjusted under 35 U.S.C. 154(b) by 0 days.

(21) Appl. No.: 19/309,072

(22) Filed: Aug. 25, 2025

(65) Prior Publication Data

US 2025/0377187 A1 Dec. 11, 2025

Related U.S. Application Data

(62) Division of application No. 18/480,425, filed on Oct. 3, 2023, now Pat. No. 12,405,089.

(60) Provisional application No. 63/417,236, filed on Oct. 18, 2022, provisional application No. 63/412,758, filed on Oct. 3, 2022.

(51) Int. Cl.
*F41G 11/00* (2006.01)
*F41A 21/36* (2006.01)

(52) U.S. Cl.
CPC ..... *F41G 11/001* (2013.01); *F41A 21/36* (2013.01); *F41G 11/003* (2013.01)

(58) Field of Classification Search
CPC ..... F41G 1/30; F41G 11/001; F41G 11/002; F41G 11/003
USPC ..... 42/113
See application file for complete search history.

(56) References Cited

U.S. PATENT DOCUMENTS 2,043,430 A 6/1936 Doe
4,023,914 A 5/1977 Holmes
4,076,064 A 2/1978 Holmes
(Continued)

FOREIGN PATENT DOCUMENTS

AT 15586 U1 2/2018
WO 2023249525 12/2023

OTHER PUBLICATIONS

Southwest Precision; Instagram; at least as early as Oct. 2, 2022.
(Continued)

*Primary Examiner* — Bret Hayes
(74) *Attorney, Agent, or Firm* — Schwabe Williamson & Wyatt

(57) ABSTRACT

In various embodiments, an apparatus comprises a locating optic assembly mount arranged to receive an optic sight or an adapter on which the optic sight is installable, wherein the locating optic assembly mount includes: one or more locating fastener openings to receive one or more locating fasteners with threaded sections and non-threaded shoulders, wherein the non-threaded shoulders extend through the optic sight or the adapter and below a surface located below the optic sight or the adapter, each locating fastener opening including: a threaded hole to mate with the threaded section of the corresponding locating fastener; and a counter opening located above the threaded hole, wherein the counter opening is arranged to slip fit with the non-threaded shoulder of the corresponding locating fastener to align a center axis of the locating fastener with a center axis of the locating fastener openings. Other embodiments may be disclosed and/or claimed.

38 Claims, 37 Drawing Sheets

(56) References Cited

U.S. PATENT DOCUMENTS

| | | | | |
|---|---|---|---|---|
| 4,341,022 | A * | 7/1982 | Santoro | F41G 11/001 42/127 |
| 4,501,071 | A * | 2/1985 | Manske | F41G 11/001 42/127 |
| 4,959,908 | A | 10/1990 | Weyrauch | |
| 5,425,191 | A * | 6/1995 | Taylor | F41G 11/001 42/124 |
| 5,467,552 | A | 11/1995 | Cupp | |
| 6,318,015 | B1 | 11/2001 | Baumann | |
| 9,423,212 | B2 | 8/2016 | Campean | |
| 10,024,628 | B2 | 7/2018 | Toner | |
| 10,684,100 | B2 | 6/2020 | Pniel | |
| 10,871,350 | B1 | 12/2020 | Thomas et al. | |
| 11,002,517 | B1 | 5/2021 | Holly | |
| 11,460,274 | B2 | 10/2022 | Dawson | |
| 11,480,414 | B2 | 10/2022 | Salinas et al. | |
| 11,788,818 | B2 | 10/2023 | Roth | |
| 11,852,427 | B2 | 12/2023 | Bachstein | |
| 11,959,727 | B1 | 4/2024 | Yedor | |
| 12,130,120 | B2 | 10/2024 | Langdon | |
| 12,163,763 | B2 | 12/2024 | Dawson, Jr. | |
| 12,235,078 | B2 | 2/2025 | Planck | |
| 12,253,334 | B2 | 3/2025 | Dawson, Jr. | |
| 12,281,877 | B2 | 4/2025 | Renaud | |
| 12,339,094 | B2 | 6/2025 | Underwood et al. | |
| 12,398,969 | B2 * | 8/2025 | Toner | F41A 21/36 |
| 12,405,089 | B2 * | 9/2025 | Underwood | F41G 11/003 |
| 2003/0074824 | A1 | 4/2003 | Arachequesne | |
| 2015/0268002 | A1 | 9/2015 | Jeung | |
| 2017/0059277 | A1 | 3/2017 | Justice | |
| 2020/0025520 | A1 | 1/2020 | Niswander | |
| 2021/0088310 | A1 | 3/2021 | Planck | |
| 2021/0270572 | A1 | 9/2021 | Dawson, Jr. | |
| 2022/0268553 | A1 | 8/2022 | Roth | |
| 2024/0110759 | A1 | 4/2024 | Underwood | |
| 2024/0110767 | A1 | 4/2024 | Underwood | |
| 2024/0110769 | A1 | 4/2024 | Underwood et al. | |
| 2025/0102279 | A1 | 3/2025 | Dawson, Jr. | |
| 2025/0123079 | A1 | 4/2025 | Dawson, Jr. | |

OTHER PUBLICATIONS

Shadow Systems; Patented Multi-Footprint Optic Cut; Optic Fit; https://shadowsystemscorp.com/opticcut/; at least as early as Oct. 2, 2022.

Next Gen Tooling; Technical Support Blog, "Use Guide Pins to Assist in Loading of Fixtures to Protect Your Investment" https://www.nextgentooling.com/technical/category/tolerance/2#:~:text=Locking%20tapers%20%2D%20These%20can%20be, Dec. 14, 2016.

Fortis; "K1 System (Tapered) Castle Nut -LETM Lightweight Enhanced AR15 End Plate" https://fortismfg.com/k1systemcastlenut-lightweightenhancedar15endplate; at least as early as Oct. 2, 2022.

Emuge-Franken, SME, "Securing Fasteners in Safety Critical Aerospace and Defense Applications" https://www.sme.org/technologies/articles/2022/december/securing-fasteners-in-safety-critical-aerospace-and-defense-applications/ Dec. 6, 2022.

Walther, Walther PDP Optic Plate Mounting System (Second Generation); https://waltherarms.com/blog/walther-pdp-optic-plate-mounting-system-2; at least as early as Oct. 2, 2022.

CH Precision; Walther Defense PDP 1.0 TO Holosun EPS / EPS CARRY /SCS Carry; https://chpws.com/product/walther-defense-pdp-1-0-to-holosun-eps-eps-carry-scs-carry/; at least as early as Oct. 2, 2022.

Sage Dynamics; "Sage Dynamics Review: Unity Tactical ATOM"; https://www.youtube.com/watch?v=omYDLqfhGjw; Sep. 16, 2024.

* cited by examiner

3905

3905

3920

3920

3980

3980

7075

7600

LOCATING FASTENER FOR FIREARM OPTIC

RELATED APPLICATIONS

This a divisional application of U.S. patent application Ser. No. 18/480,425, filed on Oct. 3, 2023 which claims benefit of U.S. Provisional Application No. 63/412,758, filed on Oct. 3, 2022 and entitled LOCATING FASTENER FOR FIREARM OPTIC, and U.S. Provisional Application No. 63/417,236, filed on Oct. 18, 2022 and entitled UNDERCUT ATTACHMENT INTERFACE FOR FIREARM OPTIC, all of which are incorporated by reference herein in their entirety.

BACKGROUND

A firearm may be zeroed after an optic is attached thereto. However, with some known optic assemblies, the firearm may need to be re-zeroed after an optic is removed and re-attached to the firearm.

To avoid the need to re-zero the firearm, some firearms include rail-mounting assemblies. In these rail-mounting assemblies, an optic is slidingly coupled to the firearm on a rail. Although these slidingly coupling systems may eliminate the need to re-zero the firearm after the optic is removed and re-attached to the firearm, they may require a dedicated rail-mounted optic.

DETAILED DESCRIPTION

Locating Fastener for Firearm Optic

Figure 1A:
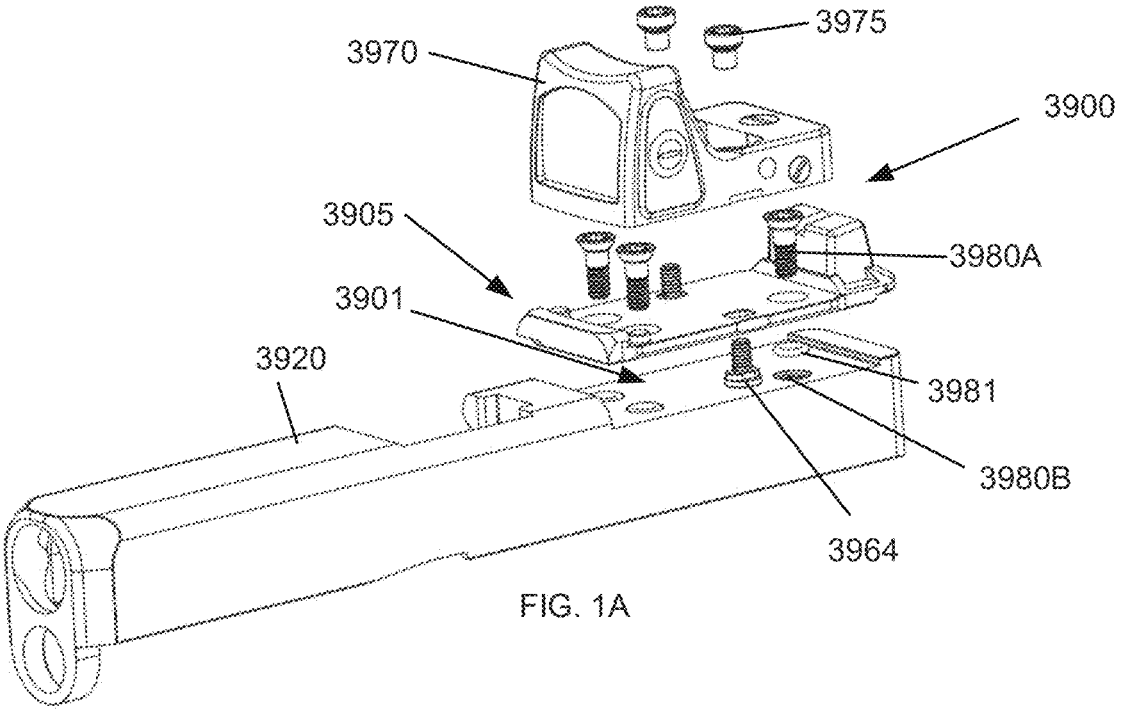
FIG. 1A illustrates an exploded isometric view of an optic assembly coupled to a locating optic assembly mount, according to various embodiments.
Figure 1B:
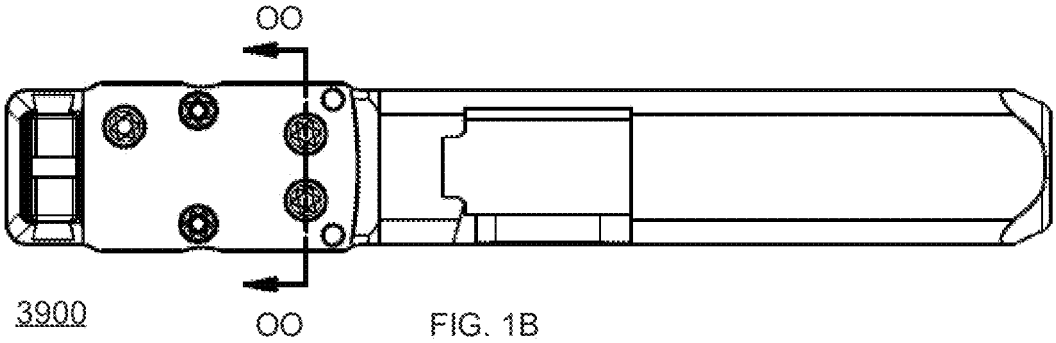
FIG. 1B illustrates a top view of the optic assembly of FIG. 1A.
Figure 1C:
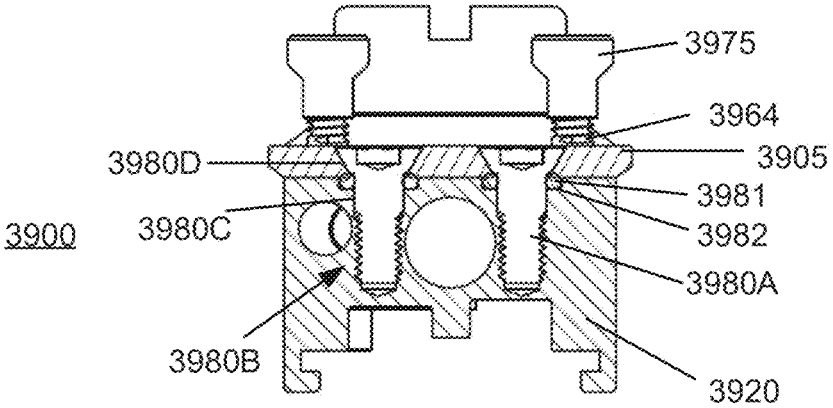
FIG. 1C illustrates a section view taken along section line OO of FIG. 1B.
Figure 1D:
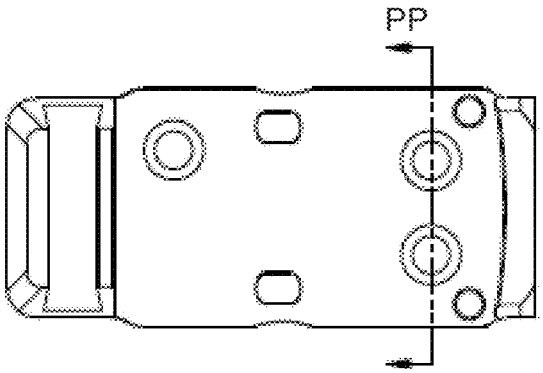
FIG. 1D illustrates a top view of the bracket of FIG. 1A, with the optic omitted for brevity.
Figure 1E:
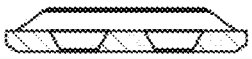
FIG. 1E illustrates a section view taken along section line PP of FIG. 1D.
Figure 1F:
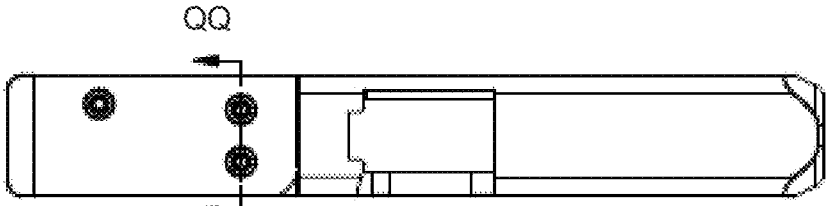
FIG. 1F illustrates a top view of the slide of FIG. 1A.
Figure 1G:
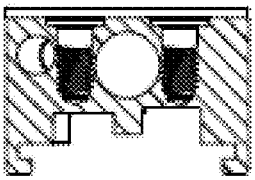
FIG. 1G illustrates a section view taken along section line QQ of FIG. 1F.
Figure 1H:
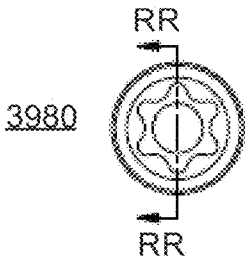
FIG. 1H illustrates a top view of the fastener of FIG. 1A.
Figure 1I:
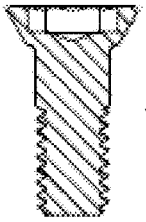
FIG. 1I illustrates a section view taken along section line RR of FIG. 1H.

FIG. 1A illustrates an exploded isometric view of an optic assembly 3900 coupled to a locating optic assembly mount 3901 defined by a slide 3920, according to various embodiments. FIG. 1B illustrates a top view of the optic assembly 3900 of FIG. 1A, with the optic omitted for brevity. FIG. 1C illustrates a section view taken along section line OO of FIG. 1B. FIG. 1D illustrates a top view of the bracket 3905 of FIG. 1A. FIG. 1E illustrates a section view taken along section line PP of FIG. 1D. FIG. 1F illustrates a top view of the slide 3920 of FIG. 1A. FIG. 1G illustrates a section view taken along section line QQ of FIG. 1F. FIG. 1H illustrates a top view of the locating fastener 3980A of FIG. 1A. FIG. 1I illustrates a section view taken along section line RR of FIG. 1H.

The locating optic assembly mount 3901 is arranged for repeatably removing and alignably attaching an optic 3970 to the slide 3920. It is known that a firearm may be zeroed after an optic is attached thereto. However, with some known optic assemblies, the firearm may need to be re-zeroed after an optic is removed and re-attached to the firearm.

To avoid the need to re-zero the firearm, some firearms include rail-mounting assemblies. In these rail-mounting assemblies, an optic is slidingly coupled to the firearm on a rail. Although these slidingly coupling systems may eliminate the need to re-zero the firearm after the optic is removed and re-attached to the firearm, they may require a dedicated rail-mounted optic.

Unlike the rail-mounting assemblies that may require the dedicated rail-mounted optic, locating optic assembly mount 3901 may be compatible with any style of optic (e.g., any style of pistol optic), such as the RMR optic 154 (FIG. 1F).

Referring to FIG. 1C, the locating optic assembly mount 3901 (FIG. 1A) may include locating fastener openings 3980B that have a locating function and a fastening function. The locating function of the locating fastener openings 3980B may provide repeatable locating of the optic 3970 relative to the slide 3920 (by providing repeatable locating of the bracket 3905 in a same position on the slide 3920, in this embodiment). The fastening function may limit movement of the optic 3970 relative to the slide 3920 (by limiting "play" of the bracket 3905 relative to the slide 3920, in this embodiment).

In this embodiment, referring to FIG. 1C, the locating fastener openings 3980B include a counter opening 3980D for a head of the shouldered fastener 3980A (e.g., a counter sink), a counter opening 3980C for the shoulder of the shouldered fastener 3980A, and the threaded hole. The counter sink 3980D may be arranged to provide a clearance fit for the head, while the counter bore 3080C may be arranged to provide a slip fit for the shoulder (e.g., dimensioned to slip-fittingly receive the shoulder). The slip fit causes a center axis of the shouldered fastener 3980A to precisely coincide with a center axis of the fastener opening 3080B (the slip fit counter bore 3080C provides the locating function). This contrasts with fastener openings in which the fastener may not be precisely aligned in a fastener hole due to tolerances in the threading (this threading tolerance allows screws to be rotationally driving into the hole).

When the shouldered fastener 3980A is rotatably driven into the slide 3920 (e.g., into a threaded fastener opening), the slip fit may force the fastener 3980A into a centered position in the locating fastener opening 3980B. Although threading may be required to have sufficient tolerance to allow the shouldered fastener 3980A to be rotatably driven into the threaded section of the locating fastener opening 3980B (with no tolerance, driving a screw into a threaded hole may be difficult or impossible), the shoulder may be tight-fitting in the counter bore 3080C, so that a center axis of the locating fastener 3980A precisely coincides with a center axis of the locating fastener opening 3980B when the shoulder is located in the tight-fitting counter bore 3080C. As used herein, the term "locating counter opening" refers to a counter opening that performs this locating function by being tighter-fitting than the threading (e.g., dimensioned to slip-fittingly receive a corresponding part of a rotatably-driven part).

In some embodiments, tapered head may be less tight-fighting in the counter sink 3980D than the shoulder is in the counter bore 3980C (e.g., clearance fitting). This may optimize the case of rotatably driving the locating fastener 3980A into the locating fastener opening 3980B on the final rotations.

Regarding the shoulder section 3980C, tolerance of this section may be tighter than the tolerance of the threaded section of the locating fastener opening 3980B, which may reduce or eliminate "play" of the bracket 3905 relative to the slide 3920. Also, the shoulders may be wider than an outer diameter of the threading, which may resist sheering similar to any bolt shank described herein.

In this embodiment, an additional counter bore (centered on a same axis as the other counter openings) may provide a pocket for the seal 3981. The seal 3981 and the pocket may be similar to any other seal and pocket described herein. The seal 3981 may prevent moisture from damaging the threading and/or threaded holes (in arrangements without the seal 3981 rust may form—binding up the threading in the threaded holes).

Referring again to FIG. 1A, in this embodiment the locating optic assembly mount 3901 uses fastener openings an opposite ends of the locating optic assembly mount. This may also may reduce or eliminate "play" of the bracket 3905 relative to the slide 3920. In this embodiment, there are three threaded fastener openings, but other embodiments may have different numbers of fastener openings.

Also, in this embodiment, the locating and fastening features of the locating optic assembly mount 3901 may be formed using the same type of tooling (e.g., tooling for making counter openings). This may reduce manufacturing steps in forming the slide 3920 than other locating solutions on slides that may require different tooling for different regions of a locating structure on the slide (e.g., tooling for pins and tooling for grooves).

Referring again to FIG. 1A, the bolts 3964 and barrel nuts 3975 may be similar to any bolts and barrel nuts described herein. The optic 3970 may be similar to any optic described herein. The bracket 3905 includes a dovetail groove for a rear sight (the rear sight is shown installed in the dovetail groove). The bracket 3905 may include any features of any bracket described herein.

In the illustrated embodiment, the locating optic assembly mount is arranged to receive an optic assembly that includes the bracket 3905. In other embodiments, a locating optic assembly mount may be arranged for direct-mounting an optic on a firearm (e.g., a slide include a locating optic assembly mount arranged for direct-mounting an optic).

In this embodiment, the coaxial counter openings are circular openings to mate with circular sections of the locating fastener 3980A. In other embodiments, a locating fastener may a faceted section in place of at least one of the circular sections (e.g., a square shoulder).

In this embodiment, the optic assembly 3900 includes the bracket 3905 and the optic 3970. In other embodiments, it may be possible and practical to provide an optic assembly with an optic to mount directly to a locating optic assembly mount (e.g., without any bracket). In these embodiments, locating fasteners (similar in various respects to the locating fasteners 3980A) may attach the optic directly to the locating optic assembly mount.

In this embodiment, the optic assembly 3900 is attached to the locating optic assembly mount 3901 using a homogenous group of fasteners (e.g., three locating fasteners 3980A). In other embodiments, an optic assembly may be attached to a locating optic assembly mount using a heterogeneous group of fasteners. Such a heterogeneous group of fasteners may include any number of locating fasteners (similar in various respects to locating fastener 3980A) and any number of other fasteners now known or later developed. For example, a single locating fastener opening may be all that is required to achieve the locating function—and the fastening function may be provided in part using other fasteners now known or later developed (in one example, the single locating fastener opening is provided on one end of the locating optic assembly mount and threaded holes for any threaded fasteners now known or later developed may be provided at the other end of the locating optic assembly).

The embodiments described in the previous paragraph may use threaded openings on both ends of a locating optic assembly mount (e.g., using locating fastener openings exclusively or using any number of locating fastener opening(s) in combination some other attachment feature that utilizes fasteners). However, in yet other embodiments, the other attachment feature may not require threading (or even separate fasteners). For example, in one embodiment, an optic assembly may include a bracket with a non-threaded structure (such as a tab) or recess to mate with a corresponding recess or non-threaded structure (such as the tab), respectively, on a firearm. The optic assembly may be installed by coupling the non-threaded structure with the recess on the one end, and then attaching the other end of the optic assembly to at least one locating fastener opening of the locating optic assembly mount. This is one example of an attachment feature for one end of an optic assembly in which the attachment feature does not use threading (or even separate fasteners). In various embodiments, an optic assembly may use any attachment feature now known or later developed in combination with at least one locating fastener opening (which may be similar in various respects to any locating fastener opening described herein).

Figure 2A:
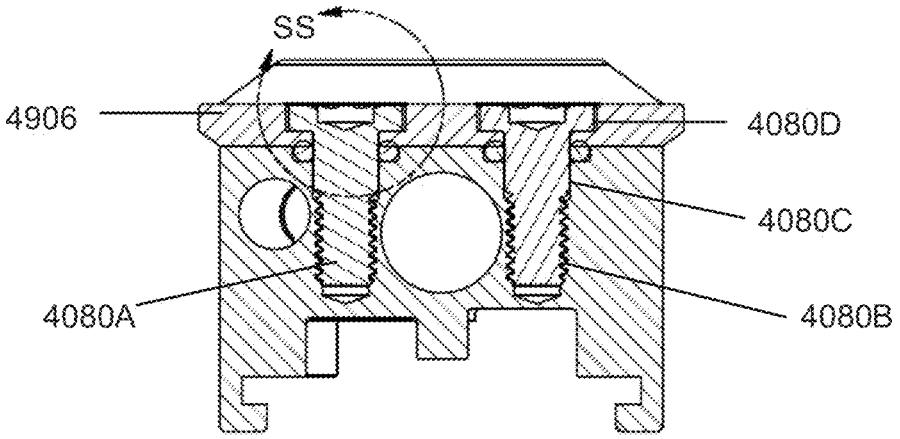
FIG. 2A illustrates a section view of an optic assembly coupled to a locating optic assembly mount, according to various embodiments.

FIG. 2A illustrates a section view of an optic assembly 4906 coupled to a locating optic assembly mount, according to various embodiments. This embodiment may be similar in any respect to the embodiment of FIG. 1A, but with a different fastener opening (both of the counter openings 4080C and 4080D of the locating fastener opening are counter bores) and a corresponding locating fastener 4080A.

In this embodiment, the shoulder section 4080C is shown with a slip fit arrangement (the spacing on the head section may be exaggerated to illustrate the contrasting clearance fit). As the fastener threading (which may be similar to fastener threading of FIG. 1A) is rotatably driven into the threaded section 4080B of the locating fastener opening, the shoulder section 4080C (which may have a tighter tolerance than the threaded hole 4080B) may precisely locate a center axis of the locating fastener 4080A coincident with a center axis of the locating fastener opening. The shoulder section 4080C may also may resist sheering similar to any bolt shank described herein.

The counter bore 4080D may be arranged to be non-contacting a sidewall of the head of the locating fastener 4080A, as illustrated. In this embodiment, the counter bores 4080C and 4080D are coaxial, but this is not required. In other examples, a counter bore (or other opening for a fastener head) may a center axis that is offset from a center axis of a locating counter opening.

In the embodiments illustrated herein, the mechanism (e.g., a socket) for rotating the locating fasteners is covered by an optic when the optic is coupled to a bracket. In other embodiments, the mechanism for rotating the locating fasteners may be exposed, which may allow the optic assembly to be removed from the firearm without removing the optic from the bracket. For example, in some embodiments a rear iron sight may be omitted from the bracket, and fastener opening(s) for the rear end of the optic assembly may be provided below this part of the bracket, so that the rotation mechanism of the rear fastener(s) may be exposed when the optic is attached to the mount. Fastener opening(s) for a front end of the optic assembly may also be exposed when the optic is attached to the mount. In other embodiments, one end of the optic assembly may attach to a firearm using a non-threaded attachment structure (such as a tab), and the other end of the optic assembly may attach to the firearm using one or more locating fasteners having rotating mechanisms that are exposed when the optic is attached to the bracket. In these embodiments, the optic assembly may be removed from the firearm without removing the optic from the bracket.

Undercut Attachment Interface for Firearm Optic

As described in the previous section, one end of an optic assembly may be arranged to attach to a firearm using a non-threaded attachment structure (such as a tab), and the other end of the optic assembly may attach to the firearm using one or more locating fasteners having rotating mechanisms that are exposed when the optic is attached to the bracket. In an optic assembly including a bracket and an optic, this may allow the optic assembly to be removed from the firearm without removing the optic from the bracket-which preserves zero. In the embodiments that follow, undercut structure(s) may be used to define a non-threaded attachment structure that may be used, in combination with one or more fasteners (e.g., one or more locating fasteners), to allow removal of the optic assembly from the firearm without removing the optic from the bracket.

Figure 3A:
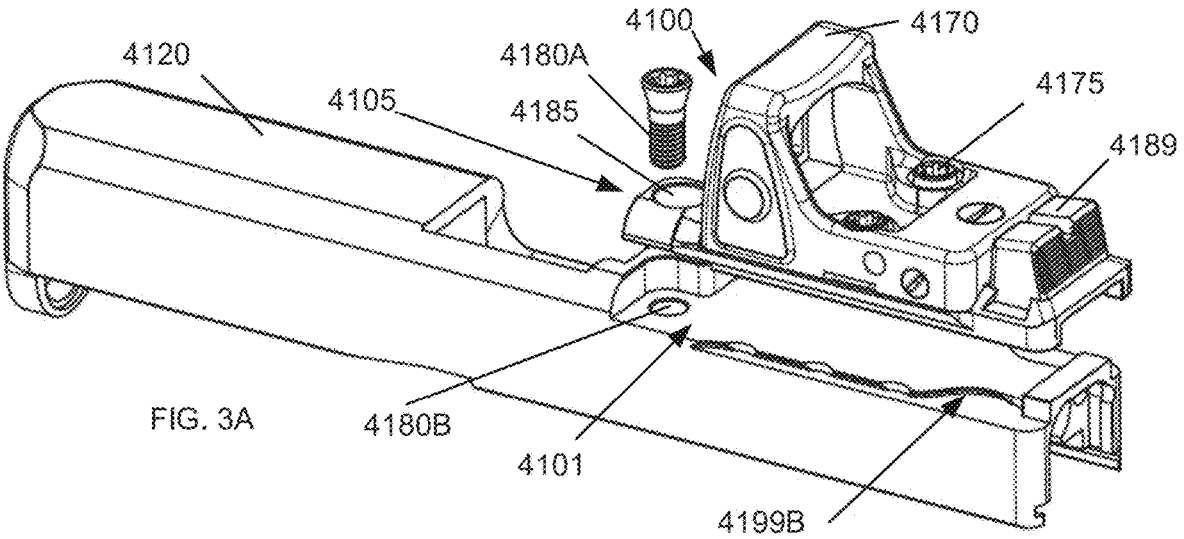
FIG. 3A illustrates an exploded isometric view of an optic assembly coupled to a slide using an undercut attachment interface, according to various embodiments.
Figure 3B:
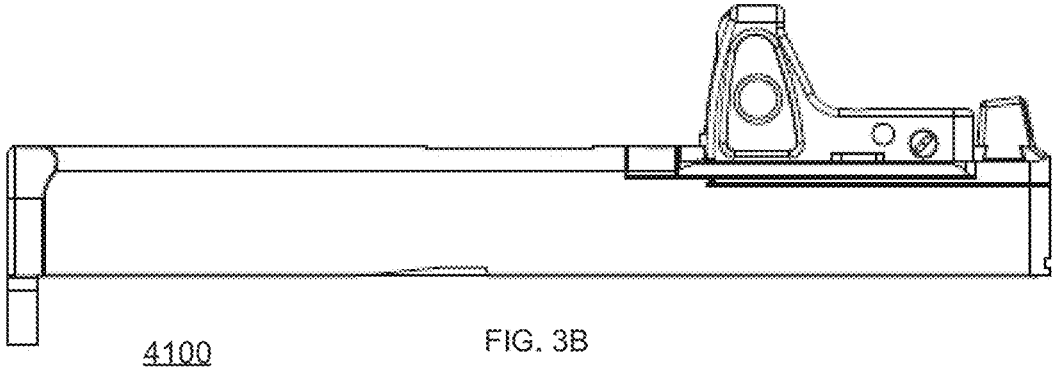
FIG. 3B illustrates a side view of the optic assembly of FIG. 3A coupled to the slide of FIG. 3A.
Figure 3C:
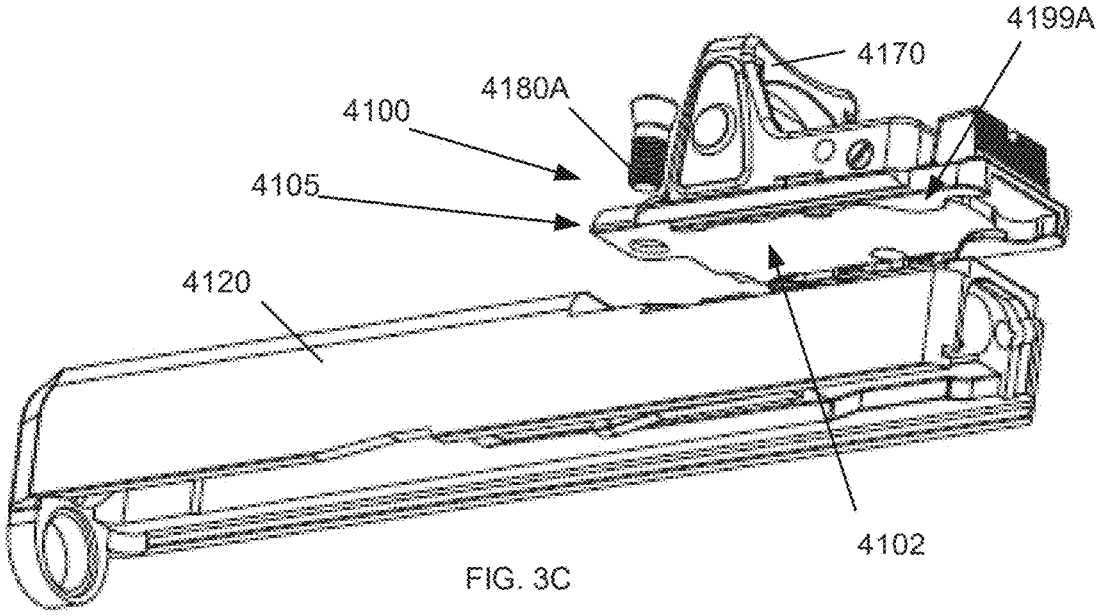
FIG. 3C illustrates an exploded isometric view showing a bottom of the optic assembly of FIG. 3A coupled to the slide of FIG. 3B.

FIG. 3A illustrates an exploded isometric view of an optic assembly 4100 coupled to a slide 4120 using an undercut attachment interface, according to various embodiments. FIG. 3B illustrates a side view of the optic assembly 4100 of FIG. 3A coupled to the slide 4120 of FIG. 3A. FIG. 3C illustrates an exploded isometric view showing a bottom of the optic assembly 4100 of FIG. 3A coupled to the slide 4120 of FIG. 3A.

Figure 6A:
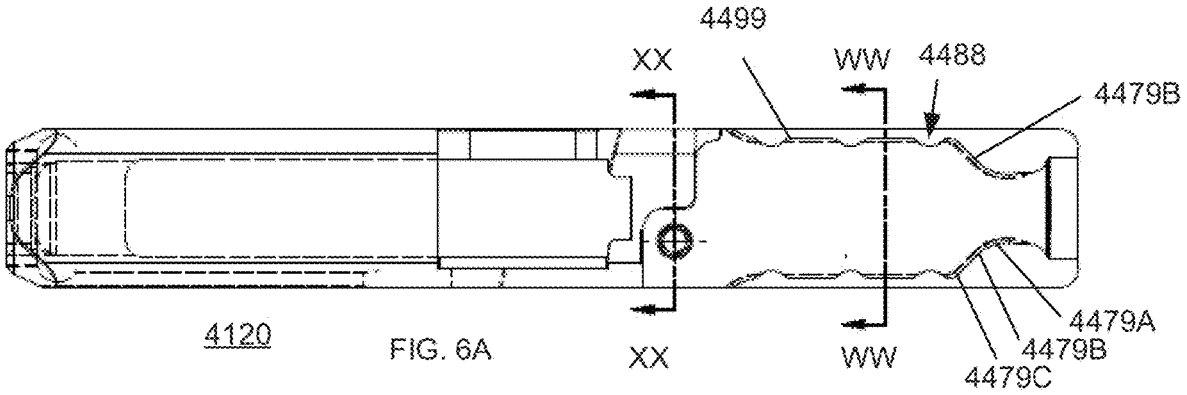
FIGS. 6A and 6B illustrate top and rear views, respectively, of the slide of FIG. 2A.
Figure 6B:
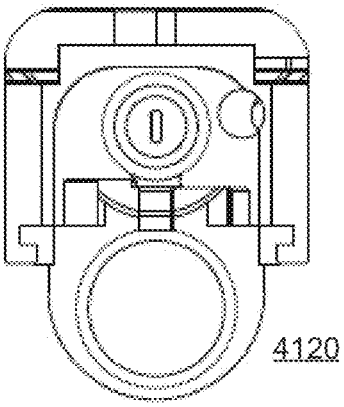
Figure 6C:
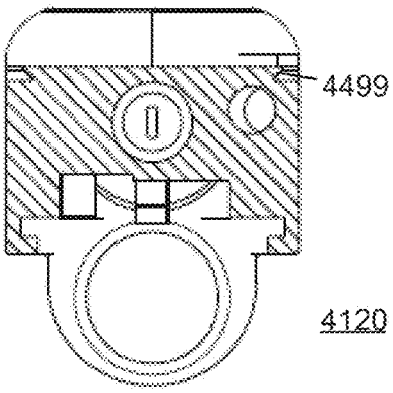
FIGS. 6C and 6D illustrate section views taken along lines WW and XX of FIG. 6A, respectively.
Figure 6D:
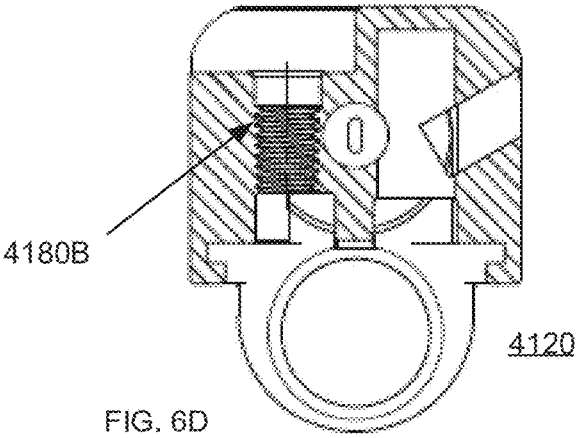
Figure 7A:
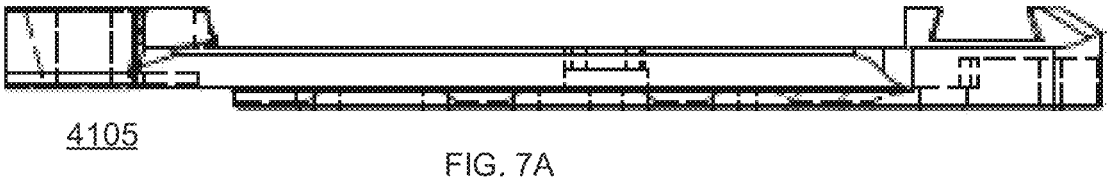
FIG. 7A illustrates a side view of the bracket of FIG. 2A.
Figure 7B:
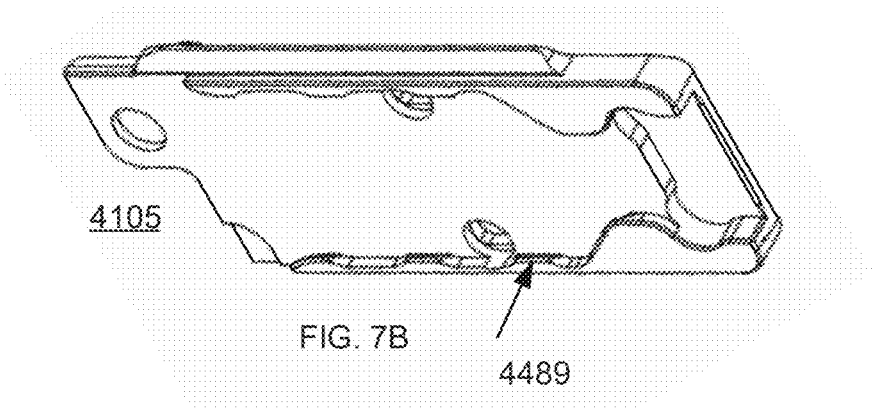
FIG. 7B illustrates an isometric view showing a bottom of the bracket of FIG. 2A.
Figure 7C:
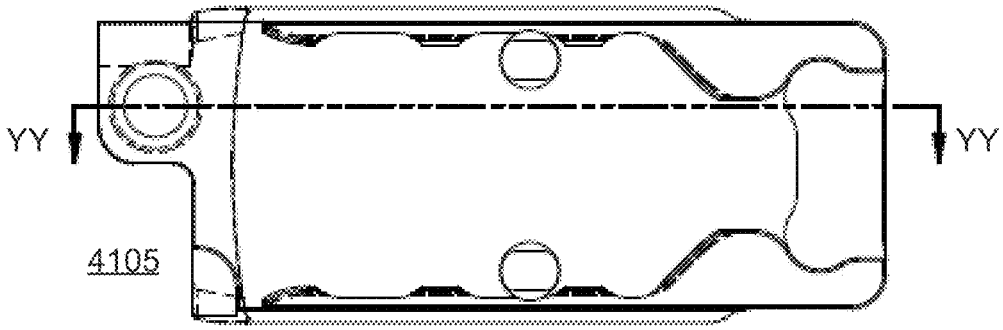
FIG. 7C illustrates a bottom view of the bracket of FIG. 2A.
Figure 7D:
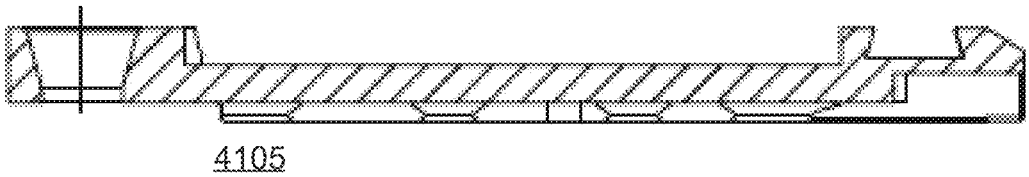
FIG. 7D illustrates a section view taken along section line YY of FIG. 6C.

A locating optic mount 4101 defined by a top of the slide 4120 includes an undercut structure 4199B (FIG. 3A) to mate with a corresponding undercut structure 4199A defined by an underside of the bracket 4105 (FIG. 3C). Referring briefly to FIGS. 6A, 6B, 6C, and 6D, in FIG. 6A a dashed line 4499 illustrates the undercut of undercut structure 4199B (the undercut is also shown in FIG. 6C). The corresponding undercut structure 4199A (FIG. 3A) of the underside of the bracket 4105 is shown in FIGS. 7A, 7B, 7C, and 7D.

In this example, one of the undercut attachment structures 4199A and 4199B may include a first dovetail (e.g., the undercut attachment structure 4199B, in this example), and the other of the undercut attachment structures 4199A and 4199B may include a second dovetail (e.g., the undercut attachment structure 4199A, in this example) to mate with the first dovetail. However, in other examples undercut interfaces having any shape, dovetail or otherwise, may be used for an undercut attachment interface.

Figure 8A:
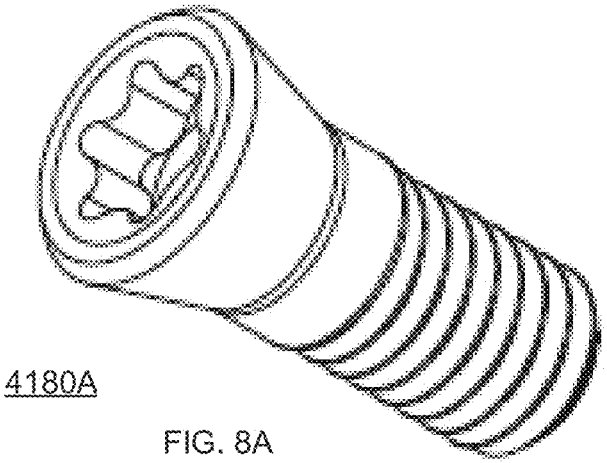
FIG. 8A illustrates an isometric view of the locating fastener of FIG. 2A.
Figure 8B:
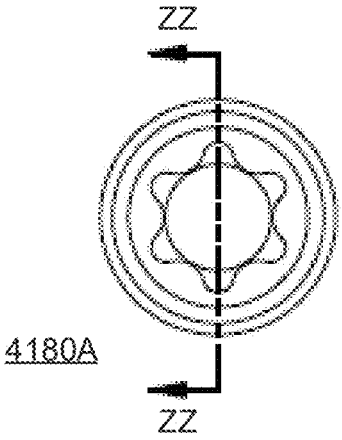
FIG. 8B illustrates a top view of the locating fastener of FIG. 2A.
Figure 8C:
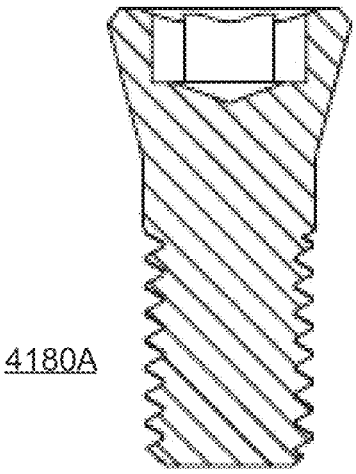
FIG. 8C illustrates a section view taken along section line ZZ of FIG. 7A.

Referring again to FIG. 3A, the locating optic mount 4101 defined by the top of the slide 4120 may also include a locating fastener opening 4180B, which may be similar in various respects to any locating fastener opening described herein. A locating fastener 4180A includes threading and a shoulder to mate with the locating fastener opening 4180B. However, the locating fastener 4180A also includes a tapered head to mate with a tapered opening 4185 defined by a top surface of the bracket 4105. The locating fastener 4180A is illustrated in more detail FIGS. 8A, 8B, and 8C.

Referring again to FIG. 3A, the locating optic assembly mount 4101 may also include a fastener opening 4180B to provide a fastening function, and the bracket 4105 may include a tapered opening 4185 to provide a locating function. The fastening function may limit movement of the optic assembly 4100 relative to the slide 4120 (by limiting "play" of the bracket 4105 relative to the slide 4120, in this embodiment), similar to the locating fastener 3980A (FIG. 1A). Regarding the locating function, the tapered head of the locating fastener 4180A is arranged to engage with part of a tapered opening 4185 of the bracket 4105 to interlock the undercut structures 4199A and 4199B, which repeatably locates the bracket 4105 (and therefore the optic 4170 installed thereon) in the same position on the slide 4120.

Figure 5A:
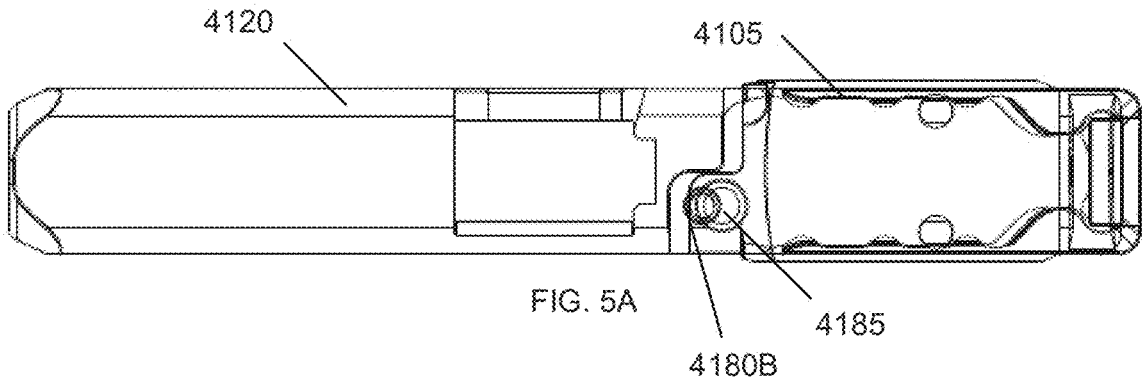
FIG. 5A-B illustrate installation of the bracket of the optic assembly of FIG. 2A on the slide in which the bracket is shown with transparence.
Figure 5B:
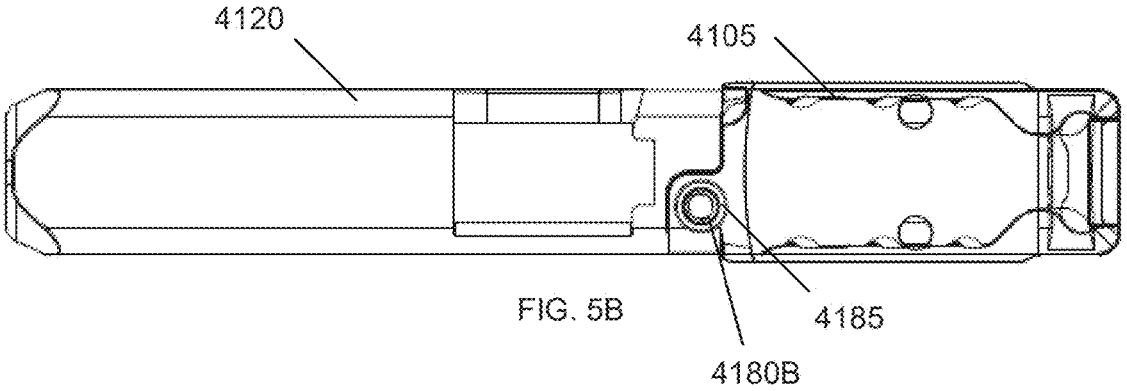
Figure 5C:
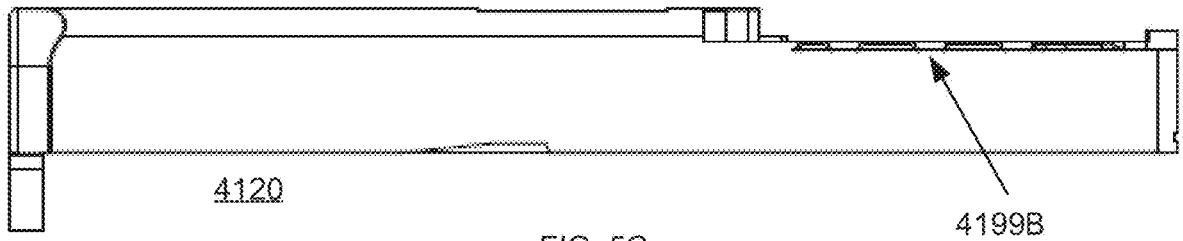
FIG. 5C illustrates a side view of the slide of FIG. 2A.

Installation of the bracket 4105 on the locating optic mount 4101 is illustrated in FIGS. 5A and 5B. The slide 4120 includes recesses 4488 (FIG. 6A), and the bracket 4105 includes projections 4489 (FIG. 7B) that drop into the recesses 4488 to position the bracket 4105 on the slide 4120, as shown in FIG. 5A. Next, a user slides the bracket 4105 forwardly to perform an initial alignment of the bracket 4105 on the slide 4120 (e.g., when the tapered opening 4185 and the locating fastener opening 4180B align, as shown in FIG. 5B, which allows the locating fastener 4180A (FIG. 3A) to be installed through the aligned openings 4185 and 4180B).

Figure 4A:
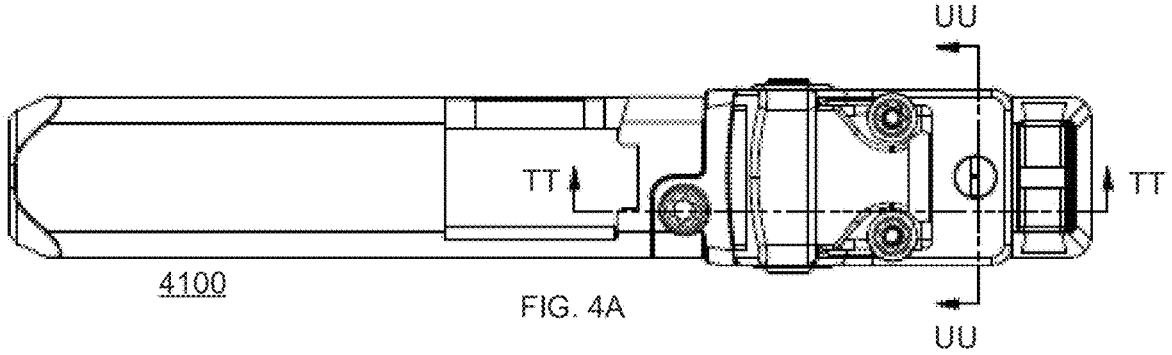
FIG. 4A illustrates a top view of the optic assembly of FIG. 3A coupled to the slide of FIG. 3A.
Figure 4B:
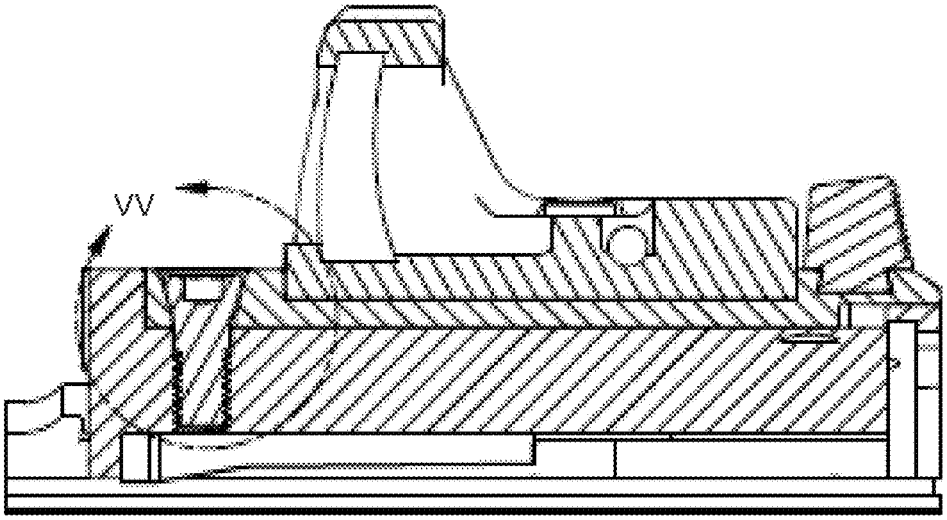
FIG. 4B illustrates a section view taken along section line TT of FIG. 4A.
Figure 4C:
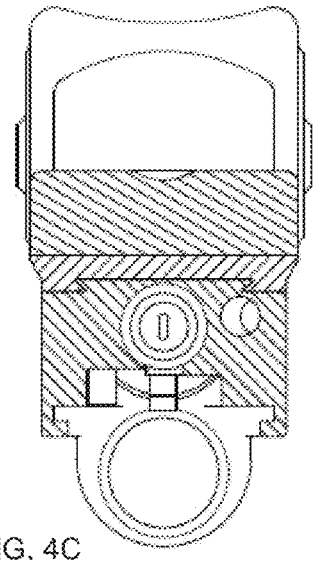
FIG. 4C illustrates a section view taken along section line UU of FIG. 4A.
Figure 4D:
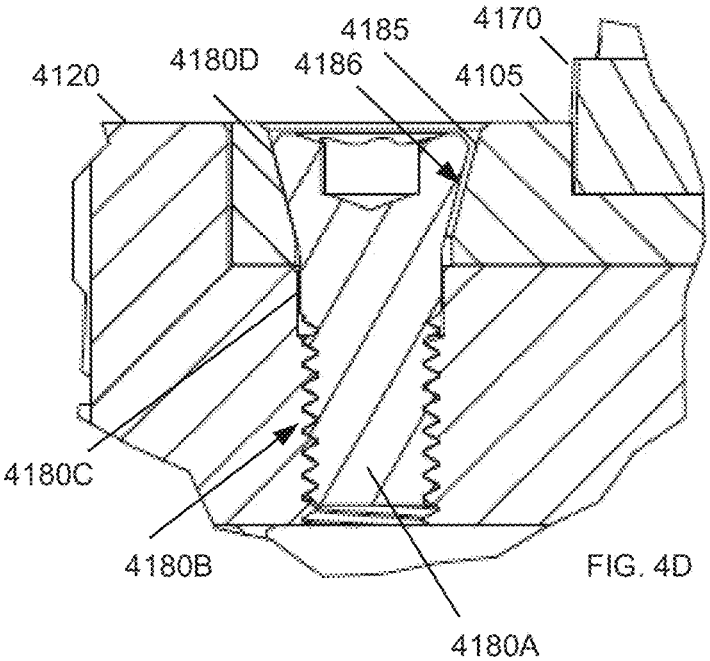
FIG. 4D illustrates a detailed view VV of FIG. 4B.

As the locating fastener 4180A is installed in the aligned openings 4180B and 4185, referring now to FIGS. 4A, 4B, 4C, and 4D, as shown in FIG. 4D a part of the tapered head 4180D engages a part of the tapered opening 4185. This engagement urges the bracket 4105 forward, which interlocks the undercut structure 4199B (FIG. 3A) and the undercut structure 4199A (FIG. 3C). FIG. 4D shows a gap 4186 (not to scale) on only one side of the tapered head 4180D to emphasize the forward-urging caused by the taper-engagement. This interlocking performs a final alignment of the bracket 4105 on the slide 4120.

Still referring to FIG. 4D, in this embodiment the locating fastener 4180A includes a non-threaded shoulder 4180C. In one embodiment, this non-threaded shoulder 4180C may be slip fit with the locating opening 4180A similar to any locating opener described herein. A part of the non-threaded shoulder 4180C may be clearance fit with the straight section below the tapered opening 4185 (so that the only part of the locating fastener 4180A that contacts the bracket 4105 is the tapered head 4180D, which is illustrated in the drawing), in various embodiments. Other embodiments may not include the non-threaded shoulder-instead the entire length of a locating fastener below a tapered head may be threaded.

The threading on the locating fastener 4180A can be similar to any threading described herein. In some embodiments, the locating fastener opening 4180B may have a counter bore for receiving a seal (not shown), similar to the counter bore 3982 (FIG. 1C). This may prevent corrosion—so that the threading does not bind up over time.

Referring again to FIG. 6A, a part of a sidewall of the undercut structure 4199B (FIG. 3A) of the slide 4120 may have a pair of non-parallel straight sections 4479B (FIG. 6A) located between curved sections 4479A and 4479C. This pair of non-parallel straight sections 4479B interlocks with a corresponding pair of non-parallel straights sections on the undercut structure 4199A—contributing, together with the tapered head 4180D, to alignment (e.g., lateral and/or front/aft alignment) of the optic assembly 4100 in a repeatable position on the slide 4120.

Referring again to FIG. 3A, the optic 4170 may be similar to any optic described herein. The fasteners 4175 that couple the optic 4170 to the bracket 4105 may also be similar to any fasteners described herein for attaching an optic to a bracket, or any known fastener. The rear sight 4189 may be fixably installed (e.g. press fit) to a rear end of the bracket 4105 using a dovetail groove, as illustrated.

In another embodiment, an optic may be installed more aftly on a bracket, and a rear sight may be fixably installed to a front end of the bracket using a dovetail groove. In another embodiment, an optic guard (e.g., any optic guard described herein) may be fixably or releasably installed to a front end of the bracket using a dovetail groove.

Self-Lockingly Fastened Components in a Recoil Environment

Various firearm assemblies have some degree of modularity. Sometimes modularity is provided by the original equipment manufacturer (OEM) of the firearm—an operator may have the option of configuring and/or operating the firearm with or without an optional component. The firearm may be manufactured with the optional component fixably installed on the attachment interface, in some examples. If the firearm is configured with the optional component, the operator may wish to uninstall the component of the firearm for some applications and re-install the component for other applications.

In other instances, modularity may be provided in the aftermarket. As a simple example, a user may replace the original barrel of a firearm with a threaded barrel to provide modularity. This essentially adds an additional attachment interface—the threaded part of the barrel. The user may then thread mating accessories, such as compensators, suppressors, or the like, onto the threaded barrel.

In either case, in some examples, the attachment interface is located on a reciprocating component of the firearm. An example is an optic attachment interface on a slide. This may expose the attachment interface to various recoil-based forces with each movement of the assembly including reciprocating component and the reciprocating-component mounted device.

To withstand the repeated action of the reciprocating-component, various known attachment interfaces may fixably install the reciprocating-component mounted device on the reciprocating component. In a fixable installation, a non-temporary deformation occurs when installing and/or or removing the reciprocating-component mounted device from the reciprocating component. In many examples of fixable installations generally, non-temporary deformation must occur at both installation and removal. For example, with riveting, the rivets are non-temporarily deformed on attachment and removal. In other examples, non-temporary deformation may be occur in response to clamping, drilling, welding, or the like.

In other fixable installations, non-temporary deformation may occur at removal specifically. One example is an adhesive, such as a thread locking adhesive. Once the thread-locking adhesive cures, the cured adhesive must be broken in order to remove the reciprocating-component mounted device from the reciprocating component. A user may unintentionally damage the reciprocating component or the reciprocating-component mounted device when attempting to break the cured adhesive. Even when this damage is avoided, the user may still have to clean up the devices (i.e., remove the broken cured compound in order to apply the required new adhesive for fixable re-installation).

U.S. Pat. No. 11,480,414, which is incorporated by reference herein, describes a taper lock interface. This taper lock interface may be utilized to barrel-mount a firearm accessory. What is needed is an attachment interface that may be similar in some respects to the '414 embodiments. It would also be beneficial for such an attachment interface to have attributes consistent with self-lockingly fastening a wide variety of parts in a recoil environment (e.g., not limited to barrel-mounting, and having attributes consistent with use in various locations of a firearm assembly, such as compact dimensions, case of use, etc.)

Various embodiments described herein include an assembly to operate in a recoil environment in which the assembly may be mounted on a device that produces or transmits recoil. At least one part of the assembly may be self-lockingly fastened to a mating part. In various embodiments, the mating part may be a slide or other reciprocating part of a recoil-producing device.

While various features described herein may be arranged to withstand the variety of forces involved when the mating component is a reciprocating component (e.g., a slide), any of the features described herein are also well-suited to self-lockingly fastening the assembly to some other mating part of a device that produces or transmits recoil (e.g., a non-reciprocating part such as a frame assembly of a firearm, or another part of an assembly in which both parts are mounted on a reciprocating or non-reciprocating part in a recoil environment). For example, the features described herein may be used for self-lockingly fastening a magwell to a backstap, self-lockingly fastening a gas key to a bolt carrier, self-lockingly fastening a buffer tube to a lower receiver, or self-lockingly fastening any other parts in a recoil environment.

In various embodiments, an apparatus including at least one part of an assembly self-lockingly fastened to a mating part may include a threaded opening defining self-locking threads, and a non-threaded opening defining: a tapered opening comprising a locking taper, or a tapered counter opening arranged to make contact (e.g., taper-to-taper contact) with a taper defined by a rotatably-driven part, wherein the threaded hole is arranged to mate with threading defined by the rotatably-driven part. In various embodiments, the at least one part of the assembly may be self-lockingly fastened to the mating part in more than one way (e.g., using the locking taper and self-locking threads).

In some embodiments, the threaded and non-threaded openings may be part of a same fastener opening, and the rotatably-driven part may be a rotatably-driven fastener. The fastener opening may have a top section and a bottom section located below the top section in the fastener opening. The bottom section may define the threaded opening and the top section may define the non-threaded opening.

In various embodiments, one of the self-lockingly fastened parts may define the threaded opening and the other of the self-locking fastened parts may define at least a portion of the tapered counter opening.

In some embodiments, the rotatably-driven fastener may define the self-locking threads—such as in the case of a nut (e.g., a sleeve nut, a castle nut, or any other nut). In some embodiments, the tapered opening may mate with a tapered surface defined by an exterior of the nut, in which the threaded opening is defined by an interior of the nut.

Figure 9A:
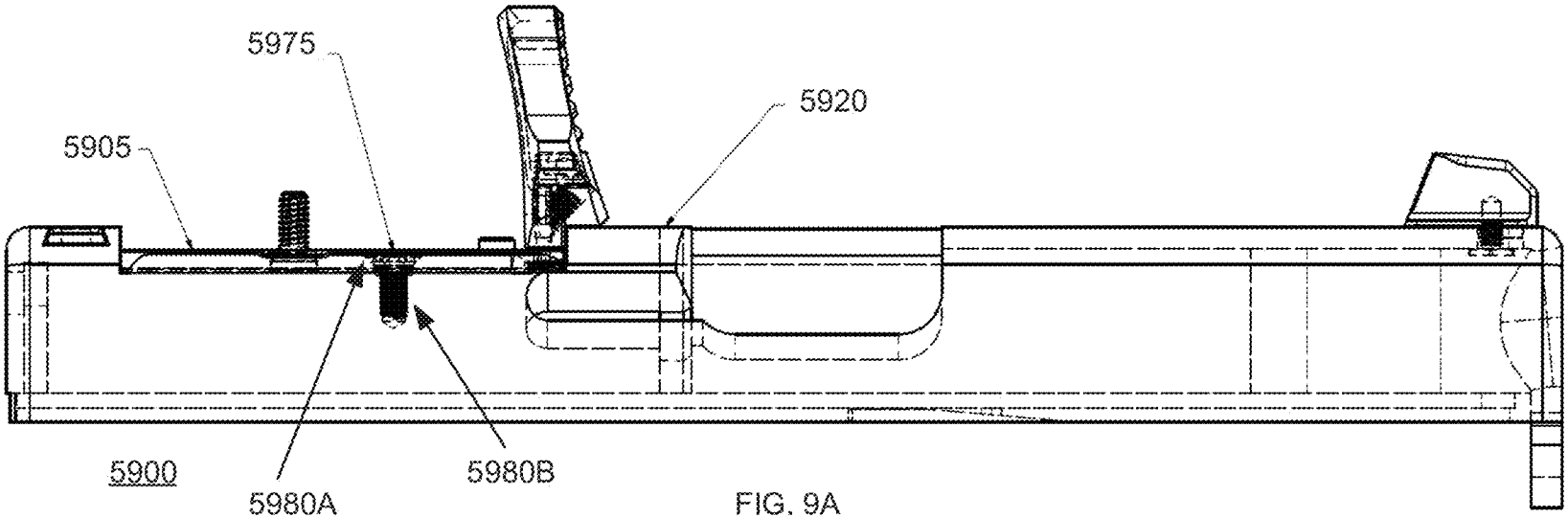
FIG. 9A illustrates a side view of a slide assembly including an optic adapter self-lockingly fastened to a slide, according to various embodiments.
Figure 9B:
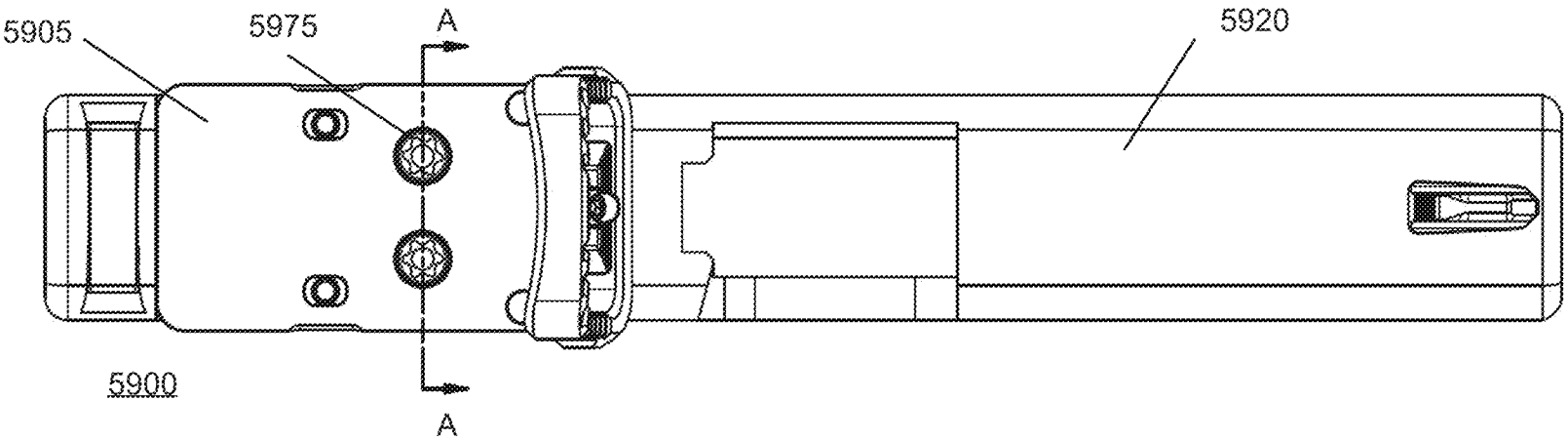
FIG. 9B illustrates a top view of the slide assembly of FIG. 9A.
Figure 10B:
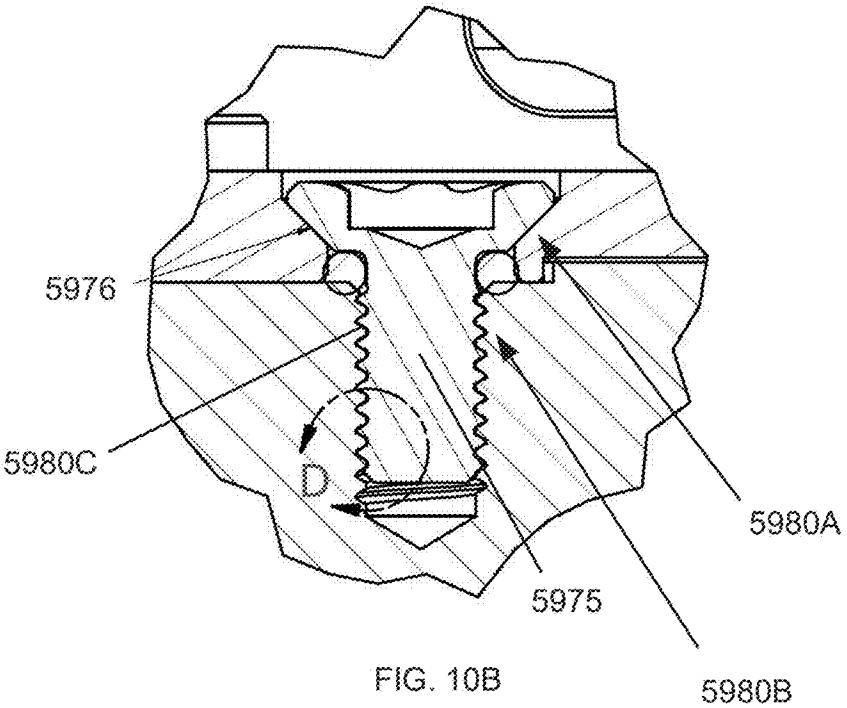
FIG. 10B illustrates a detailed view B of FIG. 10A.
Figure 10A:
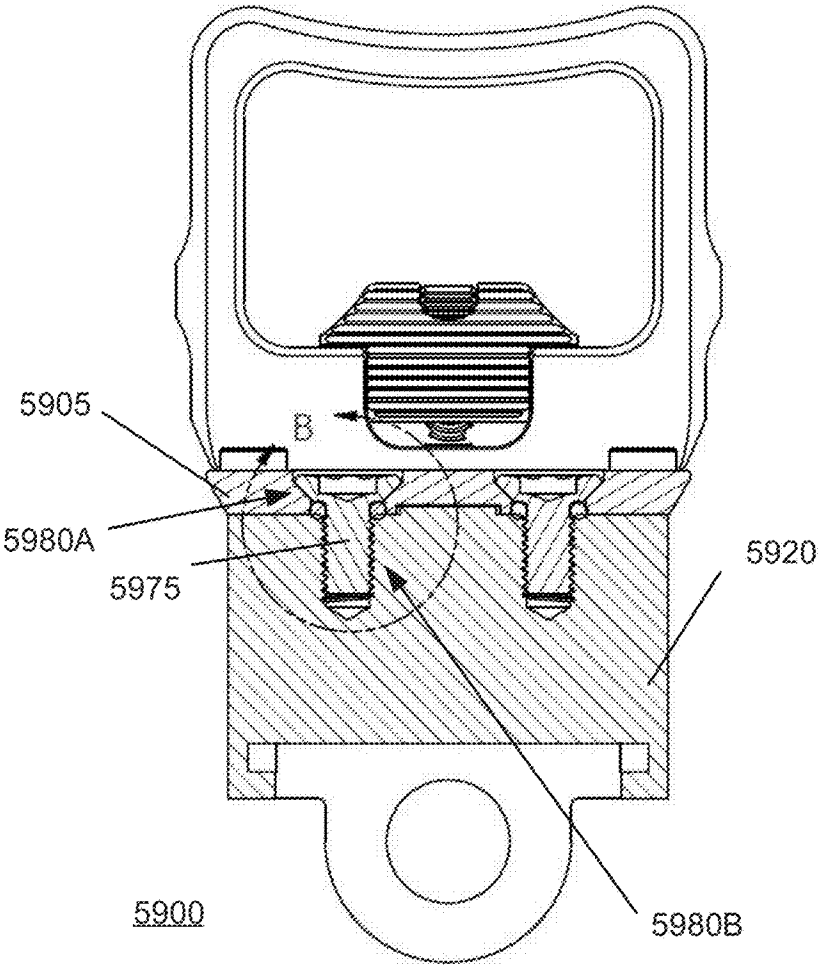
FIG. 10A illustrates a section view taken along section line AA of FIG. 9B.
Figure 10D:
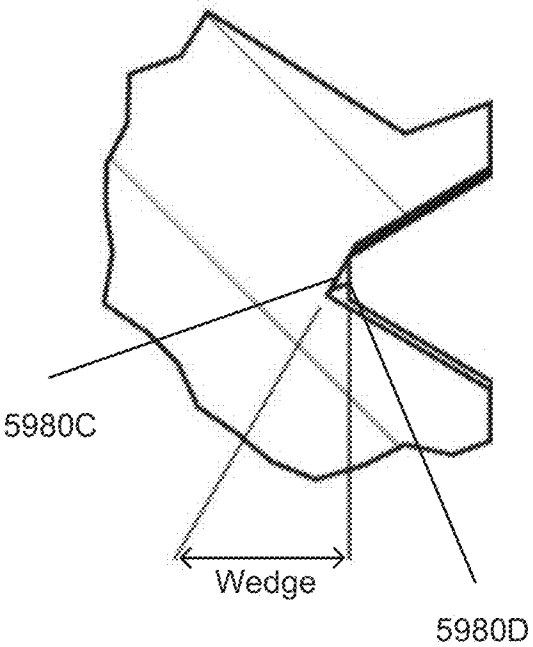
FIG. 10D illustrates a detailed view of a part of the self-locking threads of FIG. 10C.
Figure 10C:
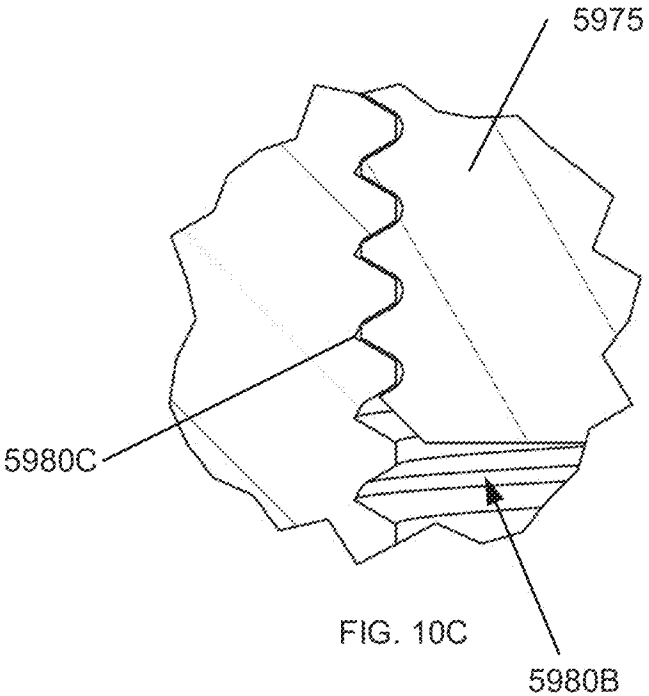
FIG. 10C illustrates a detailed view D of FIG. 10B.

FIG. 9A illustrates a side view of a slide assembly 5900 including an optic adapter 5905 self-lockingly fastened to a slide 5920, according to various embodiments. FIG. 9B illustrates a top view of the slide assembly 5900 of FIG. 9A. FIG. 10A illustrates a section view taken along section line AA of FIG. 9B. FIG. 10B illustrates a detailed view B of FIG. 10A. FIG. 10C illustrates a detailed view D of FIG. 10B. FIG. 10D illustrates a detailed view of a part of the self-locking threads of FIG. 10C.

In this embodiment, the reciprocating-part mounted assembly includes an optic adapter 5905 (to receive an optic, not shown) and the illustrated fasteners, and the mating part is the slide 5920. The optic adapter 5905 is self-lockingly fastened to the slide 5920, rather than being fixably installed on a slide like other slide assemblies that may require adhesive (e.g., a thread locking compound).

Like other self-lockingly fastened embodiments described herein, the slide assembly 5900 includes a non-threaded opening and a threaded opening (5980A and 5980B, respectively). In this embodiment, self-locking threads (FIG. 10C, 5980C) are defined by the mating part (by the slide 5920 in this embodiment), and a tapered opening (e.g., a conical counter opening) is defined by the other part 5905.

The tapered opening may have a slope that is corresponding to (e.g., matching) a slope of a tapered section of the rotatably-driven fastener 5975, to provide taper-to-taper contact (as illustrated). Referring to FIG. 10B, a conical taper 5976 may make taper-to-taper contact with the tapered opening.

Depending on a number of factors including a slope of the tapers, this taper-to-taper contact may produce some resistance to the rotatably-driven fastener 5975 backing out due to a recoil impulse transmitted into the rotatably-driven fastener 5975 by, say, the mating part (which hereinafter may be referred to as 'recoil-loosening resistance'). The slope of the conical taper 5976 is shallow compared to the conical taper 6676 of the locking taper illustrated in FIG. 17A. A degree of slope may be varied depending on design requirements. Referring again to FIG. 10B, in this embodiment using the shallow slope allows an optic to 'sit lower' on the pistol, because the shallow slope does not require increasing a height of the fastener head, which therefore does not requiring increasing the thickness of a plate of the optic adapter 5905. An optic that sits lower on a pistol is, of course, an advantage for firearm operators. The slope may be varied from what is shown based on any application requirement such as:

A total magnitude of recoil-loosening resistance required (based on the location of the attachment interface on the firearm, characteristics of the firearm, or the, or combinations thereof);

Sizing requirements for the attachment interface; or

A magnitude of total recoil-loosening resistance provided by self-locking threads (which may be impacted by the count of individual threads of self-locking threads used on the mating part, a number of threaded openings used for the attachment interface, a type of self-locking thread, etc.), or the like, or combinations thereof.

In embodiments in which the magnitude of the recoil-loosening resistance provided by self-locking threads alone is not sufficient for an application, a steep slope may be used to provide recoil-loosening resistance that is equal or greater than a threshold amount, such as a recoil-loosening resistance comparably provided by the self-locking threads (e.g., redundancy), e.g., a 'locking taper'. In other embodiments, a conical taper may have a shallow slope which may provide some other non-zero amount of additional recoil-loosening resistance. In various embodiments, a steep slope (e.g., an included angle) may be thirty degrees or less, as just one example; however, this is just an example—since various factors may impact slope requirements, as previously discussed. In some examples, it may be possible and practical to use a locking taper and any threads now known, or later developed (e.g., no redundancy).

The self-locking threads 5980C (FIGS. 10C and 10D) may be any self-locking threads now known, or later developed, that may provide a threshold recoil loosening resistance alone or in combination with any recoil resistance provided by the taper-to-taper contact, which does not fixably couple the self-locking fastened parts (e.g., do not result in non-temporary deformation on every fastening or unfastening, such as threads that require thread-locking compound to prevent loosening in a recoil environment).

In some examples, the self-locking female threads may have a thirty degree wedge ramp, as illustrated, may be created using threading tools such as the Emuge threading tools described on the Emuge-Fraken Group website. The male threading 5980D may be any threading to mate with the self-locking female threads 5980C.

Referring again to FIGS. 9A and 9B, the self-lockingly fastened parts 5905 and 5920 are non-fixably coupled. Unlike some known firearm assemblies that may fixably install an optic plate on a slide using a thread-locking compound, the optic adapter 5905 can be releasably removed from the slide 5920 and re-fastened to the slide 5920 by loosening and/or tightening the rotatably-driven fastener 5975.

The optic adapter 5905 and slide 5920 may be similar in any respect to any other optic adapter and slide described herein. In various embodiments, the slide 5920 and/or the optic adapter 5905 may have any locating fastener opening described herein, which may allow the optic adapter 5905 and/or an optic attached thereto (not shown for brevity) to be released and re-fastened without having to re-zero the firearm. The locating fastener opening may be a different opening than the fastener opening illustrated in FIG. 9A, or the illustrated opening may perform the locating function similar to any locating fastener opening described herein. A locating fastener opening may have any threads and/or may or may not provide the same taper-to-taper contact described above (in the case of a locating fastener opening that is also relied upon for recoil-loosening resistance).

Figure 11A:
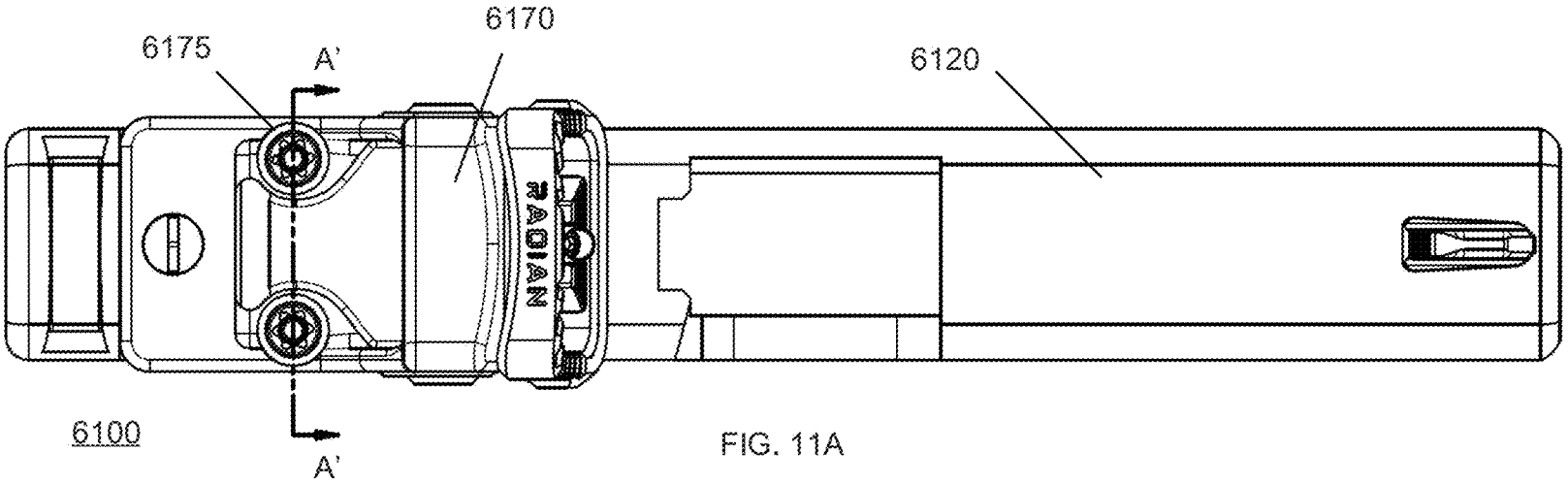
FIG. 11A illustrates a top view of another a slide assembly including an optic self-lockingly fastened to an optic adapter, according to various embodiments.
Figure 11B:
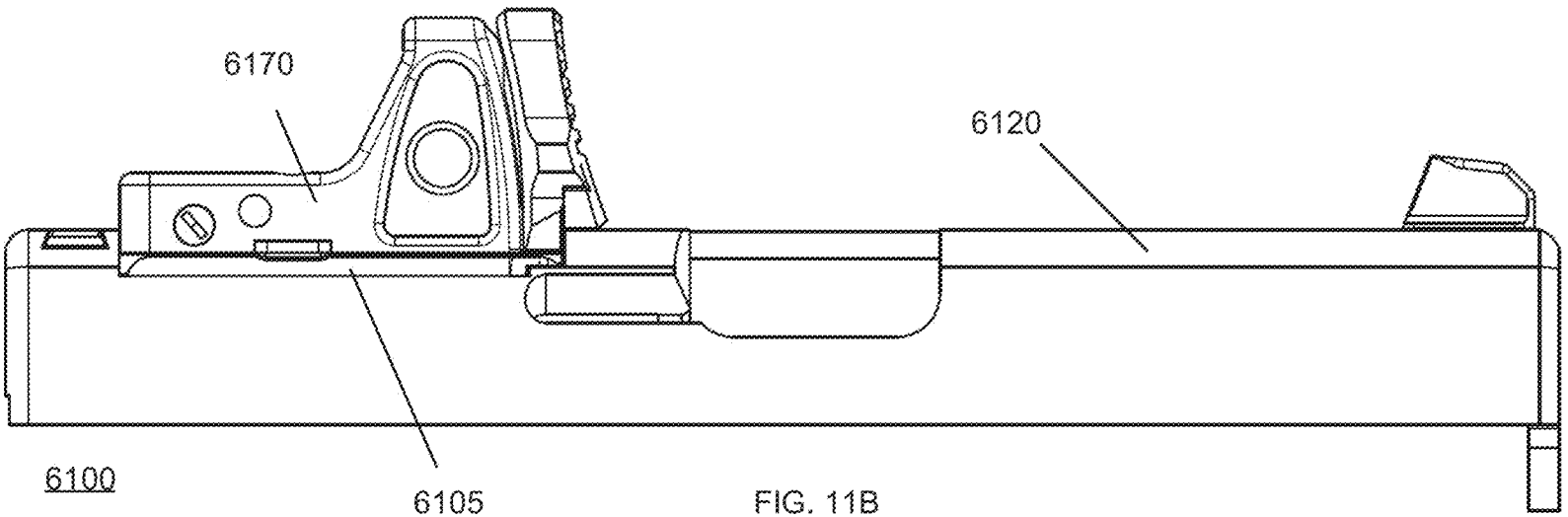
FIG. 11B illustrates a side view of the slide assembly of FIG. 11A.
Figure 12B:
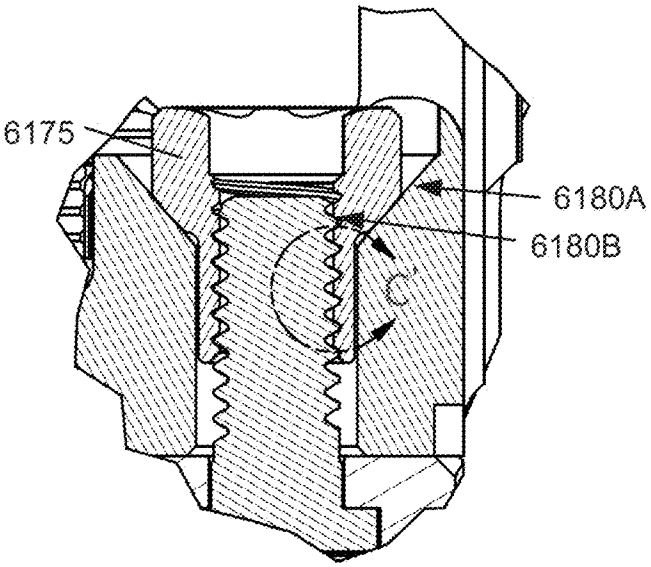
FIG. 12B illustrates a detailed view B' of FIG. 12A.
Figure 12C:
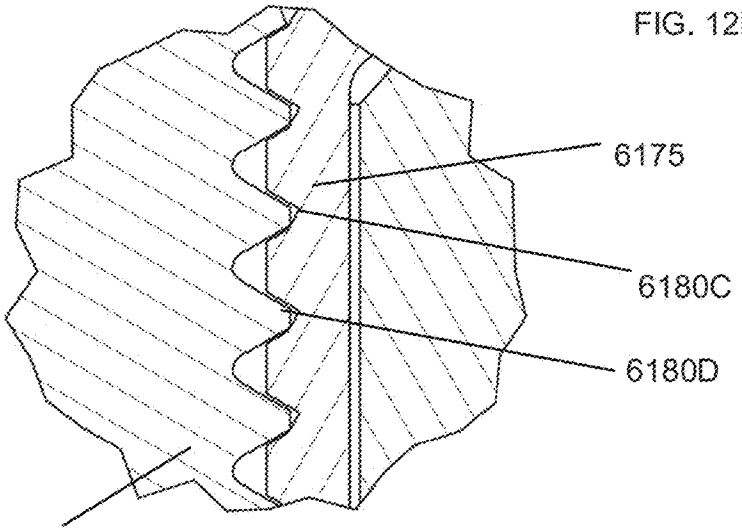
FIG. 12C illustrates a detailed view C' of FIG. 12B.
Figure 12A:
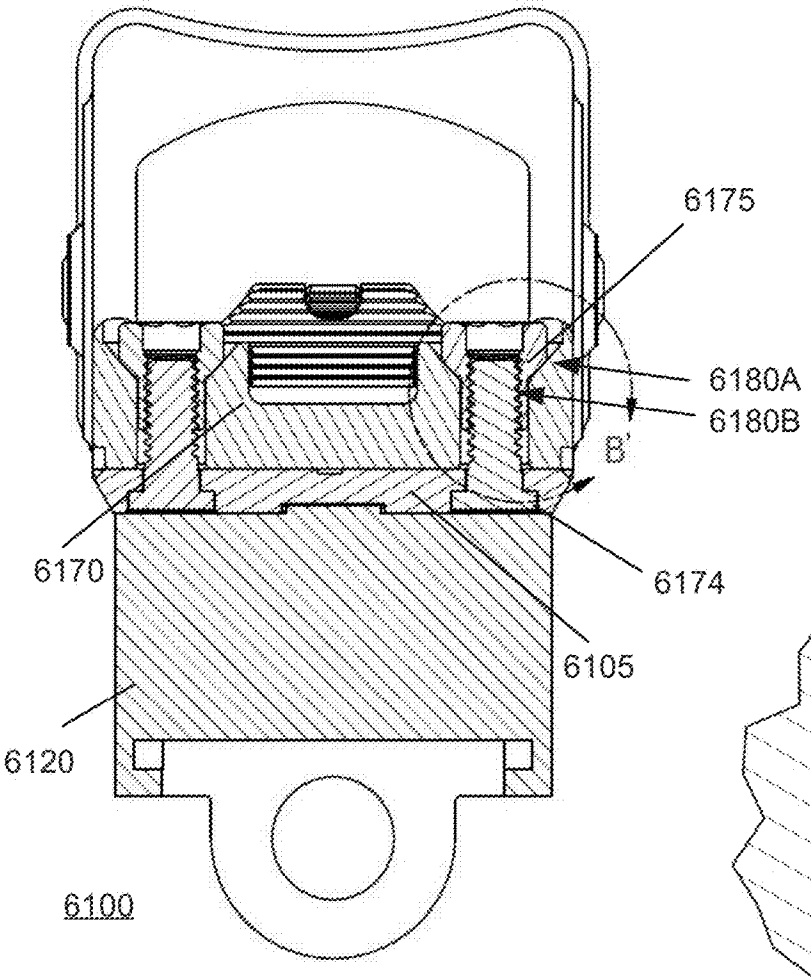
FIG. 12A illustrates a section view taken along section line A'A' of FIG. 11A.
Figure 13B:
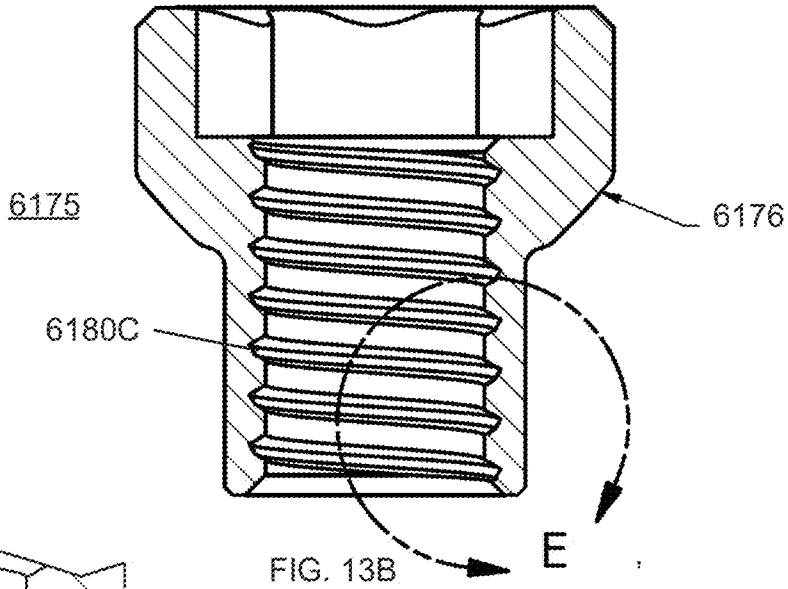
FIG. 13B illustrates a section view taken along section line D'D' of FIG. 13A.
Figure 13C:
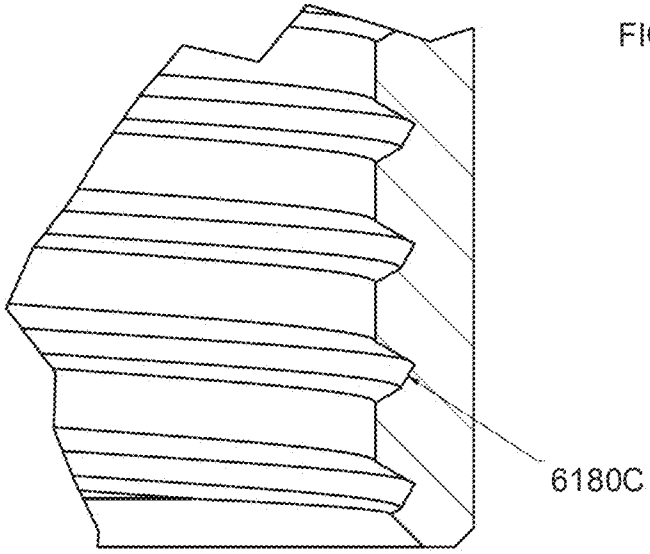
FIG. 13C illustrates a detailed view E' of FIG. 13B.
Figure 13A:
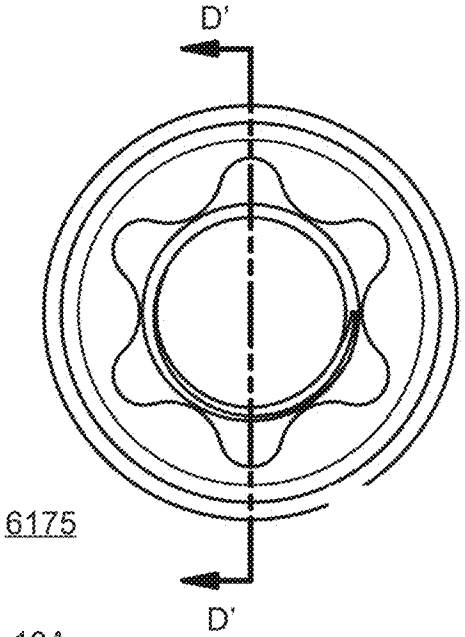
FIG. 13A illustrates a top view of the nut of FIG. 11A.

FIG. 11A illustrates a top view of another a slide assembly 6100 including an optic 6170 self-lockingly fastened to an optic adapter 6105, according to various embodiments. FIG. 11B illustrates a side view of the slide assembly of FIG. 11A. FIG. 12A illustrates a section view taken along section line AA' of FIG. 11A. FIG. 12B illustrates a detailed view B' of FIG. 12A. FIG. 12C illustrates a detailed view C' of FIG. 12B. FIG. 13A illustrates a top view of the nut 6175 of FIG. 11A. FIG. 13B illustrates a section view taken along section line DD' of FIG. 13A. FIG. 13C illustrates a detailed view E' of FIG. 13B.

Referring now to FIG. 11B, the optic adapter 6105 may be similar to optic adapter 5905 in any respect, and may be self-lockingly fastened to the slide 6120 in a similar way that optic adapter 5905 is self-lockingly fastened to the slide 5920. The slide 6120 may be similar in any respect to the slide 5920.

In this embodiment, the rotatably driven part 6175 may be a nut (e.g., a sleeve nut, which may be similar in any respect to any sleeve nut described herein), which may include self-locking female threads 6180C that may be similar to self-locking female threads 5980C in any respect. Referring to FIG. 13B, the nut 6175 may have a tapered section 6176 to provide taper-to-taper contact with the non-threaded opening 6180A (FIG. 12B) similar to any other taper-to-taper contact described herein.

The nut 6175 may include any features of any other nut described herein, in various embodiments. Also, although the illustrated nut 6175 (FIGS. 13A-13C) is a sleeve nut in the illustrated embodiment, in other embodiments other types of nuts may be used in a similar way to the sleeve nut 6175. In still other embodiments, other rotatably driven parts similar in any respect to the sleeve nut 6175 may be used in other embodiments in which an optic is self-lockingly fastened to a slide assembly.

In contrast to the previously described embodiments in which the threaded opening 5980A is defined by the slide 5920, the threaded opening 6180B is a threaded hole of the sleeve nut 6175. The non-threaded opening 6180A may receive a head of the sleeve nut 6175, and may provide taper-to-taper contact.

The optic 6170 and optic adapter 6105 may be similar in any respect to any other optic and optic adapter described herein. In various embodiments, the optic adapter 6105 and/or the optic 6170 may have any locating fastener opening described herein, which may allow the optic 6170 to be released and re-fastened to the slide assembly 6100 without having to re-zero the firearm. The locating fastener opening may be a different opening than the fastener opening illustrated in FIG. 12A, or the illustrated opening may be modified to perform the locating function similar to any locating fastener opening described herein.

The fastener 6174 may be a bottom-up fastener 6174 (e.g., a bottom-up bolt), as illustrated. However, in other embodiments, a threaded post may be integrally formed on an optic adapter, to provide the threading 6180D to mate with the self-locking female threads 6180C. Any structure, now known or later developed, to provide threading to which the self-locking threads may be self-lockingly fastened to may be used.

Figure 14A:
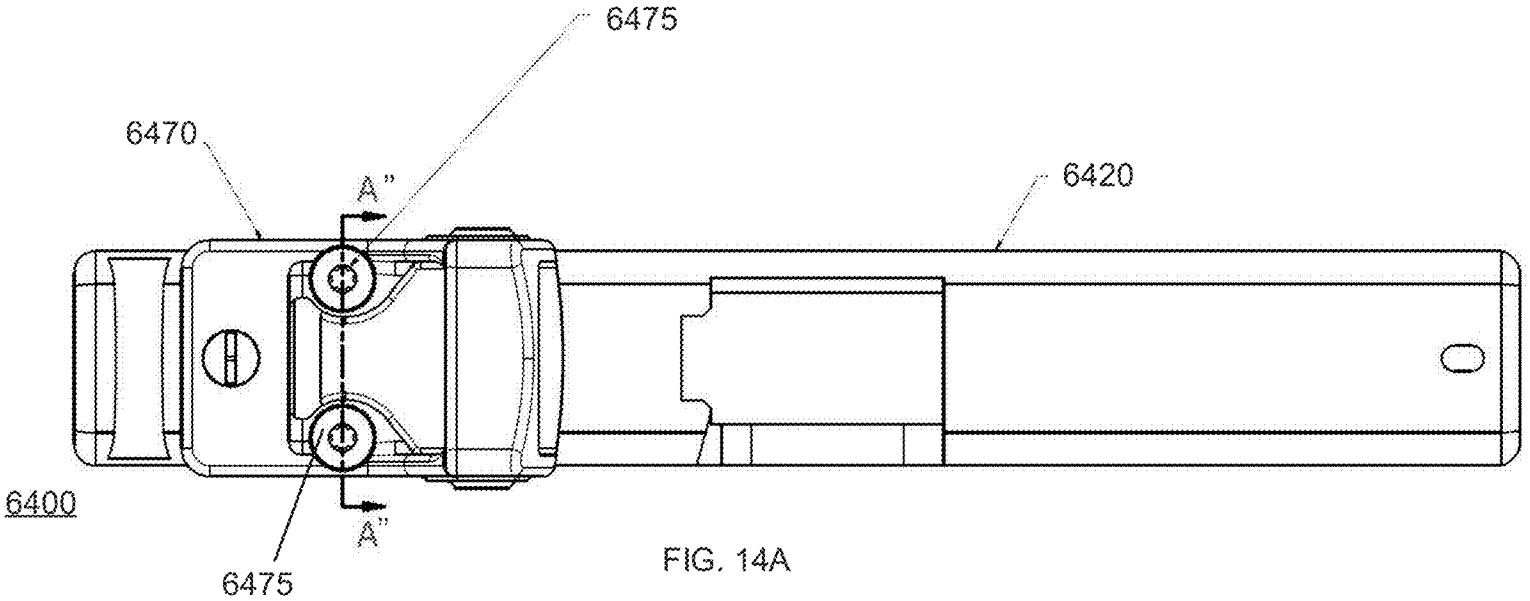
FIG. 14A illustrates a top view of another a slide assembly including an optic self-lockingly fastened to a slide, according to various embodiments.
Figure 14B:
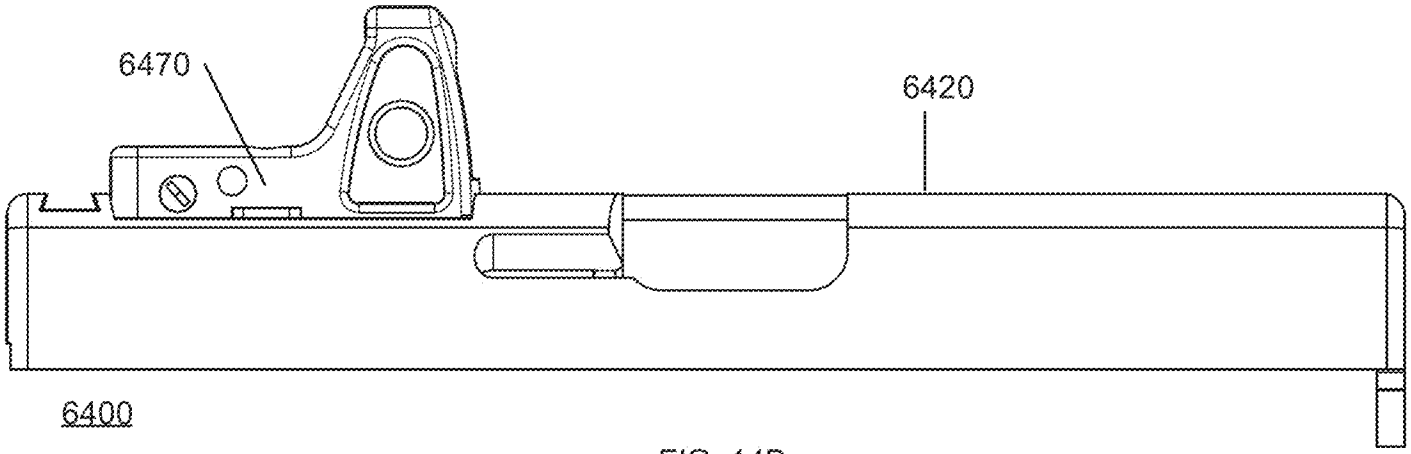
FIG. 14B illustrates a side view of the slide assembly of FIG. 14A.
Figure 15B:
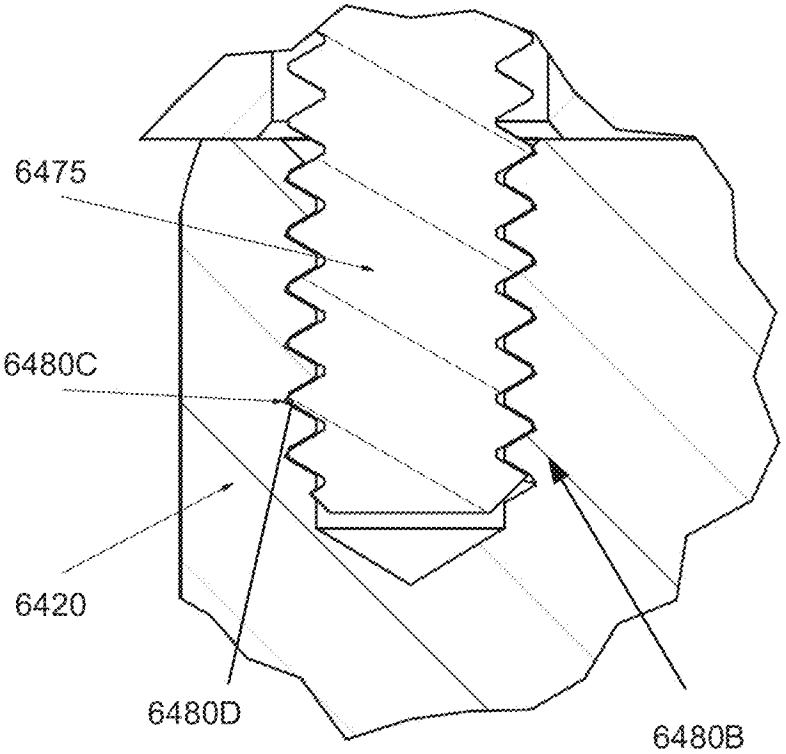
FIG. 15B illustrates a detailed view B" of FIG. 15A.
Figure 15A:
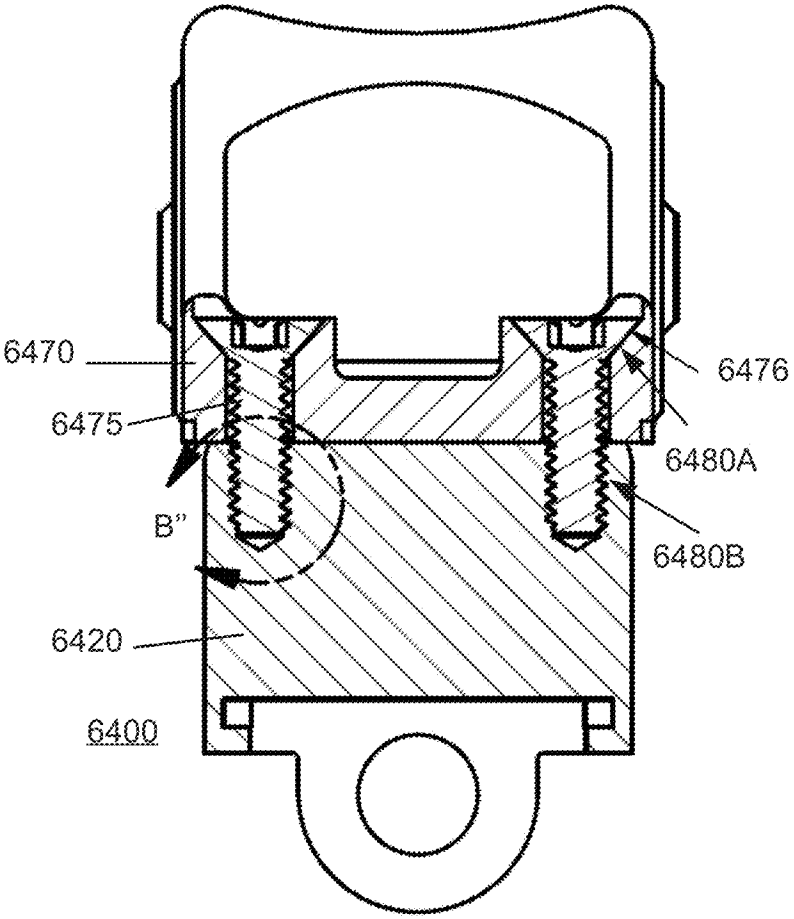
FIG. 15A illustrates a section view taken along section line AA" of FIG. 14A.

FIG. 14A illustrates a top view of another a slide assembly 6400 including an optic 6470 self-lockingly fastened to a slide 6420, according to various embodiments. FIG. 14B illustrates a side view of the slide assembly 6400 of FIG. 14A. FIG. 15A illustrates a section view taken along section line AA" of FIG. 14A. FIG. 15B illustrates a detailed view B" of FIG. 15A.

This is a direct mount embodiment in which slide 6420 includes an optic mounting section to which the optic 6470 may be directly fastened, instead of using optic adapter. There may be a gasket/O-ring and/or a sealing plate (not shown) or the like, located between the directly fastened optic 6470 and the slide 6420, in various embodiments.

In this embodiment, the threaded opening 6480B may be defined by the slide 6420 and the non-threaded opening 6480A (to provide taper-to-taper contact with the taper 6476 defined by the rotatably-driven part 6475) may be defined by the optic 6470. The rotatably-driven part 6475 may provide the threading 6480D to mate with the self-locking threads 6480C. In the illustration, the rotatably-driven part 6475 has threading all the way to its head, but this is not required (in some embodiments the rotatably-driven part 6475 may have a non-threaded shoulder between the threading 6480D and its head).

Figure 16A:
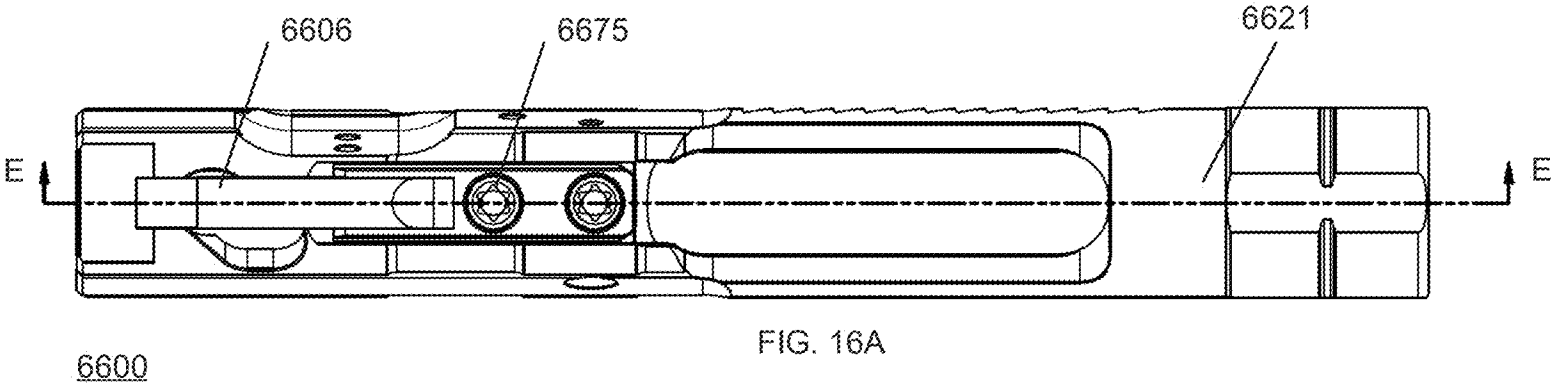
FIG. 16A illustrates a top view an assembly including a gas key self-lockingly fastened to a bolt carrier, according to various embodiments.
Figure 16B:
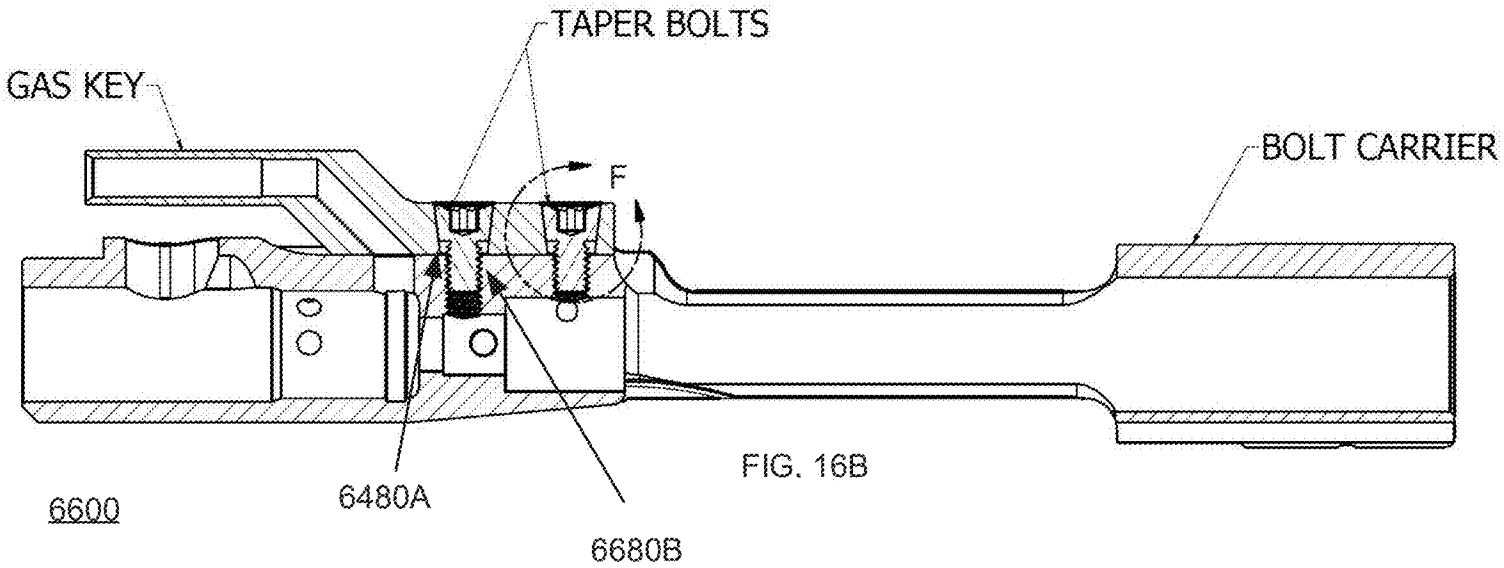
FIG. 16B illustrates a section view taken along section line EE of FIG. 16A.
Figure 17B:
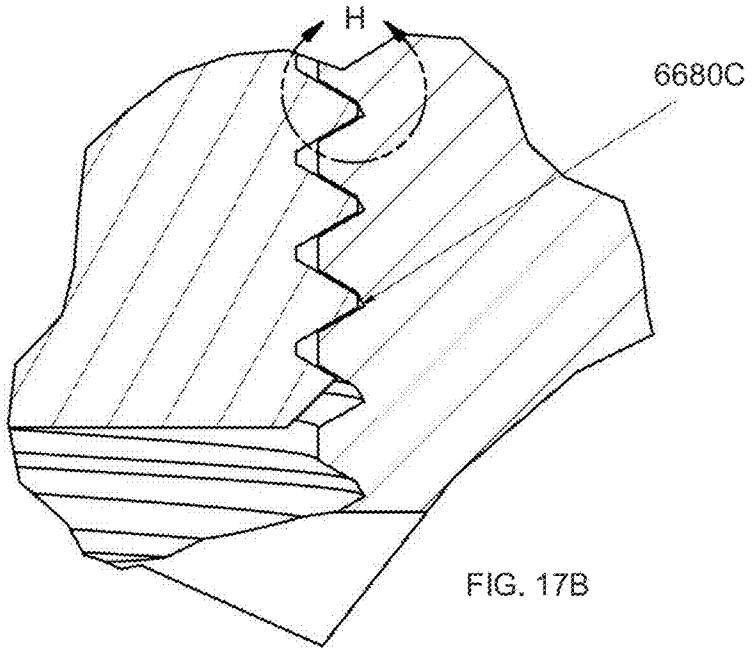
FIG. 17B illustrates a detailed view G of FIG. 17A.
Figure 17C:
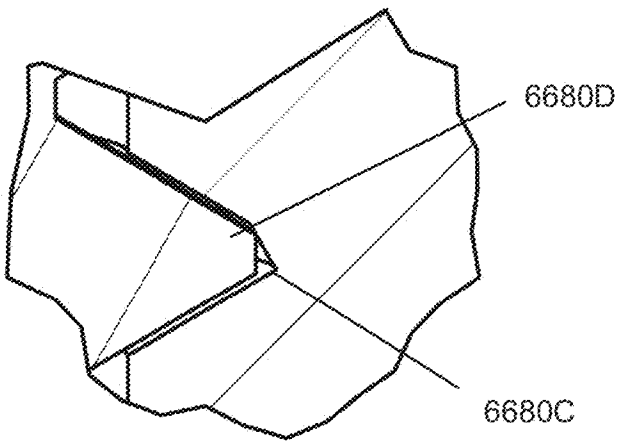
FIG. 17C illustrates a detailed view of a part of the self-locking threads of FIG. 17B.
Figure 17A:
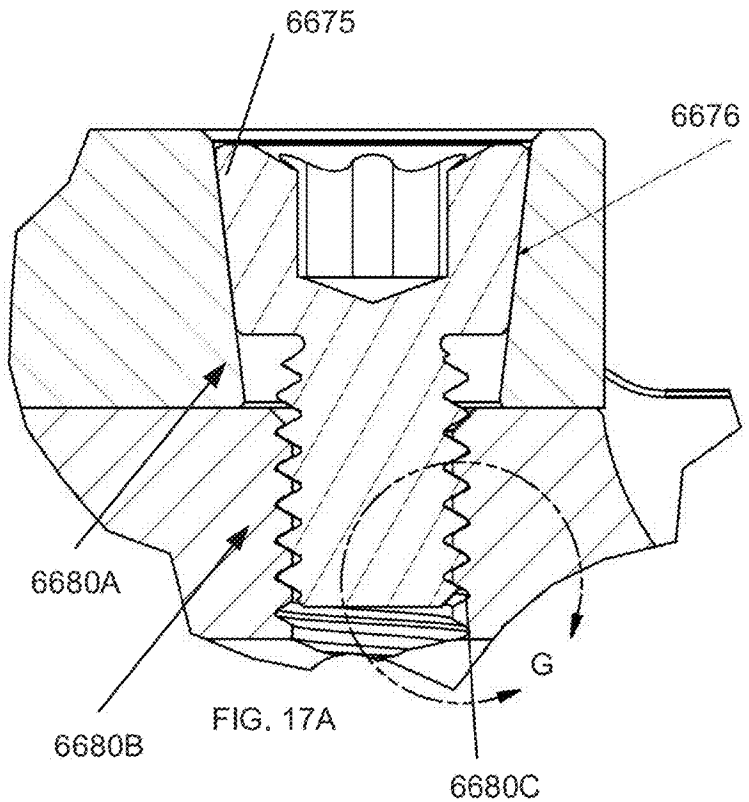
FIG. 17A illustrates a detailed view F of FIG. 16B.
Figure 18A:
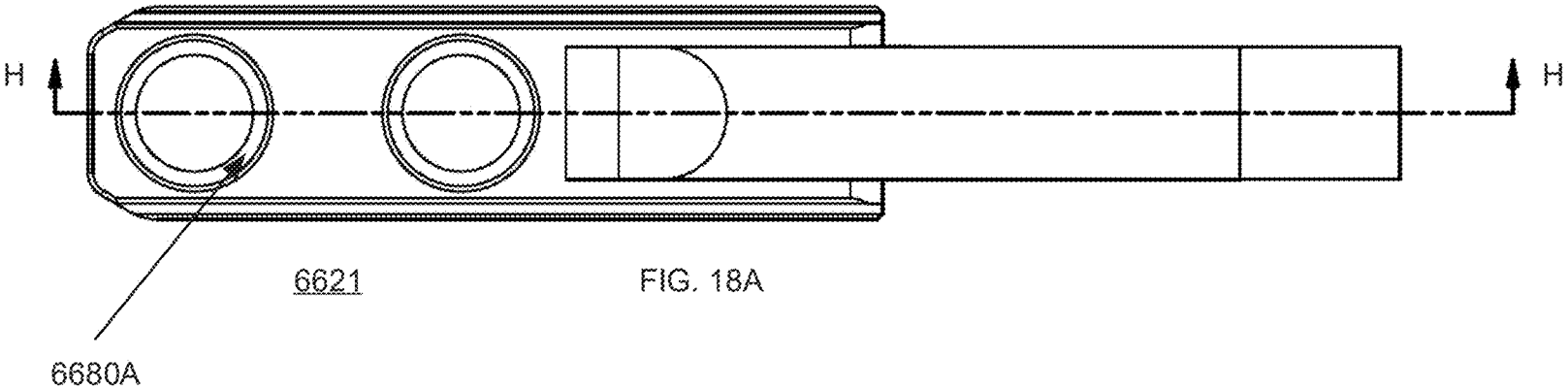
FIG. 18A illustrates a top view of the gas key of FIG. 16A.
Figure 18B:
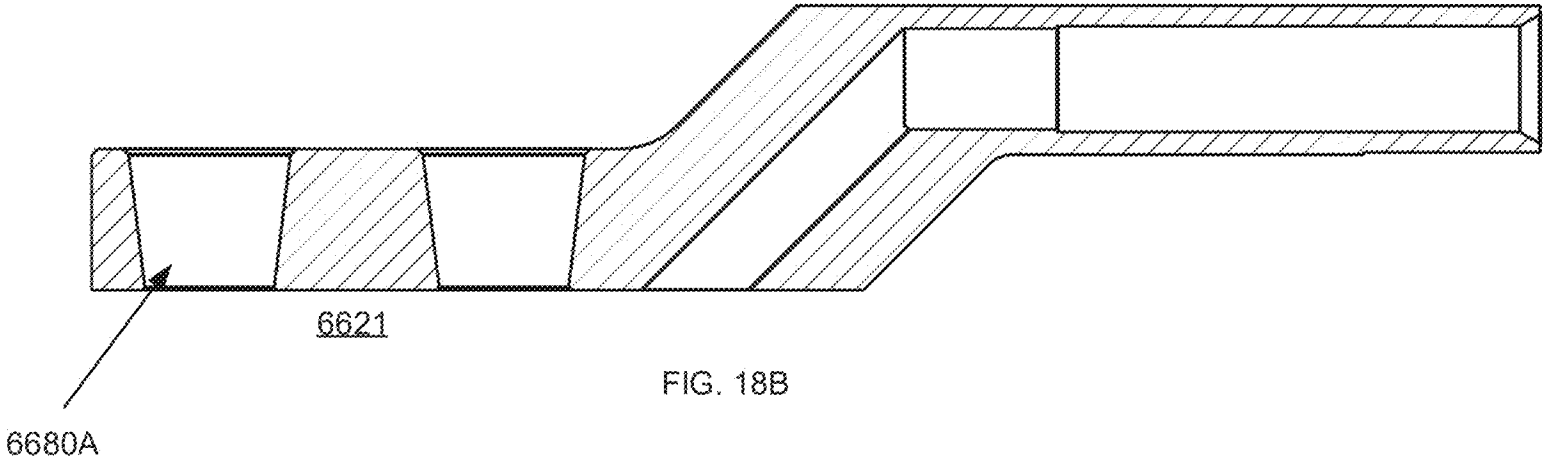
FIG. 18B illustrates a section view taken along section line HH of FIG. 18A.
Figure 19B:
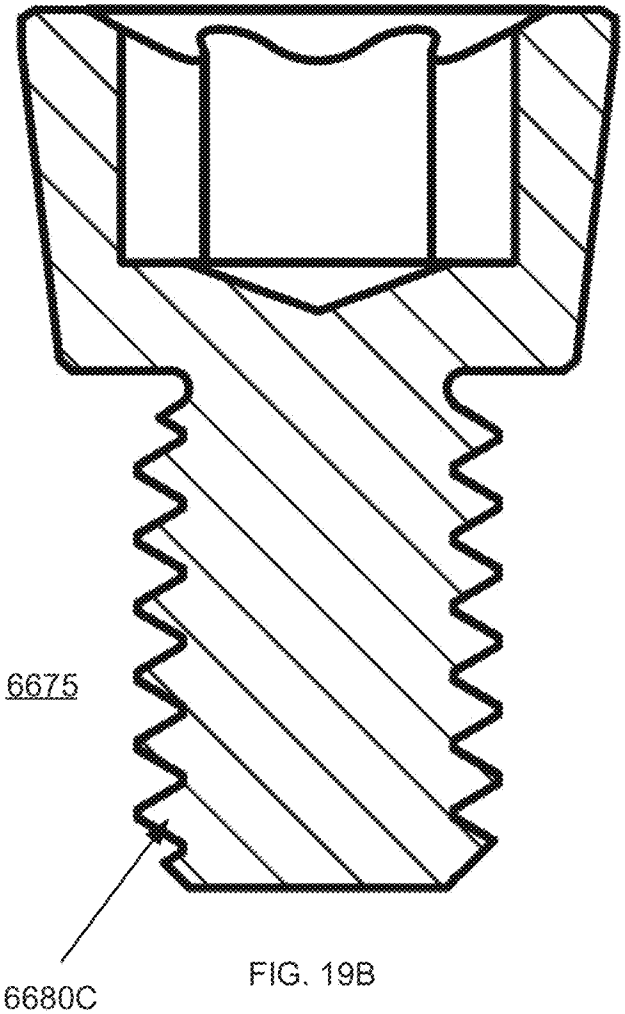
FIG. 19B illustrates a section view taken along section line JJ of FIG. 19A.
Figure 19A:
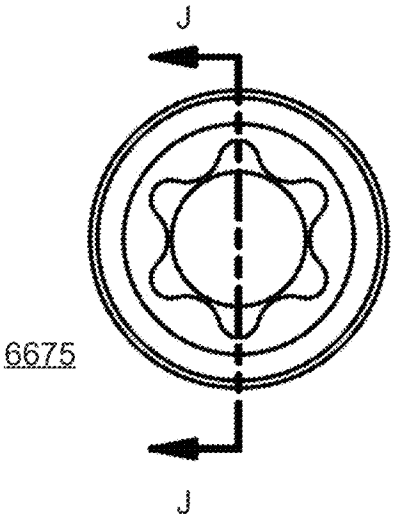
FIG. 19A illustrates a top view of the rotatably-driven part of FIG. 16A.

FIG. 16A illustrates a top view an assembly 6600 including a gas key 6606 self-lockingly fastened to a bolt carrier 6621, according to various embodiments. FIG. 16B illustrates a section view taken along section line EE of FIG. 16A. FIG. 17A illustrates a detailed view F of FIG. 16B. FIG. 17B illustrates a detailed view G of FIG. 17A. FIG. 17C illustrates a detailed view of a part of the threading of FIG. 17B. FIG. 18A illustrates a top view of the gas key 6606 of FIG. 16A. FIG. 18B illustrates a section view taken along section line HH of FIG. 18A. FIG. 19A illustrates a top view of the rotatably-driven part of FIG. 16A. FIG. 19B illustrates a section view taken along section line JJ of FIG. 19A.

Referring now to FIG. 16B, the mating part (the bolt carrier 6621, which may be a reciprocating assembly that reciprocates on an inside of an upper receiver) may define the threaded opening 6680B. The non-threaded opening 6680A may be defined by the gas key 6606. Referring now to FIG. 17A, a taper 6676 to form a locking taper is illustrated here. This arrangement is also self-locking in more than one way, given the self-locking threads 6680C to mate with the threading 6680D. One or more of the recoil-loosening resistances provided by the different structures may individually provide a threshold recoil-loosening resistance (e.g., with the other providing some amount of redundancy), or may provide the threshold recoil-loosening resistance in combination.

Figure 20A:
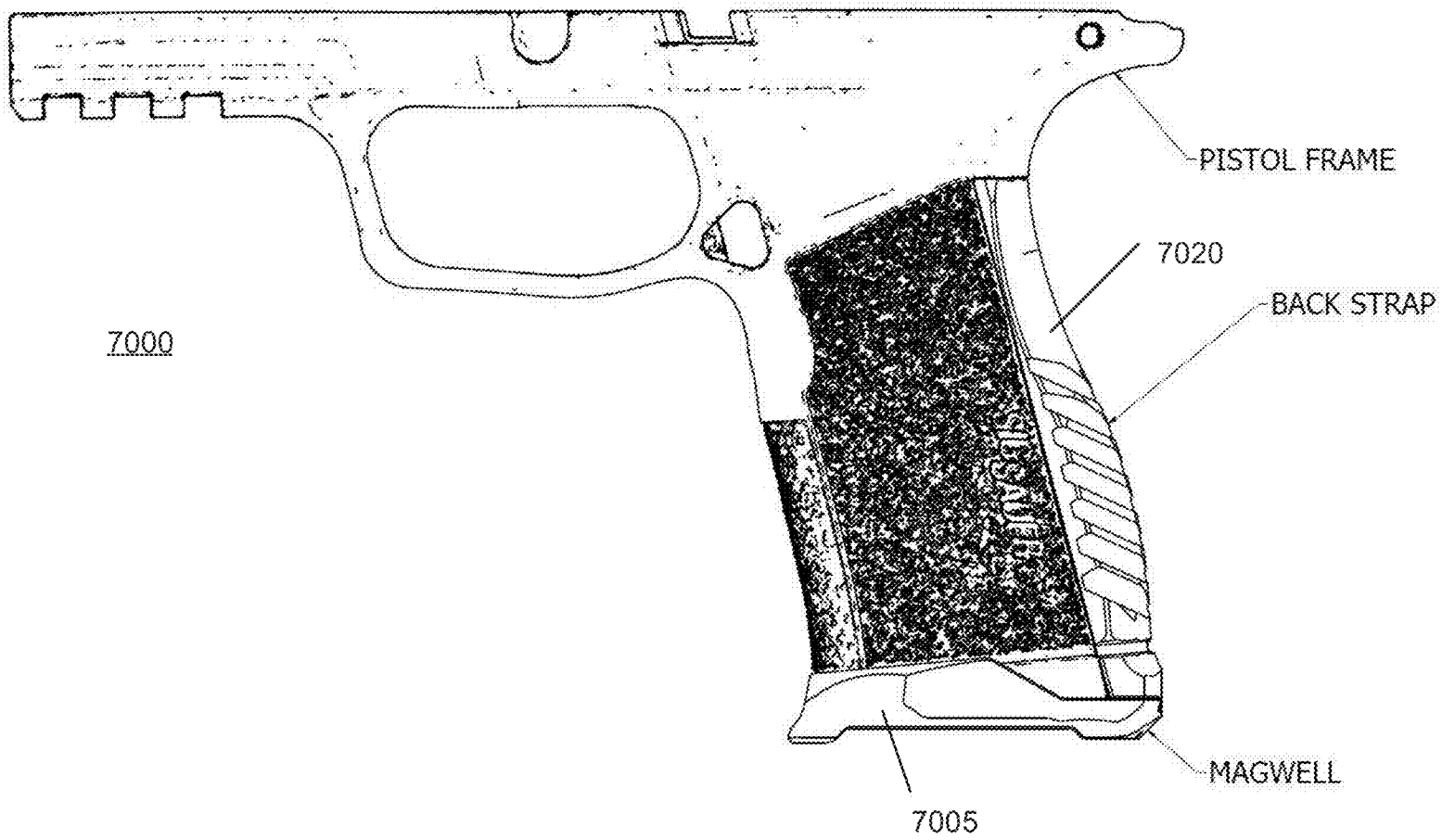
FIG. 20A illustrates an assembly including a magwell self-lockingly fastened to a backstrap, according to various embodiments.
Figure 20C:
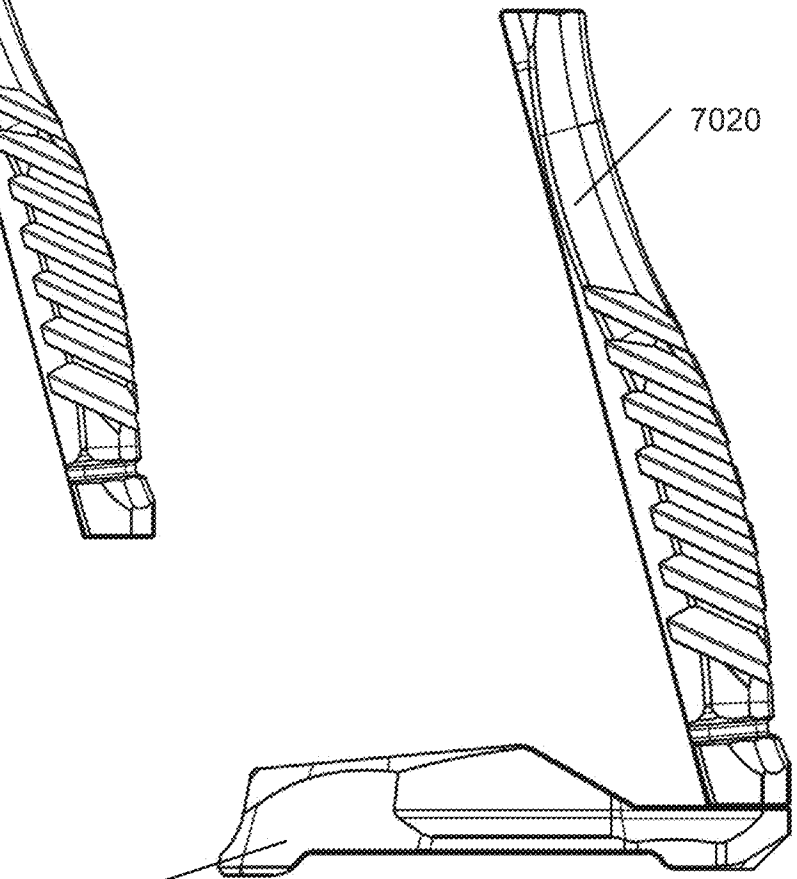
FIG. 20C illustrates a side view of the backstrap and the magwell of FIG. 20A.
Figure 20B:
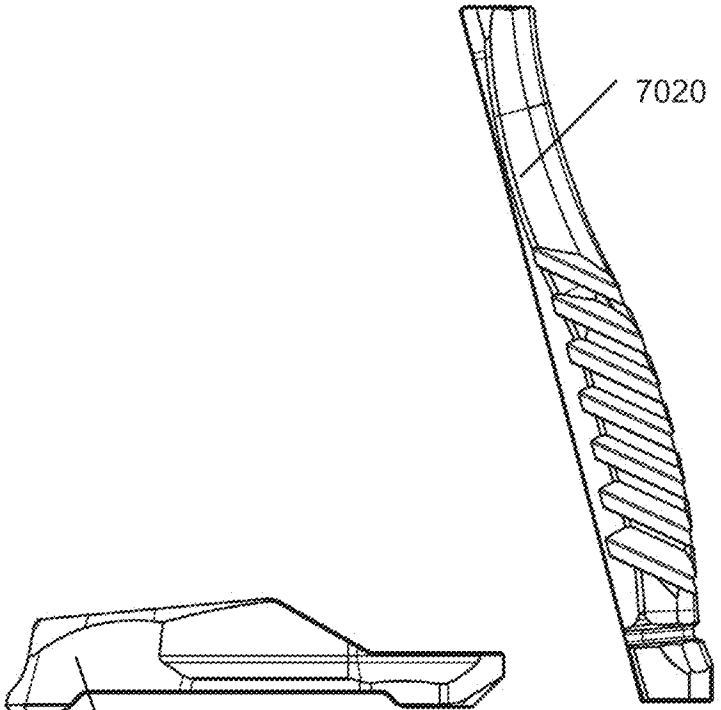
FIG. 20B illustrates an exploded view of the backstrap and magwell of FIG. 20A.
Figure 21B:
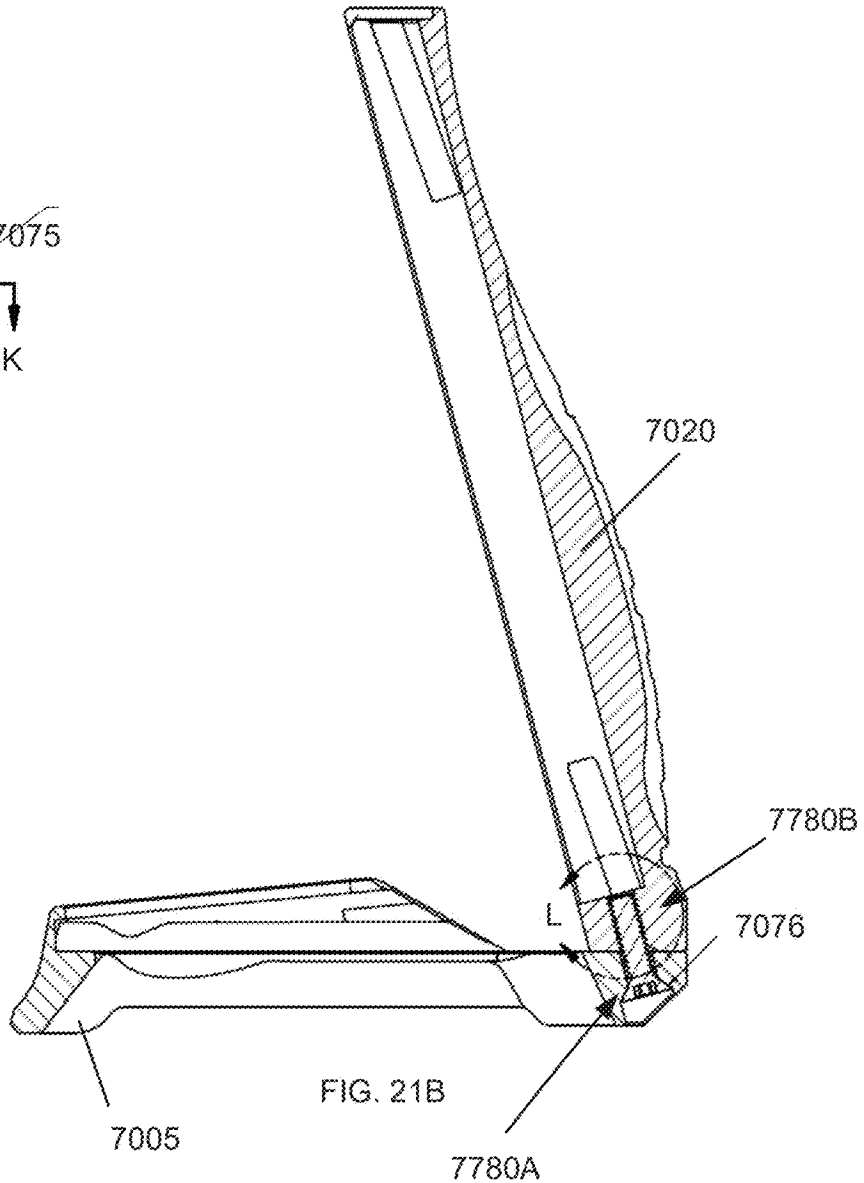
FIG. 21B illustrates a section view taken along section line KK of FIG. 21A.
Figure 21A:
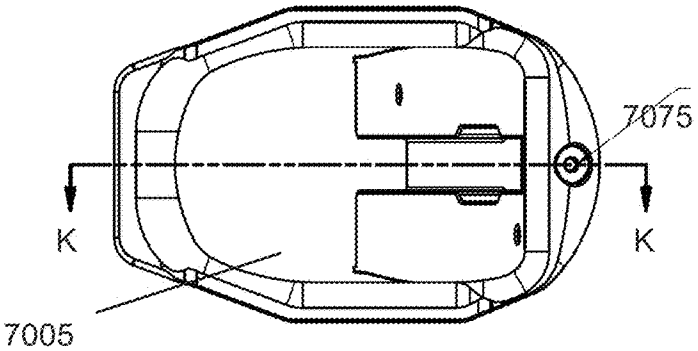
FIG. 21A illustrates a bottom view of the assembly of FIG. 20C.
Figure 22B:
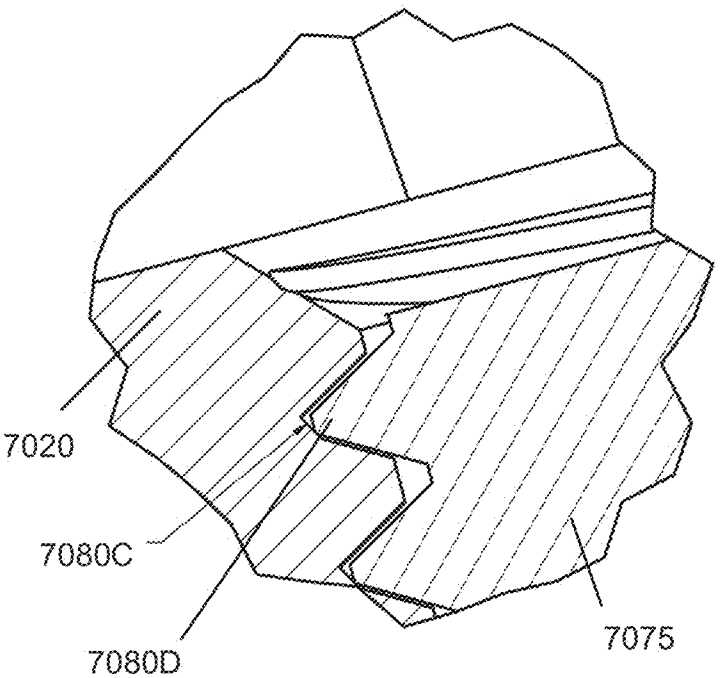
FIG. 22B illustrates a detailed view M of FIG. 22A.
Figure 22A:
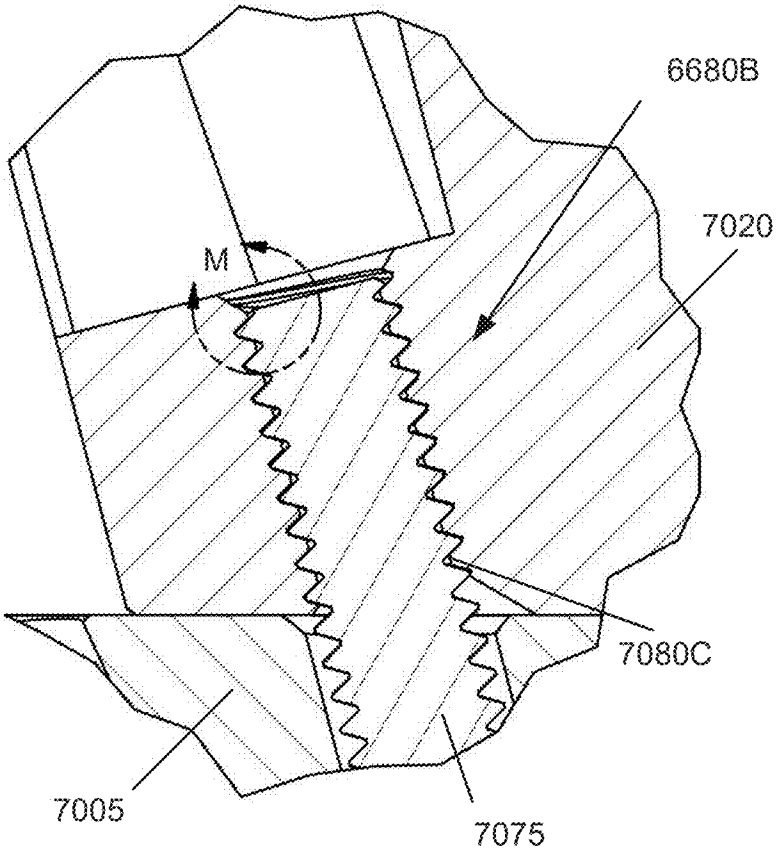
FIG. 22A illustrates a detailed view L of FIG. 21B.

FIG. 20A illustrates an assembly 7000 including a magwell 7005 self-lockingly fastened to a backstrap 7020, according to various embodiments. FIG. 20B illustrates an exploded view of the backstrap 7020 and magwell 7005 of FIG. 20A. FIG. 20C illustrates a side view of the backstrap 7020 and the magwell 7005 of FIG. 20A. FIG. 21A illustrates a bottom view of the assembly of FIG. 20C. FIG. 21B illustrates a section view taken along section line KK of FIG. 21A. FIG. 22A illustrates a detailed view L of FIG. 21B. FIG. 22B illustrates a detailed view M of FIG. 22A.

Referring now to FIGS. 21B, 22A, and 22B in combination, the threaded opening 7780B may be defined by the mating part (the backstrap 7020). The magwell 7005 may define the non-threaded opening 7780A. A conical taper 7076 of the rotatably-driven fastener has a shallower slope than the previously illustrated embodiment due to application requirements. The self-locking threads 6680C may be defined by the backstrap 7020, and the threading 7080D may be defined by the rotatably-driven part 7075.

Figure 23A:
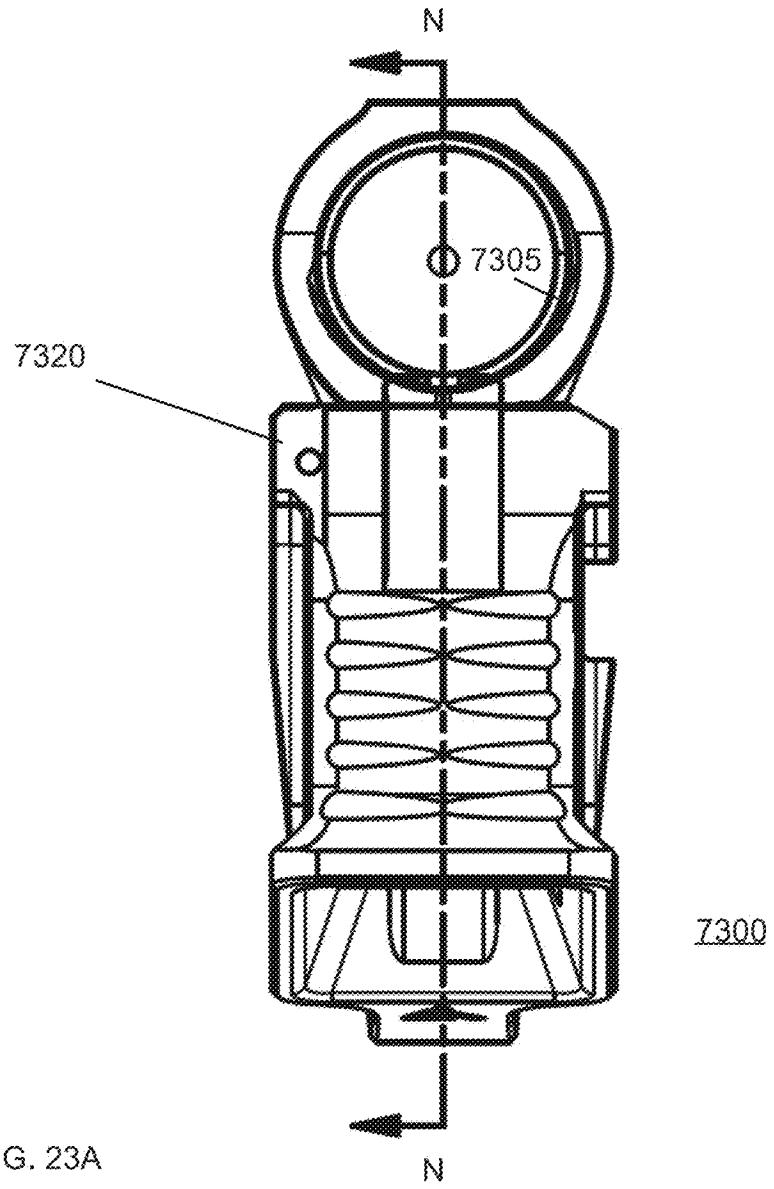
FIG. 23A illustrates a front view of a firearm assembly including a buffer tube self-lockingly fastened to a lower receiver, according to various embodiments.
Figure 23B:
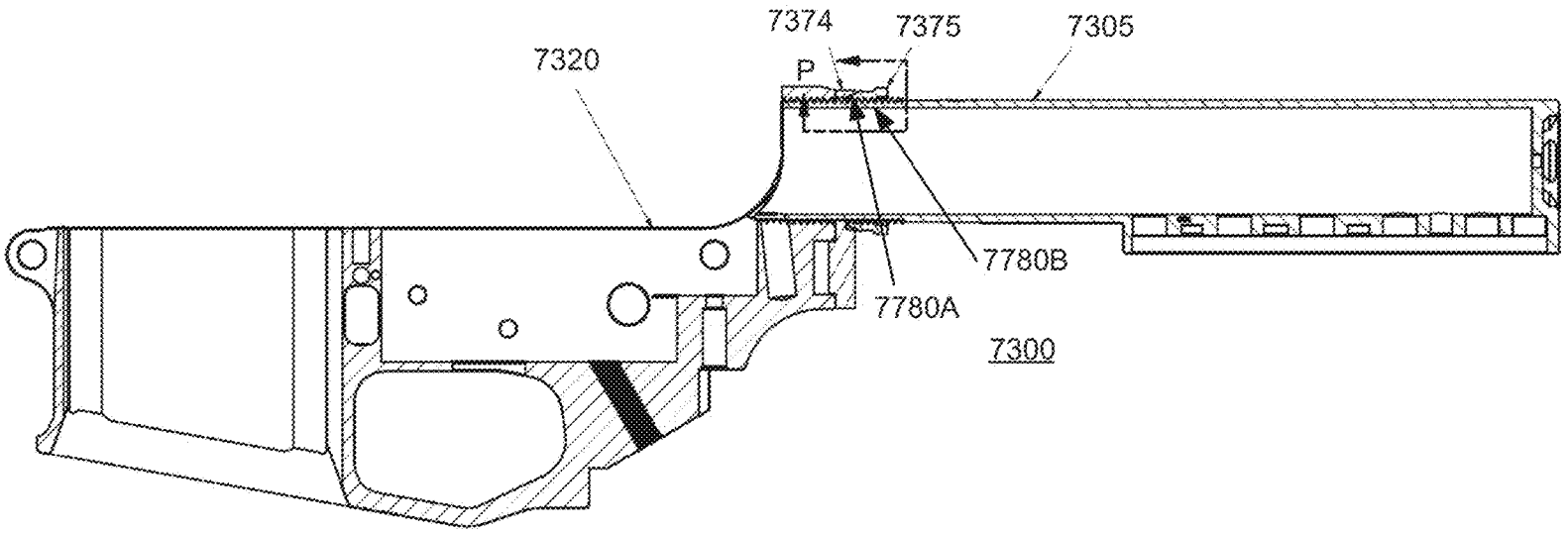
FIG. 23B illustrates a section view taken along section line NN of FIG. 23A.
Figure 23C:
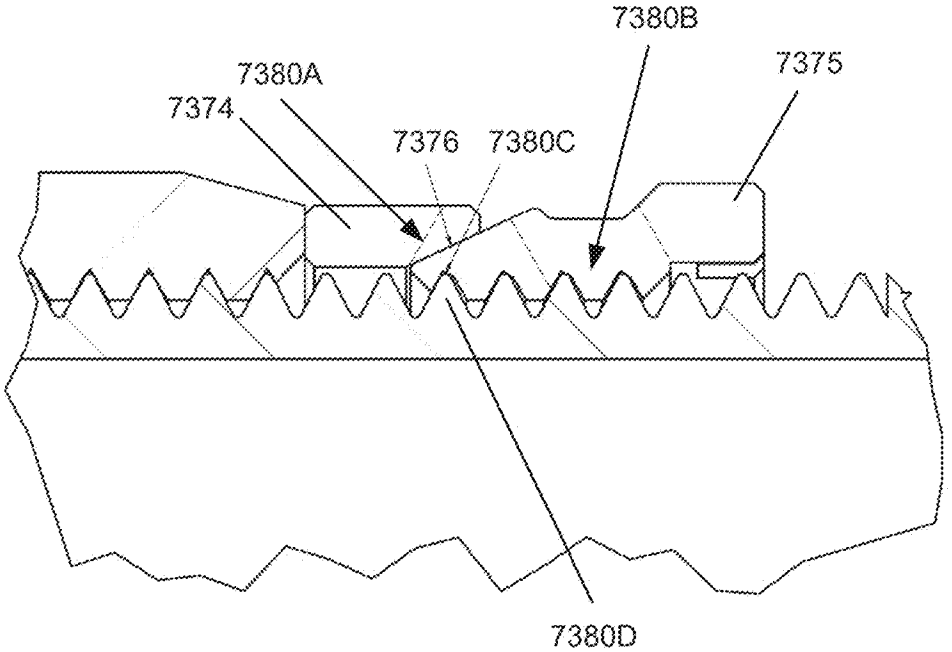
FIG. 23C illustrates a detailed view P of FIG. 23B.
Figure 24B:
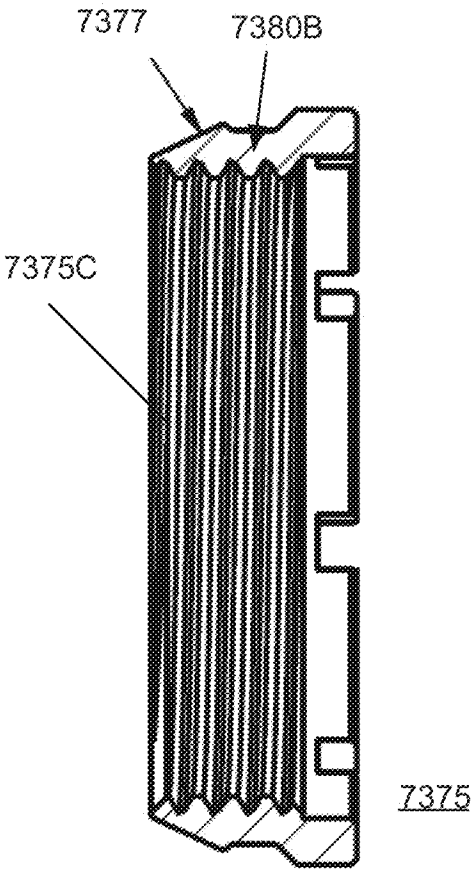
FIG. 24B illustrates a section view taken along section line QQ of FIG. 24A.
Figure 24A:
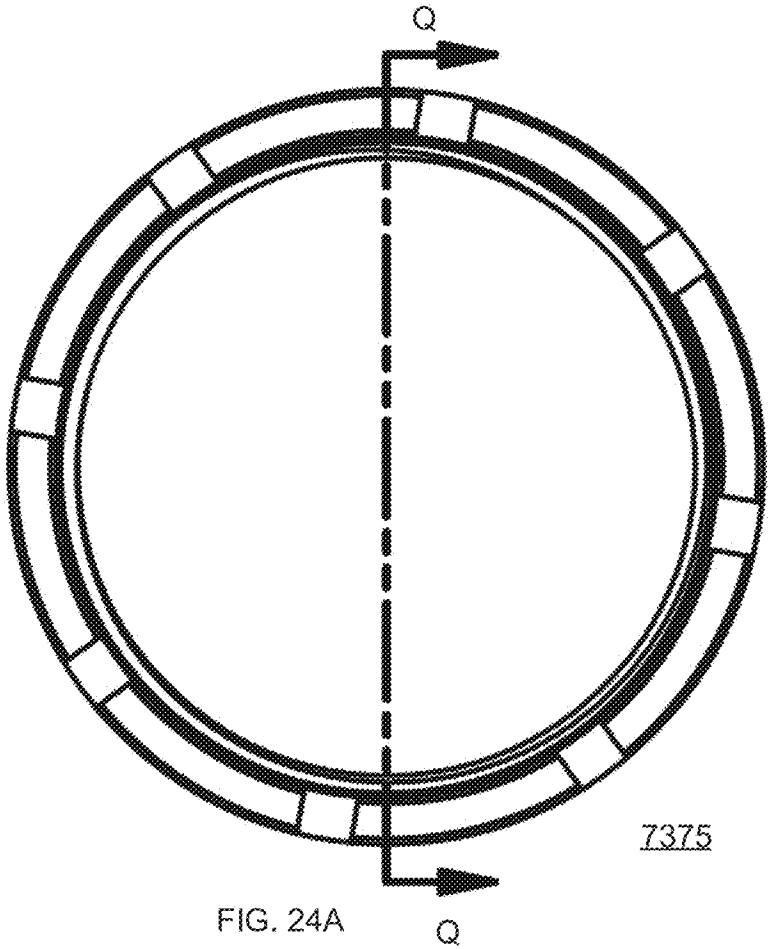
FIG. 24A illustrates a front view of the castle nut of FIGS. 23A-B.
Figure 25B:
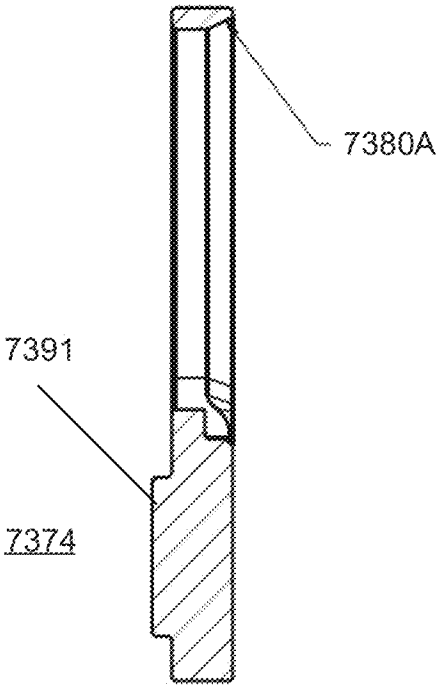
FIG. 25B illustrates a section view taken along section line RR of FIG. 25A.
Figure 25A:
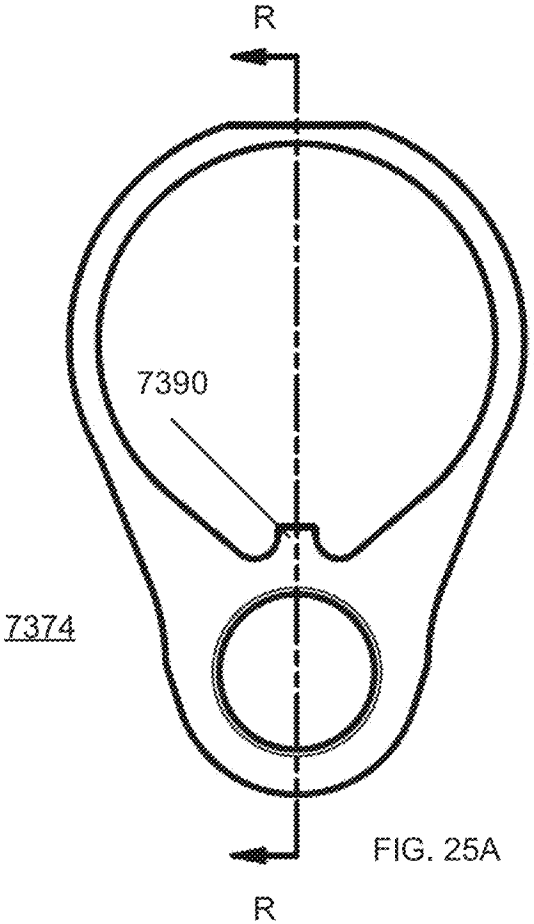
FIG. 25A illustrates a front view of the end plate of FIG. 23A-B.

FIG. 23A illustrates a front view of a firearm assembly 7300 including a buffer tube 7305 self-lockingly fastened to a lower receiver 7320, according to various embodiments. FIG. 23B illustrates a section view taken along section line NN of FIG. 23A. FIG. 23C illustrates a detailed view P of FIG. 23B. FIG. 24A illustrates a front view of the castle nut 7375 of FIGS. 23A-B. FIG. 24B illustrates a section view taken along section line QQ of FIG. 24A. FIG. 25A illustrates a front view of the end plate 7374 of FIG. 23A-B. FIG. 25B illustrates a section view taken along section line RR of FIG. 25A.

End plate 7374 includes a tab 7390 (FIG. 25A) that engages a corresponding notch in the bottom of the buffer tube 7305. The boss 7391 (FIG. 25B) engages a corresponding recess in the lower receiver 7320 (FIG. 23B). These fix rotational positions (relative to the lower receiver 7320) of the buffer tube 7305 and the endplate 7374, respectively.

This embodiment uses a nut 7375 (e.g., a castle nut) to self-lockingly fasten the buffer tube 7305 to a buffer tube tower of the lower receiver 7320. The threaded opening 7380B is defined by an interior of the nut 7375. In this embodiment, the mating part is a lower receiver assembly including the end plate 7374. The end plate 7374 defines the non-threaded opening 7380A including the tapered opening. A taper 7376 to form a locking taper is illustrated, formed by the taper-to-taper contact of a taper 7376 (FIG. 23B) on the nut 7375 and the steeply sloped non-threaded opening 7380A defined by the end plate 7374.

In this embodiment, the threading 7380D to mate with the self-locking threads 7380C is defined by the other part of the self-lockingly fastened parts (e.g., the buffer tube 7305). The buffer tube 7305 may be threaded to the end plate, and then the castle nut 7375 may be tightened to non-fixably couple the buffer tube 7305 to the mating part.

In any embodiments described herein in which a rotatably-driven part is a fastener, any locating function described herein may be also be performed by the rotatably-driven part, if desired/required. In one example, any self-locking fastener opening described herein may have a locating section located between any threaded and non-threaded openings described herein. The locating section may be dimensioned to slip-fittingly receive a non-threaded shoulder of the rotatably driven fastener to align a center axis of the rotatably-driven part with a center axis of the threaded opening defined by the mating part, similar to any locating fastener opening embodiments described herein. In another example, a conical taper head of a locating fastener may be received by a locating counter opening of the self-lockingly fastened parts to align a center axis of the rotatably-driven part with a center axis of the threaded opening defined by the mating part.

Any of the self-locking features described herein may be used in any embodiments of a locating fastener opening and/or undercut attachment interface. For example:

- Any self-locking threads described herein may be added to any locating counter opening described herein (e.g., added to the locating counter opening illustrated in FIG. 2A);
- The counter opening 4180B (FIG. 3A) may define self-locking threads similar to any self-locking threads described herein, to self-lockingly fasten the optic adapter 4105 to the slide 4120 in more than one way (i.e., in addition to the recoil-loosening resistance provided the locking taper illustrated by that figure).

Also, it is noted that any threaded opening described in the '414 patent can be modified to include any self-locking threads described herein. U.S. Non-provisional patent application Ser. No. 18/244,731, filed on Sep. 11, 2023 and entitled SELF-LOCKINGLY FASTENED COMPONENTS IN A RECOIL ENVIRONMENT, is incorporated by reference herein.

Tapered Opening to Urge Contact Between a Mounted Component and a Base Component in a Recoil Environment As explained herein in the section describing self-lockingly fastened parts, threaded fasteners may be used to attach a wide variety of parts in a recoil environment—including OEM parts and aftermarket parts. However, some known arrangements may expose the fasteners to a wide variety of sheer forces. For instance, the fasteners may be exposed to these sheer forces when the firearm receives an impact (such as from the ground or an object). Also, the fasteners may be exposed to these sheer forces during normal operation of the firearm, particularly when the part is mounted to a reciprocating part, is part of an assembly mounted to the reciprocating part and/or when the firearm is charged by pushing a mounted component against an object.

These forces may cause the fasteners to flex, which may produce damage over time to the fasteners (e.g., stretching of the fasteners and/or micro fractures) and/or degradation of the fastening functioning (e.g., loosening). This loosening may induce play to the assembly, further allowing damage as the fasteners are allowed to flex more from impact or recoil. This play may be particularly undesirable when the mounted part is an aiming device, such as an optic or a mechanical sight because the play may produce some degree of inaccuracy. The damage may ultimately lead to the fastener failing completely (e.g., fracturing into two pieces).

FIGS. 5A-B illustrate an arrangement in which a tapered opening 4185 has a center axis that is offset with respect to a center axis of a locating fastener opening 4180B. As a fastener is tightened in this arrangement, the bracket 4105 is urged forward, interlocking the undercut structure 4199B (FIG. 3A) and the undercut structure 4199A (FIG. 3C).

In some known optic mounting devices, the only surface that may make contact with a firearm may be the bottom surface of an adapter (or a bottom surface of an optic in a direct mount arrangement). However, this known contact may not prevent the optic or the adapter from developing play in the fore/aft direction and/or lateral directions. This known contact also may not protect the fasteners during reciprocating action of the slide and/or during an impact (the fasteners may be exposed to sheering forces in the fore/aft direction and/or lateral directions).

Referring now to FIG. 5B, the urging caused by the installation of the locating fastener 4180A in the locating fastener opening 4180B and the tapered opening 4185 may result in contact between additional surface(s) of bracket 4105 and/or the slide 4120. In this particular example, the additional surface(s) of the bracket 4105 may include surfaces of sides of the bracket 4105 (e.g., undercut structure 4199A and/or an end such as a front end of the bracket 4105). This additional contact may protect the fastener 4180A from sheer forces resulting from reciprocation of the slide 4120, impact to the bracket 4105, and/or impact to an optic 4170 mounted thereon. As such, fastener flex may be avoided and/or reduced, thus eliminating or reducing damage to fasteners and fastener function over time.

In various embodiments using a tapered opening to urge contact between a mounted component and a base component, with reference to FIG. 5A, an apparatus may include an assembly to operate in a recoil environment, in which at least one part of the assembly (e.g., bracket 4105) is fastened to at least one base part (e.g., slide 4120). The fastened parts may include a threaded opening (e.g., threaded hole 4180B), and a non-threaded opening (e.g., 4185). The non-threaded opening may include a tapered opening (e.g., 4185) to urge the at least one part of the assembly against at least one additional surface (e.g., the interlocking undercut structures), in response to fastening the at least one part of the assembly to the at least one base part using the threaded opening (e.g., using the threaded hole 4180B).

Although the contacting surface(s) of the mounted device (e.g., bracket 4105) are undercut structures in the embodiment illustrated in FIG. 5A, this is not required in other embodiments. The contacting surfaces may be any other surface of the mounted device, such as part of a back end and/or a front end of the mounted device, or part of a recoil post opening. Without limitation as to the location of contact, FIGS. 26A-29C illustrate various an embodiment in which the contacting surface(s) include a back of a mounted device and/or part of a recoil post opening.

In various embodiments, any contacting surface may be any other surface of the mounting device that may be urged into contact with any part of the firearm assembly (using a tapered opening) to prevent fastener flex and/or protect the fastener(s) from impact. In various embodiments, the contacting surface may be any surface-to-surface contact, including but not limited to:

- one or more curved surface(s) (e.g., a recoil post opening, or some other surface with one or more curved sections),
- a single flat (e.g., a surface having a single planar face),
- more than one flat (e.g., a surface with more than one face), or
- combinations thereof.

Figure 26A:
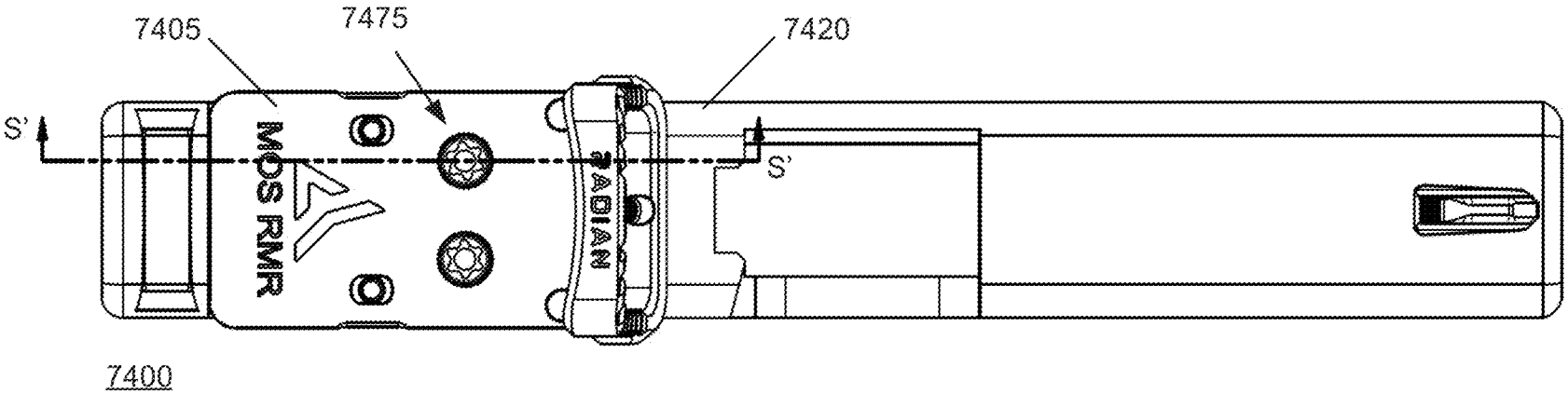
FIG. 26A illustrates a top view of a slide assembly including a tapered opening to urge contact between a mounted component and a base component, according to various embodiments.
Figure 26B:
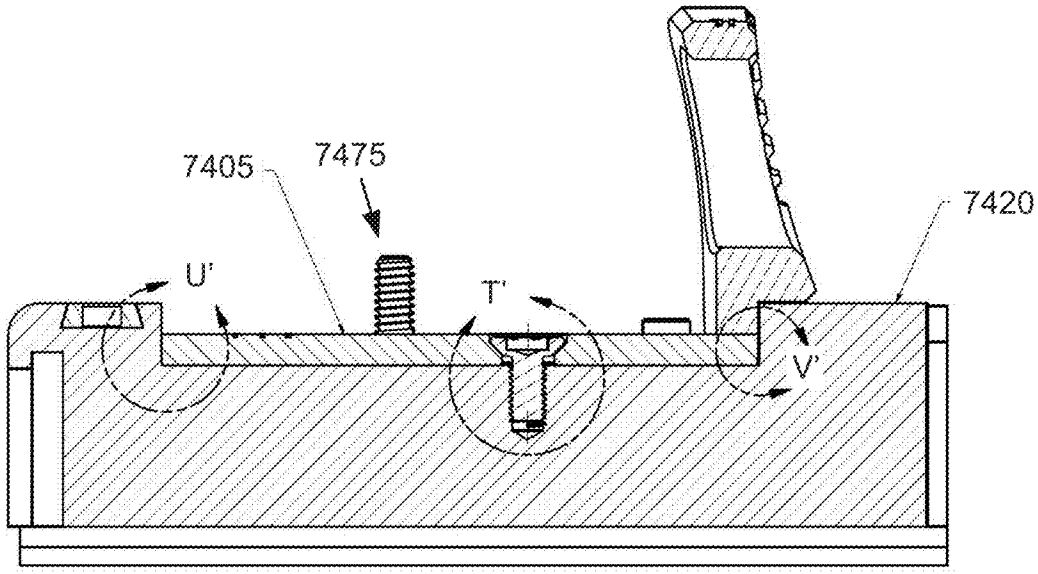
FIG. 26B illustrates a section view taken along section line S'S' of FIG. 26B.
Figure 26C:
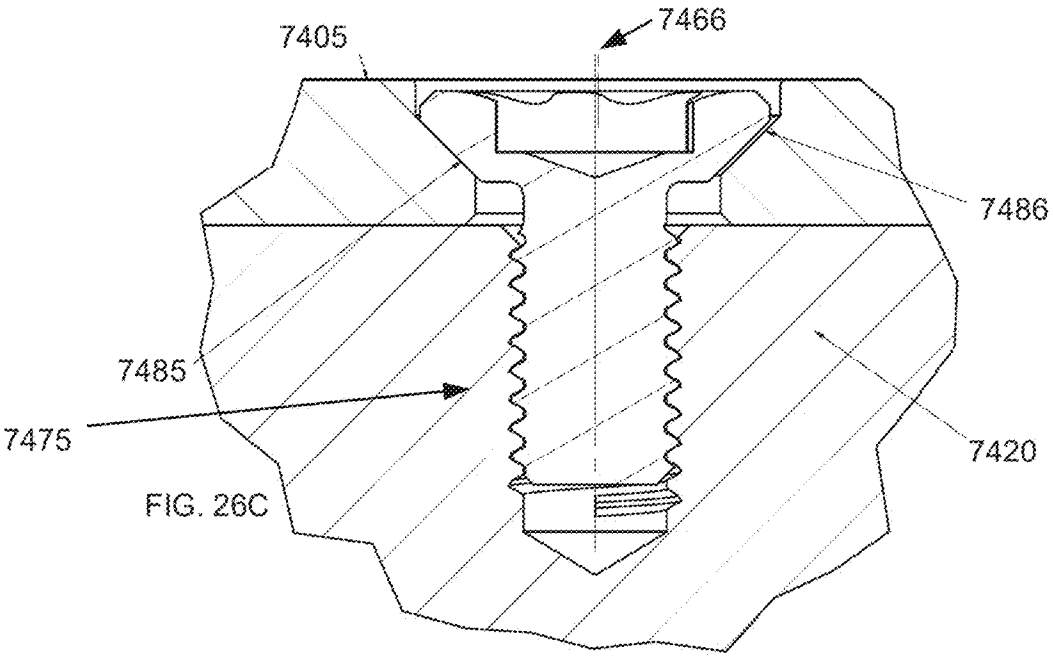
FIG. 26C illustrates a detailed view T' of FIG. 26B.
Figure 26E:
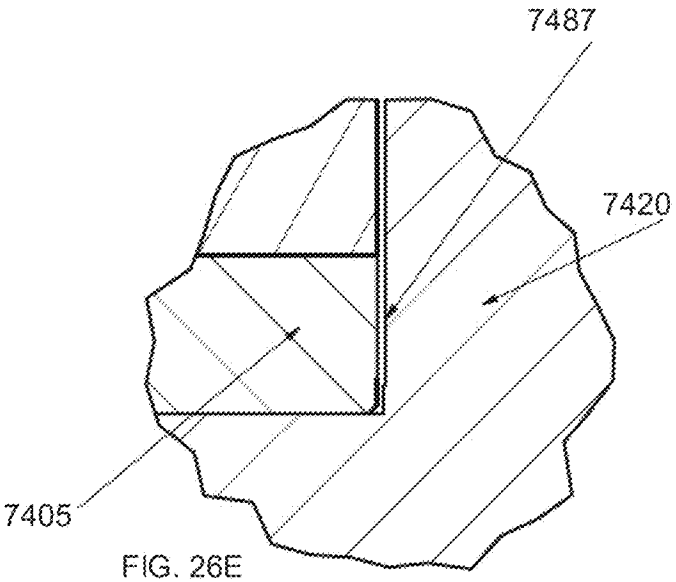
FIG. 26E illustrates a detailed view V' of FIG. 26B.
Figure 26D:
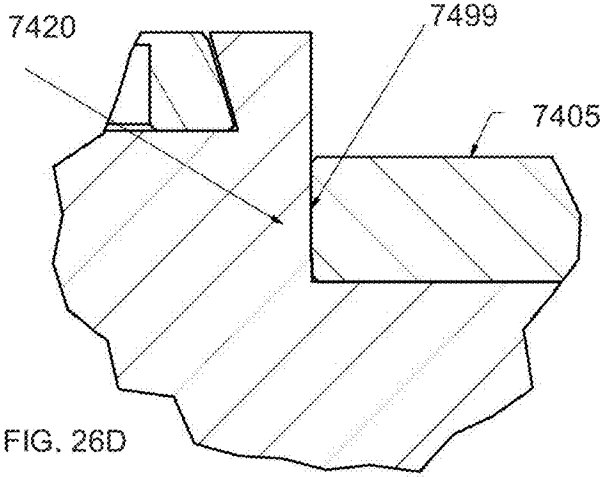
FIG. 26D illustrates a detailed view U' of FIG. 26B.

FIG. 26A illustrates a top view of a slide assembly 7400 including a tapered opening to urge contact between a mounted component and a base component, according to various embodiments. FIG. 26B illustrates a section view taken along section line S'S' of FIG. 26A. FIG. 26C illustrates a detailed view T' of FIG. 26B. FIG. 26D illustrates a detailed view U' of FIG. 26B. FIG. 26E illustrates a detailed view V' of FIG. 26B.

Referring to FIGS. 26A and 26B, in this embodiment the mounted device is an optic adapter 7405, which may be similar to any optic adapter described herein. The rotatably driven fastener 7475 may include a threaded section (e.g., a threaded length) and one or more non-threaded sections (e.g., a tapered head, and in some embodiment a non-threaded shoulder). The slide 7420 may be similar to any slide described herein.

Referring now to FIG. 26C, axes 7466 of the threaded hole in the slide 7420 and the tapered opening 7485 may be non-coaxial (e.g., an axis of the tapered opening 7485 may be offset relative to an axis of the threaded hole). Due to this offset, as the rotatably driven fastener 7475 is installed in the threaded hole, one side of the tapered head makes contact with the tapered fastener opening 7485. The other side of the tapered head may have no contact, in some embodiments (the illustration depicts a gap 7486 on an opposite side of the tapered head—the size of the gap may be exaggerated for emphasis and may not be to scale).

Referring to FIGS. 26C and 26D, the contact 7485 (FIG. 26C) by the tapered head and the tapered opening urges the optic adapter 7405 rearward causing the rear surface of the optic adapter 7405 to come into contact 7499 with the slide 7420. Referring to FIG. 26E, a gap 7487, also sized for emphasis, is also shown between a front end of the optic adapter 7405 and the slide 7420.

The contact of the surface 7499 resulting from the urging provided by the tapered opening 7485 may durably fix a position of the optic adapter 7405 relative to the slide 7420. Also, if the optic adapter 7405 takes an impact (e.g., by engaging the grip illustrated on the front end of the optic adapter 7405 with a surface to charge the firearm and/by an impact to the frame of the front end of the optic adapter 7405), the contact of the surface 7499 may reduce an amount of sheer force that may be applied to the rotatably driven fastener 7475 during the impact. Also, the contact of the surface 7499 may reduce an amount of sheer force that may be applied to the rotatably driven fastener 7475 during reciprocating action of the slide 7420.

Figure 27A:
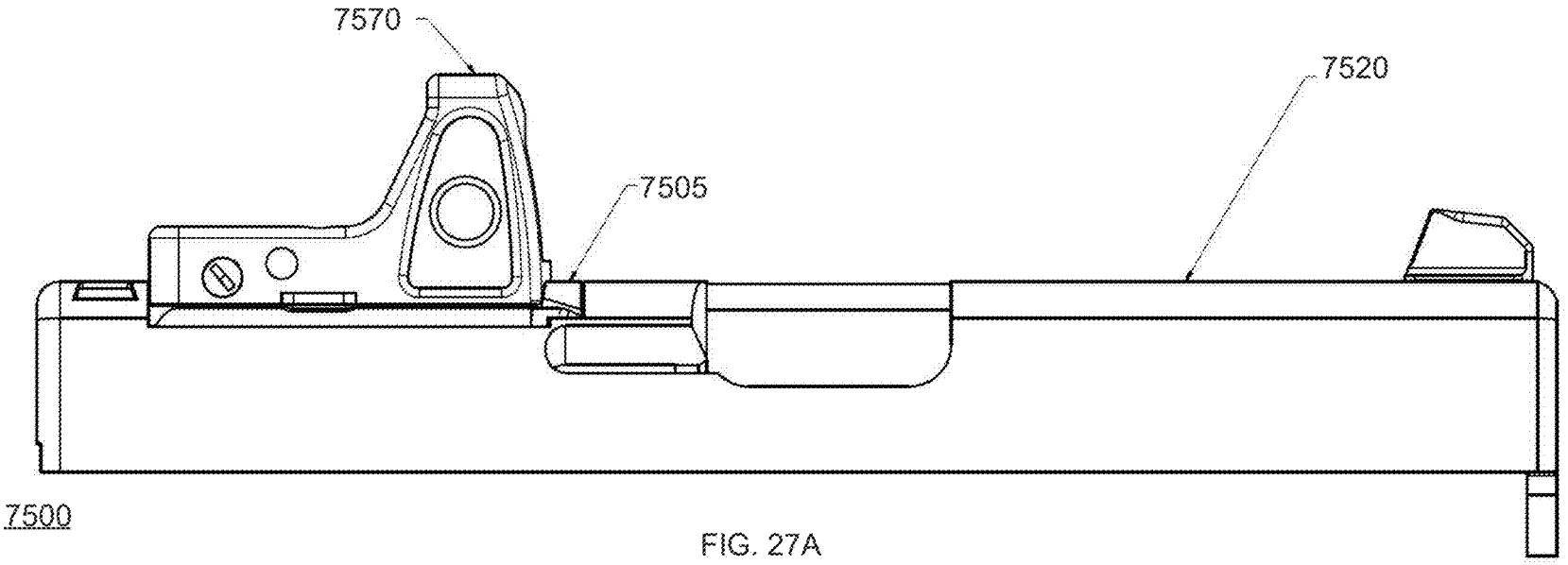
FIG. 27A illustrates a side view of another slide assembly including a tapered opening to urge contact between a mounted component and a base component, according to various embodiments.
Figure 27B:
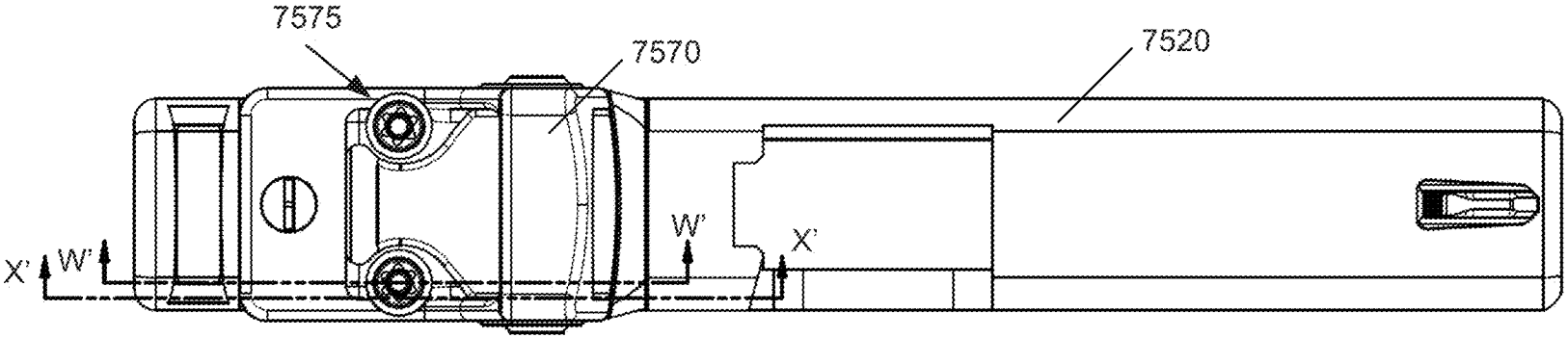
FIG. 27B illustrates a top view of the slide assembly of FIG. 27A.
Figure 27C:
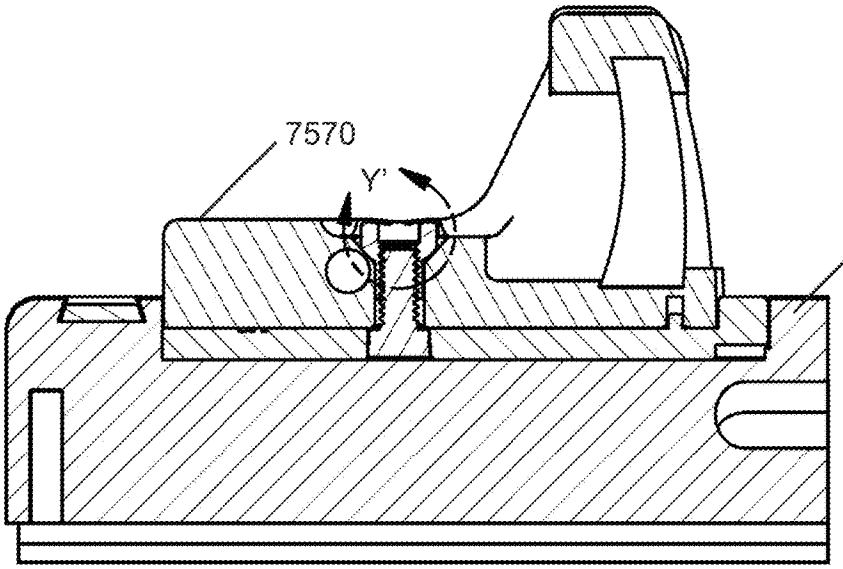
FIG. 27C illustrates a section view taken along section line W'W' of FIG. 27A.
Figure 27D:
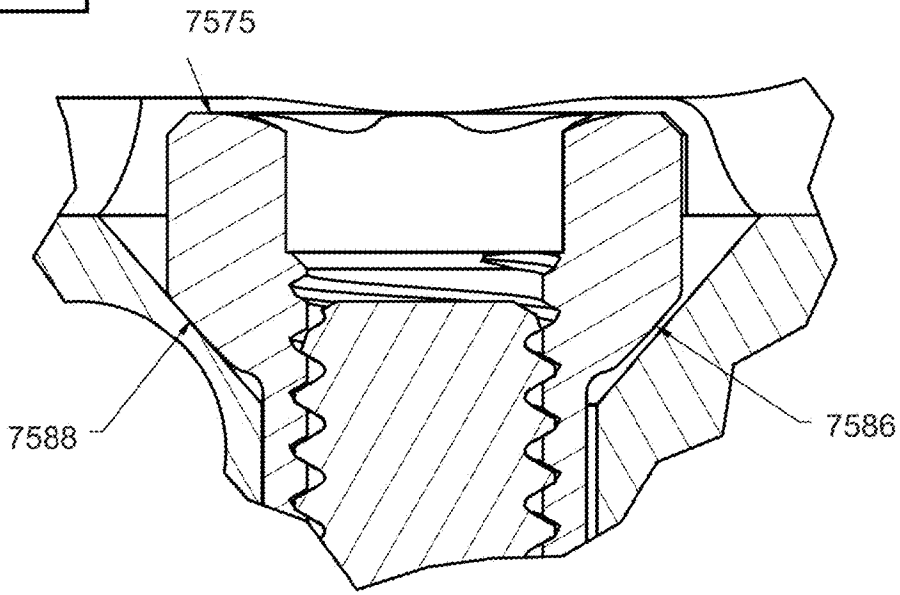
FIG. 27D illustrates a detailed view Y' of FIG. 27C.
Figure 27E:
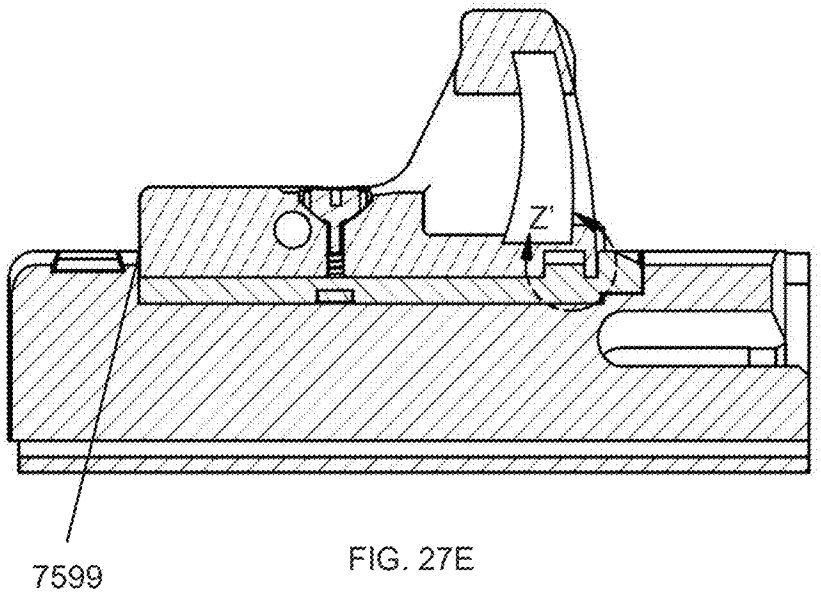
FIG. 27E illustrates a section view taken along section line X'X' of FIG. 27A.
Figure 27F:
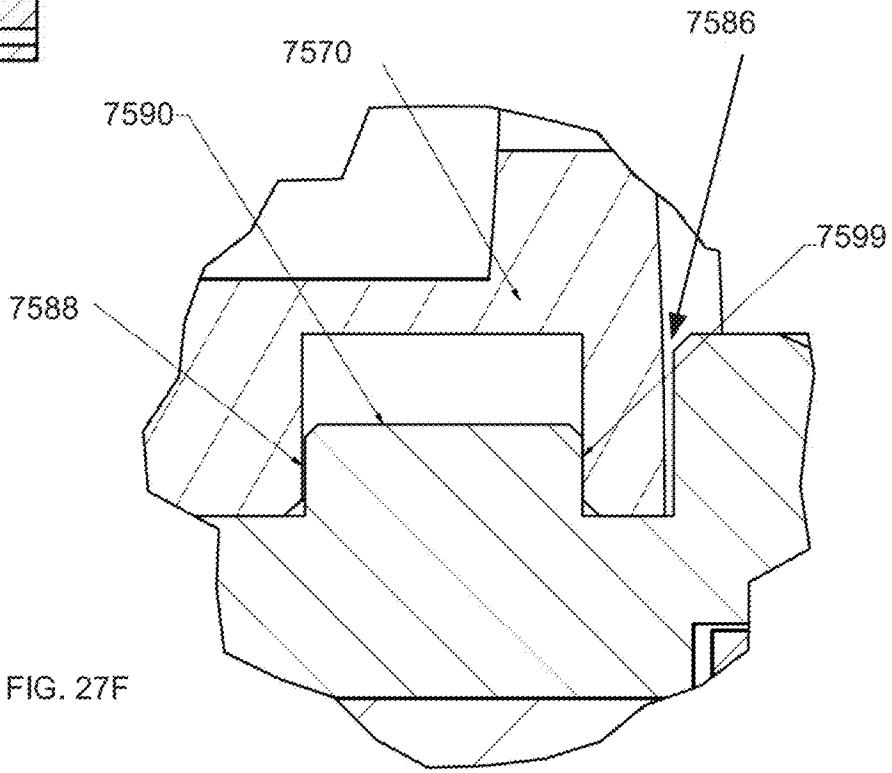
FIG. 27F illustrates a detailed view Z' taken of FIG. 27E.
Figure 28C:
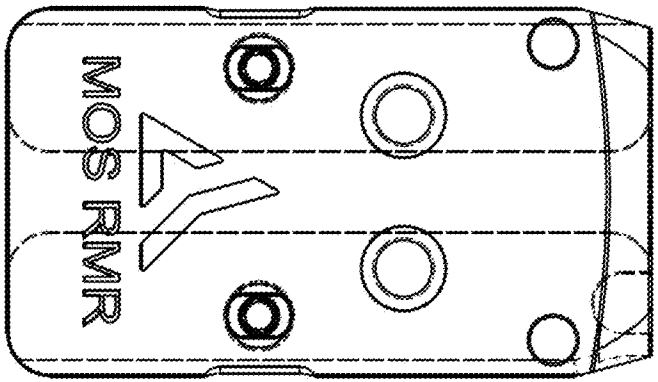
FIG. 28C illustrates a top view of an optic adapter assembly including the optic adapter of FIG. 27A.
Figure 28D:
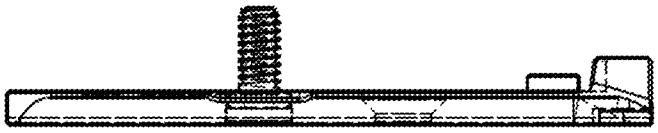
FIG. 28D illustrates a side view of the optic adapter assembly of FIG. 28C.
Figure 28A:
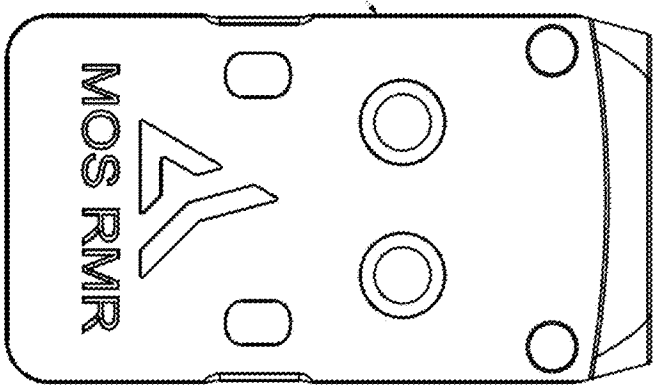
FIG. 28A illustrates a top view of the optic adapter of FIG. 27A.
Figure 28B:
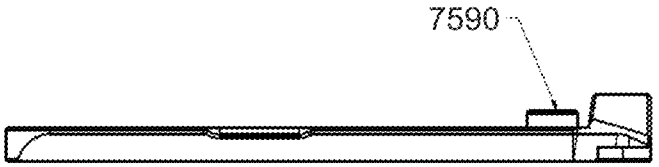
FIG. 28B illustrates a side view of the optic adapter of FIG. 27A.

FIGS. 27A and 27B illustrates a side view of another slide assembly 7500 including a tapered opening to urge contact between a mounted component and a base component, according to various embodiments. FIG. 27B illustrates a top view of the slide assembly of FIG. 27A. FIG. 27C illustrates a section view taken along section line W'W' of FIG. 27A. FIG. 27D illustrates a detailed view Y' of FIG. 27C. FIG. 27E illustrates a section view taken along section line X'X' of FIG. 27A. FIG. 27F illustrates a detailed view Z' taken of FIG. 27E. FIG. 28A illustrates a top view of the optic adapter 7505 of FIG. 27A. FIG. 28B illustrates a side view of the optic adapter 7505 of FIG. 27A. FIG. 28C illustrates a top view of an optic adapter assembly including the optic adapter 7505 of FIG. 27A. FIG. 28D illustrates a side view of the optic adapter assembly of FIG. 28C.

The optic adapter 7505 may be similar in any respect to the optic adapter 7405 (FIG. 26A) or any other optic adapter described herein. The slide 7520 may be similar to any slide described herein. In this example, the rotatably driven fastener is a nut 7575, which may be similar to any nut described herein.

Referring to FIGS. 27C and 27D, in this embodiment the tapered opening is defined by the optic 7570. As a threaded section of the nut 7575 is installed onto a corresponding section of the slide 7520 (e.g., onto the threaded post of the bottom up fastener, in this example), contact 7588 by the non-threaded section of the nut 7575 and the tapered opening defined by the optic 7570 urges/drives the optic 7570 rearward, producing contact 7599 (FIG. 27E). A gap 7586 (FIG. 27F) may be similar to gap 7486 (FIG. 26C).

Referring now to FIGS. 27E and 27F, the urging also produces contact 7599 between the optic 7570 and part of a recoil post 7590 defined by the top side of the optic adapter 7505. This contact 7599 may fix a position of the optic 7570 relative to the optic adapter 7505 in a similar way that the contact 7499 (FIG. 26D) fixes a position of the optic adapter 7405 relative to the slide 7420. The contact 7599 may also protect the threaded post of the bottom-up fastener from sheer forces in a similar way that the contact 7499 may protect the rotatably driven fastener 7475 from sheer forces. The other side of the recoil post 7590 may define a gap 7586. FIGS. 28A-D illustrate the optic adapter 7520, and show a location of the recoil post 7590.

Figure 29A:
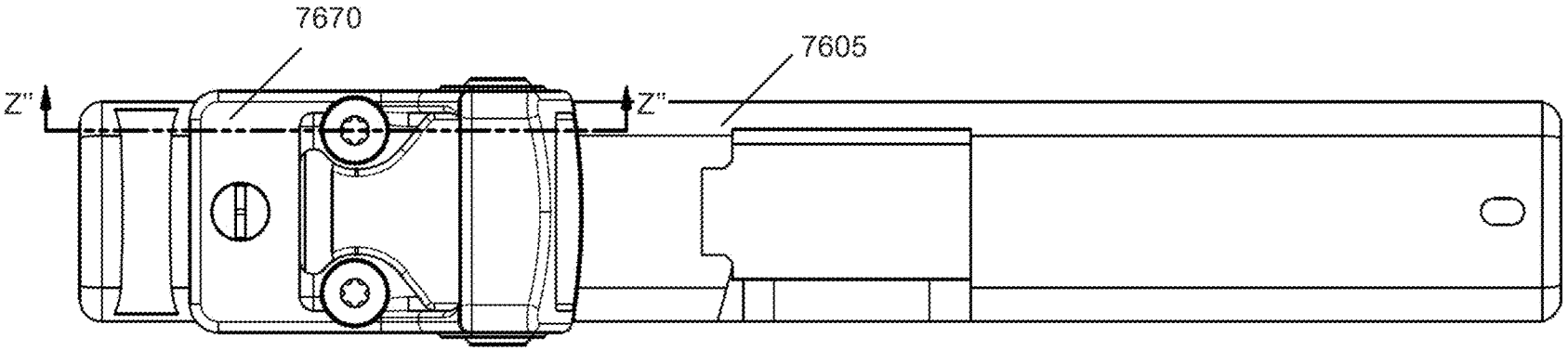
FIG. 29A illustrates a top view of another slide assembly including a tapered opening to urge contact between a mounted component and a base component, according to various embodiments.
Figure 29B:
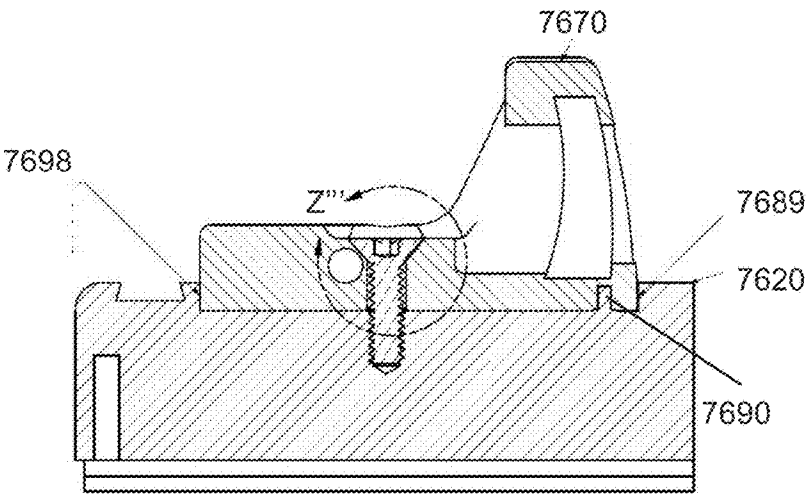
FIG. 29B illustrates a section view taken along section line Z"Z" of FIG. 29A.
Figure 29C:
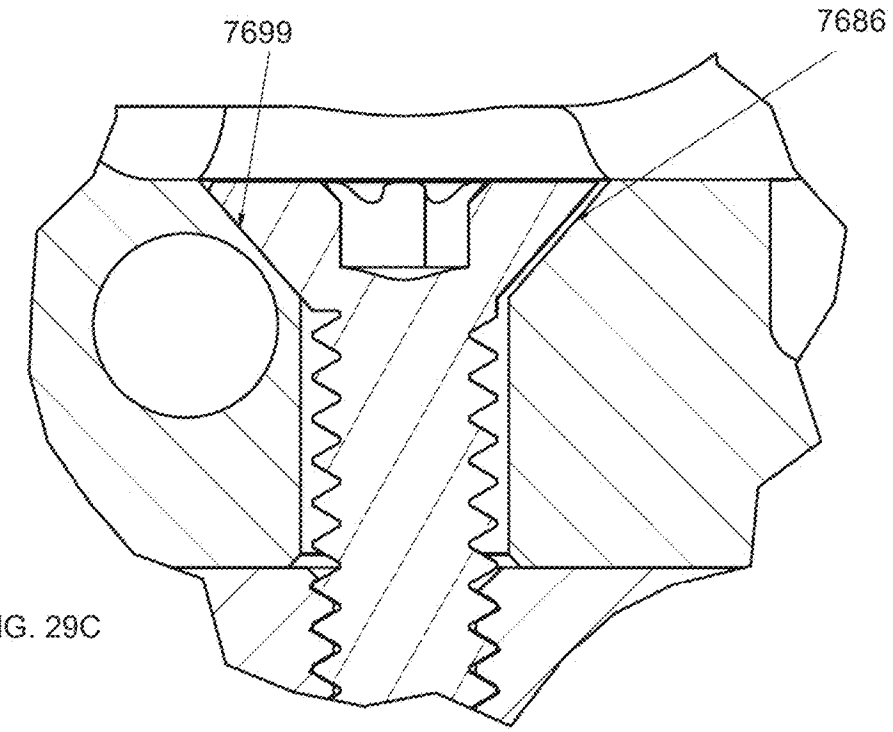
FIG. 29C illustrates a detailed view Z" of FIG. 29B.

A tapered opening may also be used in a direct mount embodiment. FIG. 29A illustrates a top view of another slide assembly 7600 including a tapered opening to urge contact between a mounted component and a base component, according to various embodiments. FIG. 29B illustrates a section view taken along section line Z"Z" of FIG. 29A. FIG. 29C illustrates a detailed view Z'" of FIG. 29B.

Referring to FIG. 29A, the optic 7670 may be similar in any respect to the optic 7570 (FIG. 27A). The slide 7605 may be similar in any respect to any slide described herein, and its top surface may be similar in any respect to any top surface of any optic adapter described herein. The top surface of the slide 7605 may define a recoil post 7690 (FIG. 29B), which may be similar to any recoil post described herein.

Referring now to FIGS. 29B and 29C, the when the fastener is tightened, contact 7699 of the head with the tapered opening may drive the optic 7670 in a rearward direction-a gap 7686 may also form. The forward urging may result in contact 7698 by a surface of a rear end of the optic 7670 with the slide 7620, which may be similar in any respect to the contact 7499 (FIG. 26D) by the surface of the rear end of the optic adapter 7405 and the slide 7420. The rearward urging may also result in contact by the recoil post 7690 and the optic 7670 similar in any respect to the contact by the recoil post 7590 (FIG. 27F) and the optic 7570. A position of the optic 7670 relative to the slide 7620 may be fixed based on the contact 7689 and/or recoil post contact. A gap 7689 may form in front of the optic 7670.

In any of the embodiments described above, an apparatus may include an assembly to operate in a recoil environment in which the assembly is mounted on a device that produces or transmits recoil. At least one part of the assembly (e.g., an optic, an optic adapter, or some other at least one body) may be fastened to at least one surface of at least one base part, the at least one base part comprising another part of the assembly (e.g., an optic adapter or a slide), a reciprocating part of a recoil-producing device (e.g., a slide), or another part of the recoil-producing device. The at least one part and the at least one base part may include a threaded opening (e.g., a threaded hole defined by a slide, or a threaded opening defined by a nut), and a non-threaded opening defining: a tapered opening to urge the at least one part of the assembly against one or more additional surfaces (e.g., against a surface defined by a recoil post, or against a surface defined by a slide), in response to installing a threaded fastener into the threaded opening (e.g., into a threaded hole) or in response to installing the threaded opening onto a threaded length (e.g., a nut onto a threaded post or other threaded length).

Figure 2B:
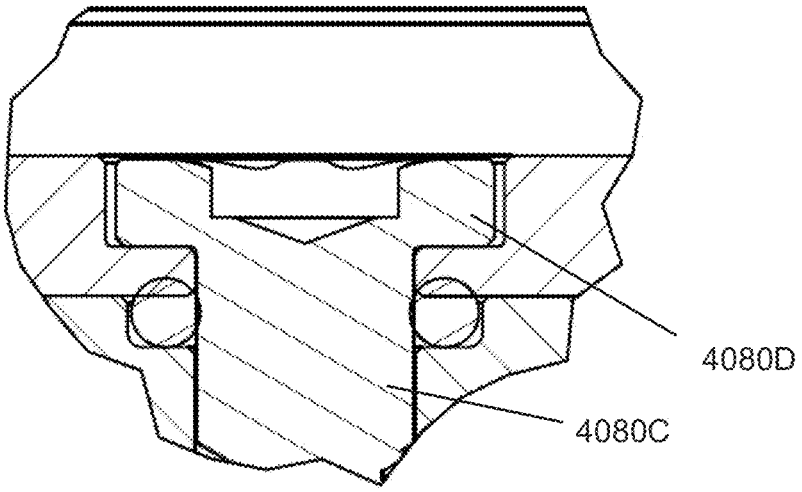
FIG. 2B illustrates a detailed view SS of FIG. 2A.

In the above-described embodiments, a tapered opening is used to urge the mounted component against a surface. In other embodiments, it may be possible to use some other counter opening having a center axis that is offset relative to a center axis of a threaded opening. For instance, FIG. 2B illustrates one example of such a counter opening (a counter opening for a flat headed rotatably driven fastener). During installation of the rotatably driven fastener, a bias can be applied by a person and/or a tool, to urge the mounted component against a surface while tightening the flat headed rotatably driven fastener.

Any non-threaded opening in an embodiment with a tapered opening to urge contact between a mounted component and a base component may include any locating features described herein, such as a non-threaded shoulder. In some embodiments, the base component may be a slide or other single part. However, this is not required. In various embodiments, the base component may be an assembly of parts (the surface that the mounted component may be urged against is not required to be the same part as the base component).

Examples in Urging Contact Between a Mounted Component and a Base Component in a Recoil Environment Example 1: An apparatus, comprising:

an assembly mountable on a firearm, wherein at least one part of the assembly is fastenable to at least one surface of at least one base part;

the at least one part and the at least one base part including: a threaded opening, and a non-threaded opening defining a tapered opening arranged to urge the at least one part of the assembly against at least one additional surface, in response to fastening the at least one part of the assembly to the at least one base part using the threaded opening.

Example 2: The apparatus of example 1 or any other example herein, wherein the at least one additional surface is located above the at least one surfaces.

Example 3: The apparatus of example 1 or any other example herein, wherein the at least one additional surface comprises a sidewall of an opening defined by the at least one base part, wherein the at least one part of the assembly is located in the opening.

Example 4: The apparatus of example 1 or any other example herein, wherein the at least one part comprises a slide or other single part, wherein the at least one additional surface is defined by the slide or single part.

Example 5: The apparatus of example 1 or any other example herein, wherein the base part comprises another part of the assembly, a reciprocating part of the firearm, or another part of the firearm.

Example 6: The apparatus of example 1 or any other example herein, wherein the threaded opening comprises a threaded hole defined by the base part.

Example 7: The apparatus of example 1 or any other example herein, wherein the assembly includes a nut, wherein the threaded opening is defined by the nut.

Example 8: The apparatus of example 1 or any other example herein, wherein the threaded opening receives a threaded post to attach the at least one part to the at least one base part.

Example 9: The apparatus of example 1 or any other example herein, wherein the at least one surface is defined by a slide or an optic adapter, and wherein the at least one additional surface comprises part of a recoil post defined by the at least one base part or another part of the assembly.

Example 10: The apparatus of example 1 or any other example herein, wherein the assembly includes a rotatably driven fastener, a non-threaded part of which is located in the tapered opening, wherein the tapered opening is arranged to urge the at least one part of the assembly in a direction that is non-parallel with a center axis of the rotatably driven fastener.

Example 11: An apparatus, comprising:

at least one body to operate in a recoil environment in which the assembly is mounted on at least one surface of a part or assembly that produces or transmits recoil;

a rotatably driven fastener including at least one non-threaded section and at least one threaded section, wherein the at least one threaded section comprising an interior of the rotatably driven fastener or an exterior of the rotatably driven fastener;

the at least one body including:

an attachment interface arranged to attach the at least one body to the at least one surface, the attachment interface including a tapered opening to receive the at least one non-threaded section of the rotatably driven fastener;

wherein the attachment interface is arranged to urge the at least one body against at least one additional surface, in response to tightening the rotatably driven fastener.

Example 12: The apparatus of example 11 or any other example herein, wherein the part or assembly that produces or transmits recoil comprises a reciprocating part, or at least one part mountable on the reciprocating part.

Example 13, The apparatus of example 12 or any other example herein, wherein the reciprocating part is a slide.

Example 14: The apparatus of example 11 or any other example herein, wherein the at least one body comprises an optic or an optic adapter.

Example 15: The apparatus of example 11 or any other example herein, wherein the rotatably driven fastener comprises a nut.

Example 16: The apparatus of example 11 or any other example herein, wherein the at least one threaded section of the rotatably driven fastener comprises an external thread.

We claim all modifications and variations coming within the spirit and scope of the following claims.

The invention claimed is:

1. An apparatus, comprising:

a locating optic assembly mount arranged to receive a direct-mount optic sight or an adapter on which another optic sight is installable, wherein the locating optic assembly mount includes:

a locating fastener opening to receive a locating fastener with a threaded section and a non-threaded shoulder, the locating fastener including a portion extending into the direct-mount optic sight or the adapter and another portion below a surface located below the direct-mount optic sight or the adapter, wherein the other portion of the locating fastener includes at least a portion of the non-threaded shoulder;

the locating fastener opening including:

a threaded hole to mate with the threaded section of the locating fastener; and a counter opening located above the threaded hole, wherein the counter opening is arranged to slip fit with the non-threaded shoulder to align a center axis of the locating fastener with a center axis of the locating fastener opening.

2. The apparatus of claim 1, wherein the locating fastener opening comprises part of a first attachment feature to releasably attach a first end of an optic assembly to a firearm, the optic assembly including the direct-mount optic sight or the adapter, and the other optic sight, and wherein the apparatus further comprises a second attachment feature to releasably attach a second end of the optic assembly to the firearm.

3. The apparatus of claim 2, wherein the second attachment feature comprises a non-threaded structure or recess to mate with a corresponding non-threaded recess or structure, respectively, on the second end of the optic assembly, or wherein the first and second attachment features utilize a heterogeneous group of fastener openings, including the locating fastener opening and at least one different fastener opening to receive at least one different fastener.

4. The apparatus of claim 1, wherein the locating fastener further comprises a head, and the apparatus further comprising a pair of counter openings located above the threaded hole, a counter opening of the pair comprising at least one counter bore, wherein the locating counter opening comprises the at least one counter bore;

wherein the other counter opening of the pair comprises a counter sink or a counter bore to clearance fit with a sidewall of the head.

5. The apparatus of claim 4, wherein the pair of counter openings comprises a pair of coaxial counter openings.

6. The apparatus of claim 5, wherein the locating fastener includes a head, and wherein the other counter opening of the pair comprises a counter sink arranged to clearance fit with a sidewall of the head.

7. The apparatus of claim 1, further comprising:

an optic assembly including the direct-mount optic sight or the adapter and the other optic sight;

an additional locating fastener opening, wherein the additional locating fastener opening is located on a different end of the locating optic assembly mount than the locating fastener opening.

8. The apparatus of claim 1, wherein the locating fastener opening further comprises an additional counter opening forming a pocket for a seal.

9. The apparatus of claim 1, wherein the locating optic assembly mount is formed on a slide or another firearm component.

10. The apparatus of claim 1, wherein the threaded hole is formed in a firearm accessory.

11. The apparatus of claim 1, wherein a portion of an underside of the direct-mount optic sight or a portion of an underside of the adapter includes a footprint, wherein, when the direct-mount optic sight or the adapter is attached to the locating optic assembly mount, the locating fastener opening is non-overlapping with the footprint.

12. An apparatus, comprising:

a locating fastener including a threaded section and non-threaded shoulder;

a firearm part including a mount, the mount arranged to receive a direct-mount optic sight or an adapter on which another optic sight is mountable, the mount comprising a surface;

a locating fastener opening in which the locating fastener is installable to attach, to the firearm part, 1) the direct-mount optic sight or 2) the adapter, the locating fastener opening including:

a threaded hole to mate with the threaded section of the locating fastener; and a counter opening located above the threaded hole, wherein the counter opening is arranged to slip fit with the non-threaded shoulder of the locating fastener to align a center axis of the locating fastener with a center axis of the locating fastener opening;

wherein when the direct-mount optic sight or the adapter is attached to the firearm part using the locating fastener, the non-threaded shoulder extends below said surface of the mount.

13. The apparatus of claim 12, wherein the locating fastener opening comprises part of a first attachment feature to releasably attach a first end of the direct-mount optic sight or a first end of the adapter to a firearm, the firearm comprising the firearm part; and wherein the apparatus further comprises a second attachment feature to releasably attach, to the firearm, a second end of the direct-mount optic sight or a second end of the adapter.

14. The apparatus of claim 13, wherein the second attachment feature comprises a non-threaded structure or recess to mate with a corresponding non-threaded recess or structure, respectively, on the second end of the optic sight or the direct-mount second end of the adapter, or wherein the first and second attachments features utilize a heterogeneous group of fastener openings, including the locating fastener opening and at least one different fastener opening to receive at least one different fastener.

15. The apparatus of claim 12, wherein the locating fastener further includes a head, and the apparatus further comprises:

a pair of counter openings located above the threaded hole, a counter opening of the pair comprising at least one counter bore, wherein the locating counter opening comprises the at least one counter bore;

wherein the other counter opening of the pair comprises a counter sink or a counter bore to clearance fit with a sidewall of the head of the locating fastener.

16. The apparatus of claim 15, wherein the pair of counter openings comprises a pair of coaxial counter openings.

17. The apparatus of claim 12, wherein the firearm part comprises a pocket for a seal, wherein the pocket comprises a counter sink associated with the locating fastener opening.

18. The apparatus of claim 12, wherein the locating fastener further includes a head, and the firearm part includes a counter sink associated with the locating fastener opening, the counter sink arranged to clearance fit with a sidewall of the head.

19. The apparatus of claim 12, wherein the firearm part comprises a slide.

20. The apparatus of claim 12, wherein the firearm part comprises a firearm accessory.

21. The apparatus of claim 12, wherein a portion of the surface includes a footprint, characterized in that, when the adapter is attached to the surface, a frontmost portion of the footprint is located forwardly of a frontmost portion of an optic footprint of the adapter.

22. A kit of parts, comprising:

an adapter to mount, to a firearm part, an optic sight, the adapter characterized in that it includes:

an optic footprint corresponding to an underside of the optic sight, and a counter opening;

a locating fastener to mount the adapter on a surface of the firearm part, the locating fastener characterized in that it includes:

a portion to extend into the adapter, wherein at least some of the portion is locatable in the counter opening, and another portion to extend below the surface;

the locating fastener including a threaded section to mate with a threaded hole in the firearm part;

the locating fastener further including a non-threaded shoulder arranged to slip fit with another counter opening, to align a center axis of the locating fastener with a center axis of the other counter opening;

wherein when the adapter is mounted on the surface using the locating fastener, the non-threaded shoulder extends below said surface.

23. The kit of parts of claim 22, the locating fastener further comprising:

terminal ends; and a head including:

a terminal end of the terminal ends, and a length;

wherein the portion of the locating fastener comprises a portion of the length of the head and the counter opening is arranged to have clearance with the portion of the length of the head.

24. The kit of parts of claim 22, wherein the portion of the locating fastener is tapered.

25. The kit of parts of claim 22, wherein when the adapter is installed on the surface of the firearm part, the adapter is releasable by removing a single rotatably-driven part from the firearm part, wherein the single rotatably-driven part comprises the locating fastener.

26. The kit of parts of claim 22, wherein the adapter comprises an adapter plate.

27. The kit of parts of claim 22, wherein the adapter includes a surface comprising the optical footprint, and another surface, in which the other surface covers a portion of the surface of the firearm part when the adapter is mounted to the firearm part.

28. The kit of parts of claim 22, the locating fastener further characterized in that it includes:

a terminal end insertable in the threaded hole to install the locating fastener, and another terminal end, wherein when the optic sight is mounted to the firearm part using the adapter, the other terminal end is located underneath a body of the optic sight and in which the other terminal end is concealed by said body.

29. The kit of parts of claim 22, the adapter further characterized in that, when the optic sight is mounted to the firearm part using the adapter:

one of the portion of the locating fastener and said portion of the underside of the optic sight is located completely forwardly of the other.

30. The kit of parts of claim 22, the locating fastener further characterized in that it includes:

a terminal end insertable in the threaded hole to install the locating fastener, and another terminal end, wherein when the optic sight is mounted to the firearm part using the adapter, one of said portion of the underside of the optic sight and the other terminal end is located completely forward of the other.

31. The kit of parts of claim 22, the locating fastener further characterized in that it includes:

a terminal end insertable in the threaded hole to install the locating fastener, and another terminal end, wherein when the adapter is mounted to the firearm part the other terminal end does not protrude from the counter opening.

32. The kit of parts of claim 22, further comprising:

another fastener to attach the optic sight to the adapter, the other fastener having a threaded section, a portion of which protrudes from a body of the optic sight when the optic sight is mounted to the firearm part using the adapter; and wherein the other fastener comprises an externally threaded part and the kit of parts further comprises an internally threaded part which is removable from the protruding portion of the threaded section of the other fastener to release the optic sight from the adapter.

33. A firearm part, a firearm assembly, or a firearm, comprising:

a mount arranged to attach thereto, using one or more threaded parts, a direct-mount optic sight or an adapter on which another optic sight is mountable;

a surface of the mount including:

one or more openings to receive the one or more threaded parts, respectively, and a footprint associated with:

a portion of an underside of the direct-mount optic sight, or a portion of an underside of the adapter, and at least one opening of the one or more openings coincident with the footprint;

the at least one opening arranged to align a center axis of a respective one of the one or more threaded parts with a center axis of the at least one opening during installation of the respective one of the one or more threaded parts in the at least one opening, each opening of the at least one opening including:

a threaded hole to mate with a threaded section of the respective one of the one or more threaded parts; and a counter opening located above the threaded hole, wherein the counter opening is arranged to slip fit with a non-threaded shoulder of the respective one of the one or more threaded parts to align the center axes;

wherein when the direct-mount optic sight or the adapter is attached to the firearm, the firearm assembly, or the firearm part using the one or more threaded parts, the non-threaded shoulder(s) extend below said surface of the mount.

34. The firearm, firearm assembly, or firearm part of claim 33, wherein the adapter comprises an RMR footprint or another optic footprint.

35. An optic assembly or an adapter assembly installable on the firearm part, the firearm assembly, or the firearm of claim 33, the optic assembly or the adapter assembly comprising:

the direct-mount optic sight or the adapter, respectively.

36. The optic assembly or the adapter assembly of claim 35, further comprising:

an additional counter opening located above a counter opening of the counter opening(s) when the direct-mount optic sight or the adapter is attached to the firearm part, the firearm assembly, or the firearm;

wherein a respective one of the non-threaded shoulder(s) comprises a portion of a corresponding one of the one or more threaded parts; and wherein the additional counter opening is arranged to receive another portion of the corresponding one of the one or more threaded parts, when the direct-mount optic sight or the adapter is attached to the firearm part, the firearm assembly, or the firearm.

37. The firearm, firearm assembly, or firearm part of claim 33, wherein the surface comprises a pocket for a seal, wherein the pocket is coaxial with a corresponding one of the counter opening(s).

38. The firearm, firearm assembly, or firearm part of claim 33, wherein the surface comprises a pocket for a seal, the pocket characterized in that, when the seal is installed therein, the seal makes contact with a portion of a corresponding threaded part of the one or more threaded parts.

* * * * *